US011429043B2

(12) United States Patent
Seki

(10) Patent No.: US 11,429,043 B2
(45) Date of Patent: Aug. 30, 2022

(54) IMAGE FORMING APPARATUS HAVING VARIABALE HEAT GENERATION STATES

(71) Applicant: Takayuki Seki, Kanagawa (JP)

(72) Inventor: Takayuki Seki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/183,693

(22) Filed: Feb. 24, 2021

(65) Prior Publication Data

US 2021/0271190 A1 Sep. 2, 2021

(30) Foreign Application Priority Data

Feb. 28, 2020 (JP) ..... JP2020-033188
May 19, 2020 (JP) ..... JP2020-087546

(51) Int. Cl.
*G03G 15/20* (2006.01)

(52) U.S. Cl.
CPC ..... *G03G 15/205* (2013.01); *G03G 15/2053* (2013.01); *G03G 15/2064* (2013.01); *G03G 15/2042* (2013.01); *G03G 2215/2032* (2013.01)

(58) Field of Classification Search
CPC ..... G03G 15/205; G03G 15/2042; G03G 15/2039; B65H 7/06
See application file for complete search history.

(56) References Cited

U.S. PATENT DOCUMENTS

2013/0108300 A1* 5/2013 Fujii ..... G03G 15/2042 399/69
2016/0085189 A1 3/2016 Arimoto et al.
2016/0238975 A1 8/2016 Seki et al.
2017/0185020 A1 6/2017 Seki et al.
2017/0185021 A1 6/2017 Seki et al.
2017/0255147 A1 9/2017 Seki et al.
2017/0364000 A1 12/2017 Seki et al.
2018/0173138 A1 6/2018 Seki et al.
2020/0174408 A1 6/2020 Furuichi et al.
2020/0209791 A1 7/2020 Seki
2020/0249604 A1 8/2020 Adachi et al.
(Continued)

FOREIGN PATENT DOCUMENTS

JP 2015-166795 9/2015
JP 2016-062024 4/2016
(Continued)

*Primary Examiner* — Arlene Heredia
(74) *Attorney, Agent, or Firm* — Harness, Dickey & Pierce, P.LC.

(57) ABSTRACT

An image forming apparatus includes a heating device including a rotator member, a heating member configured to heat the rotator member. The heating member is switchable between a first heat generation state in which an amount of heat generated on a first side is larger than an amount of heat generated on a second side in the intersection direction and a second heat generation state in which the amount of heat generated on the second side is larger than the amount of heat generated on the first side, The image forming apparatus is configured to switch between the first heat generation state and the second heat generation state while executing a job of continuously forming an image on a plurality of recording media having a same length in the intersecting direction.

18 Claims, 45 Drawing Sheets

(56) References Cited

U.S. PATENT DOCUMENTS

| | | | | |
|---|---|---|---|---|
| 2020/0285179 | A1 | 9/2020 | Seki | |
| 2020/0292973 | A1 | 9/2020 | Furuichi et al. | |
| 2020/0377318 | A1* | 12/2020 | Iwasaki | G03G 15/55 |
| 2021/0165350 | A1 | 6/2021 | Seki | |

FOREIGN PATENT DOCUMENTS

| | | |
|---|---|---|
| JP | 2016-114914 | 6/2016 |
| JP | 2017-173581 | 9/2017 |
| JP | 2017-191149 | 10/2017 |
| JP | 2018-032631 | 3/2018 |

* cited by examiner

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 6400 | 3600 | 1600 | 400 | - | - |
| AMOUNT OF HEAT GENERATED BY SECOND POWER SUPPLY LINE 62B | - | 25 | 225 | 1225 | 3025 | 5625 | 9025 |
| AMOUNT OF HEAT GENERATED BY FOURTH POWER SUPPLY LINE 62D | 25 | 25 | 25 | 25 | 25 | 25 | - |
| TOTAL AMOUNT OF GENERATED HEAT | 10025 | 6450 | 3850 | 2850 | 3450 | 5650 | 9025 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 6400 | 3600 | 1600 | 400 | - | - |
| AMOUNT OF HEAT GENERATED BY SECOND POWER SUPPLY LINE 62B | - | 400 | 1600 | 3600 | 6400 | 10000 | 14400 |
| AMOUNT OF HEAT GENERATED BY FOURTH POWER SUPPLY LINE 62D | 400 | 400 | 400 | 400 | 400 | 400 | - |
| TOTAL AMOUNT OF GENERATED HEAT | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 6400 | 3600 | 1600 | 400 | - | - |
| AMOUNT OF HEAT GENERATED BY SECOND POWER SUPPLY LINE 62B | - | 25 | 225 | 1225 | 3025 | 5625 | 9025 |
| AMOUNT OF HEAT GENERATED BY FOURTH POWER SUPPLY LINE 62D | 25 | 25 | 25 | 25 | 25 | 25 | - |
| AMOUNT OF HEAT GENERATED BY FIFTH POWER SUPPLY LINE 62E | 10000 | 10000 | 10000 | 10000 | 10000 | 10000 | 10000 |
| TOTAL AMOUNT OF GENERATED HEAT | 20025 | 16450 | 13850 | 12850 | 13450 | 15650 | 19025 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 6400 | 3600 | 1600 | 400 | - | - |
| AMOUNT OF HEAT GENERATED BY SECOND POWER SUPPLY LINE 62B | - | 400 | 1600 | 3600 | 6400 | 10000 | 14400 |
| AMOUNT OF HEAT GENERATED BY FOURTH POWER SUPPLY LINE 62D | 400 | 400 | 400 | 400 | 400 | 400 | - |
| AMOUNT OF HEAT GENERATED BY FIFTH POWER SUPPLY LINE 62E | 19600 | 19600 | 19600 | 19600 | 19600 | 19600 | 19600 |
| TOTAL AMOUNT OF GENERATED HEAT | 30000 | 26800 | 25200 | 25200 | 26800 | 30000 | 34000 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 10000 | 6400 | 3600 | 1600 | 400 | - |
| AMOUNT OF HEAT GENERATED BY SECOND POWER SUPPLY LINE 62B | - | 25 | 225 | 1225 | 3025 | 5625 | 9025 |
| AMOUNT OF HEAT GENERATED BY THIRD POWER SUPPLY LINE 62C | 25 | - | - | - | - | - | - |
| AMOUNT OF HEAT GENERATED BY FOURTH POWER SUPPLY LINE 62D | 25 | 25 | 25 | 25 | 25 | 25 | 25 |
| TOTAL AMOUNT OF GENERATED HEAT | 10050 | 10050 | 6650 | 4850 | 4650 | 6050 | 9050 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 10000 | 6400 | 3600 | 1600 | 400 | - |
| AMOUNT OF HEAT GENERATED BY SECOND POWER SUPPLY LINE 62B | - | 400 | 1600 | 3600 | 6400 | 10000 | 14400 |
| AMOUNT OF HEAT GENERATED BY THIRD POWER SUPPLY LINE 62C | 400 | - | - | - | - | - | - |
| AMOUNT OF HEAT GENERATED BY FOURTH POWER SUPPLY LINE 62D | 400 | 400 | 400 | 400 | 400 | 400 | 400 |
| TOTAL AMOUNT OF GENERATED HEAT | 10800 | 10800 | 8400 | 7600 | 8400 | 10800 | 14800 |

FIG.61

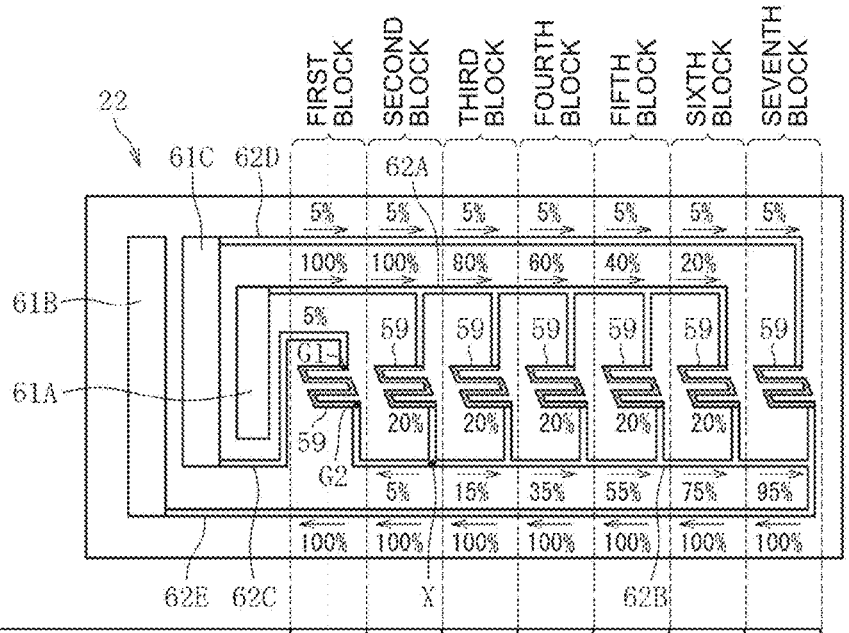

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 10000 | 6400 | 3600 | 1600 | 400 | - |
| AMOUNT OF HEAT GENERATED BY SECOND POWER SUPPLY LINE 62B | - | 25 | 225 | 1225 | 3025 | 5625 | 9025 |
| AMOUNT OF HEAT GENERATED BY THIRD POWER SUPPLY LINE 62C | 25 | - | - | - | - | - | - |
| AMOUNT OF HEAT GENERATED BY FOURTH POWER SUPPLY LINE 62D | 25 | 25 | 25 | 25 | 25 | 25 | 25 |
| AMOUNT OF HEAT GENERATED BY FIFTH POWER SUPPLY LINE 62E | 10000 | 10000 | 10000 | 10000 | 10000 | 10000 | 10000 |
| TOTAL AMOUNT OF GENERATED HEAT | 20050 | 20050 | 16650 | 14850 | 14650 | 16050 | 19050 |

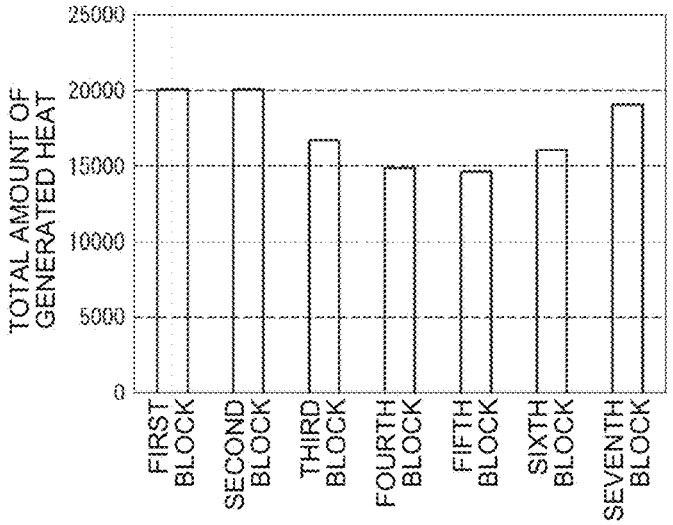

FIG.62

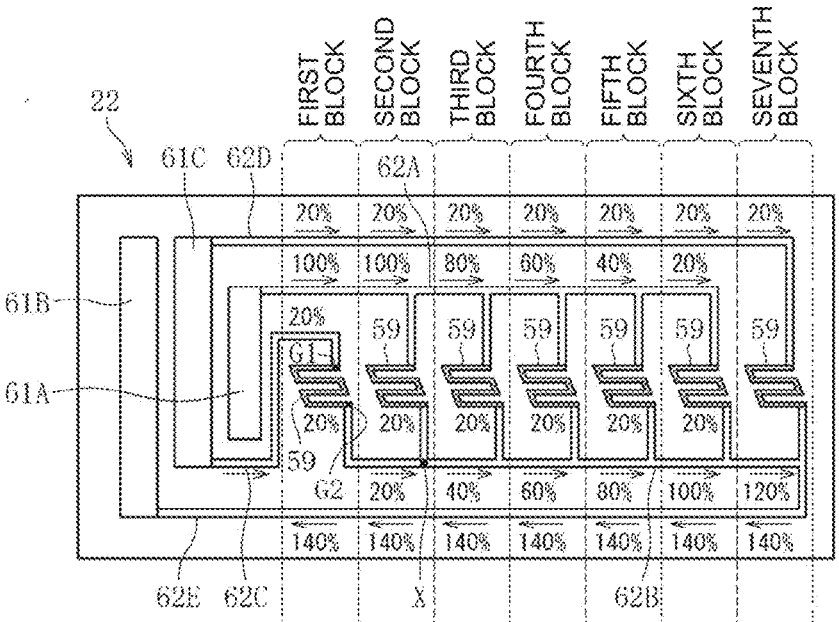

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATED BY FIRST POWER SUPPLY LINE 62A | 10000 | 10000 | 6400 | 3600 | 1600 | 400 | - |
| AMOUNT OF HEAT GENERATED BY SECOND POWER SUPPLY LINE 62B | - | 400 | 1600 | 3600 | 6400 | 10000 | 14400 |
| AMOUNT OF HEAT GENERATED BY THIRD POWER SUPPLY LINE 62C | 400 | - | - | - | - | - | - |
| AMOUNT OF HEAT GENERATED BY FOURTH POWER SUPPLY LINE 62D | 400 | 400 | 400 | 400 | 400 | 400 | - |
| AMOUNT OF HEAT GENERATED BY FIFTH POWER SUPPLY LINE 62E | 19600 | 19600 | 19600 | 19600 | 19600 | 19600 | 19600 |
| TOTAL AMOUNT OF GENERATED HEAT | 30400 | 30400 | 28000 | 27200 | 28000 | 30400 | 34400 |

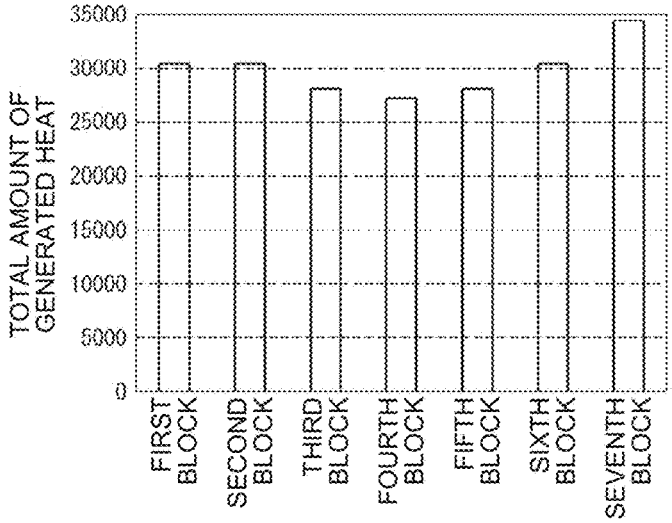

IMAGE FORMING APPARATUS HAVING VARIABALE HEAT GENERATION STATES

CROSS-REFERENCE TO RELATED APPLICATIONS

The present application claims priority under 35 U.S.C. § 119 to Japanese Patent Application No. 2020-033188, filed on Feb. 28, 2020 and Japanese Patent Application No. 2020-087546, filed on May 19, 2020. The contents of which are incorporated herein by reference in their entirety.

BACKGROUND OF THE INVENTION

1. Field of the Invention

The present invention relates to an image forming apparatus.

2. Description of the Related Art

As a heating device mounted on an image forming apparatus, such as a copier and a printer, a fixing device that fixes toner on a sheet by heat, a drying device that dries ink on a sheet, and the like are known.

Japanese Unexamined Patent Application Publication No. 2016-62024, for example, discloses a fixing device including a heating member (heater) provided with heating elements, an electrical contact, and a conductive pattern that electrically couples them on a rectangular substrate.

In the heating member provided with the conductive pattern on the substrate, the conductive pattern also slightly generates heat by being energized when causing the heating element to generate heat. Technically, the heat generation distribution of the entire heating member is affected by the heat generated by the conductive pattern.

The temperature distribution of the heating member may possibly be uneven due to the heat generation distribution of the conductive pattern. Consequently, the heating device including such a heating member requires measures to suppress unevenness in temperature and uneven heating of the heating device due to temperature deviation between a first side and a second side of the heating member in a direction intersecting the conveying direction of a recording medium.

SUMMARY OF THE INVENTION

An image forming apparatus is capable of forming an image on a plurality of recording media having different lengths in a direction intersecting a conveying direction of the plurality of recording media. The image forming apparatus includes a heating device including a rotator member, a heating member, and an opposed member. The heating member is configured to heat the rotator member. The opposed member is configured to contact with the rotator member to form a nip. The heating member is switchable between a first heat generation state in which an amount of heat generated on a first side is larger than an amount of heat generated on a second side in the intersection direction and a second heat generation state in which the amount of heat generated on the second side is larger than the amount of heat generated on the first side. The image forming apparatus is configured to switch between the first heat generation state and the second heat generation state while executing a job of continuously forming an image on a plurality of recording media having a same length in the intersecting direction.

BRIEF DESCRIPTION OF THE DRAWINGS

FIG. 61 is a diagram of the amount of heat generated by the power supply lines in the blocks when an unintended branch current is generated in the heater illustrated in FIG. 60; and FIG. 62 is a diagram of the amount of heat generated by the power supply lines in the blocks when all the heat generating units are energized in the heater illustrated in FIG. 60.

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
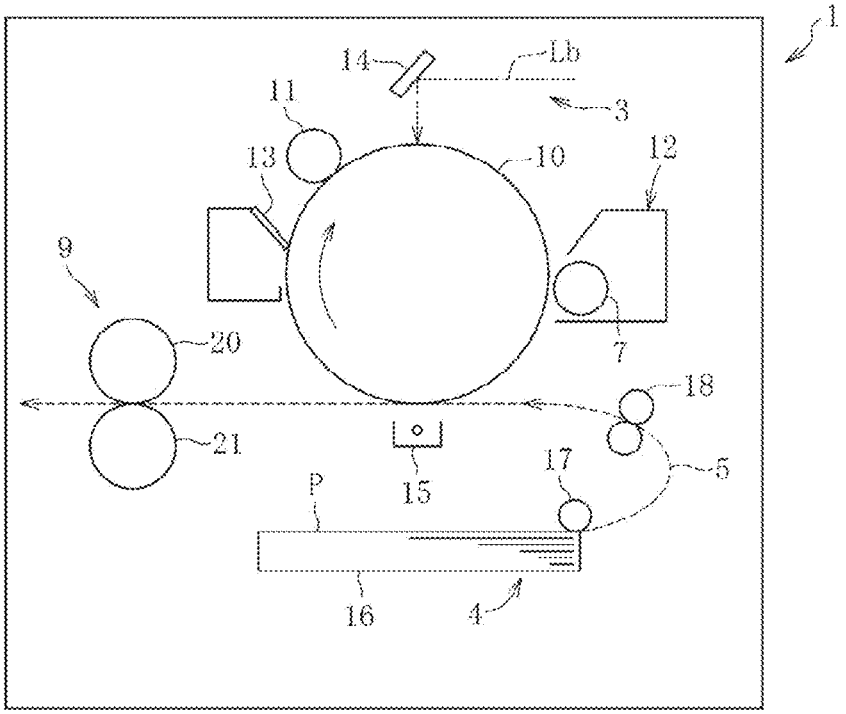
FIG. 1 is a schematic configuration diagram of an image forming apparatus according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

Exemplary embodiments according to the present invention are described below with reference to the accompanying drawings. In the figures, the same or equivalent parts are denoted by like reference numerals, and overlapping explanation thereof is appropriately simplified or omitted. In the following explanation of the embodiments, a fixing device that fixes toner by heat is described as a heating device.

A monochrome image forming apparatus 1 illustrated in FIG. 1 includes a photoconductor drum 10. The photoconductor drum 10 is a drum-shaped rotating body that can carry toner serving as developer on a surface thereof and rotates in the direction indicated by the arrow in FIG. 1. The image forming apparatus 1 includes a charging roller 11, a developing device 12, a cleaning blade 13, and other components around the photoconductor drum 10. The charging roller 11 uniformly charges the surface of the photoconductor drum 10. The developing device 12 includes a developing roller 7 that supplies toner to the surface of the photoconductor drum 10 and other components. The cleaning blade 13 is used to clean the surface of the photoconductor drum 10. The image forming apparatus 1 can perform an image formation operation on a plurality of sheets having different lengths in a direction intersecting the conveying direction of a sheet P, which will be described later. The image forming apparatus 1 can form an image on A4, A3, and B4 sheets, for example.

An exposure unit 3 is disposed above the photoconductor drum 10. The surface of the photoconductor drum 10 is irradiated with laser light Lb emitted by the exposure unit 3 based on image data via a mirror 14.

A transfer means 15 including a transfer charger is disposed at a position facing the photoconductor drum 10. The transfer means 15 transfers an image on the surface of the photoconductor drum 10 to the sheet P.

A sheet feeding unit 4 is disposed at the lower part of the image forming apparatus 1. The sheet feeding unit 4 includes a sheet feeding cassette 16, a sheet feeding roller 17, and other components. The sheet feeding cassette 16 accommodates the sheet P serving as recording media. The sheet feeding roller 17 carries out the sheet P from the sheet feeding cassette 16 to a conveyance path 5. Registration rollers 18 are disposed downstream of the sheet feeding roller 17 in the conveyance direction.

A fixing device 9 includes a fixing belt 20, a pressure roller 21, and other components. The fixing belt 20 is heated by a heating member, which will be described later. The pressure roller 21 can apply pressure to the fixing belt 20.

The following describes basic operations of the image forming apparatus 1 with reference to FIG. 1.

When an image formation operation is started, the surface of the photoconductor drum 10 is charged by the charging roller 11. The exposure unit 3 emits the laser beam Lb based on image data. The laser beam Lb lowers the electric potential of the irradiated part, thereby forming an electrostatic latent image. The surface of the photoconductor drum 10 on which the electrostatic latent image is formed is supplied with toner from the developing device 12. As a result, the electrostatic latent image is visualized as a toner image (developer image). The toner or the like left on the photoconductor drum 10 after transfer is removed by the cleaning blade 13.

When the image formation operation is started, the sheet feeding roller 17 of the sheet feeding unit 4 drives to rotate at the lower part of the image forming apparatus 1. As a result, the sheet P accommodated in the sheet feeding cassette 16 is fed out to the conveyance path 5.

The sheet P fed out to the conveyance path 5 is retained by the registration rollers 18. The sheet P is then sent to a transfer part at which the transfer means 15 faces the photoconductor drum 10 at the timing when the sheet P faces the toner image on the surface of the photoconductor drum 10. The transfer means 15 applies transfer bias to the sheet P, thereby transferring the toner image.

The sheet P to which the toner image is transferred is sent to the fixing device 9. The heated fixing belt 20 and the pressure roller 21 apply heat and pressure to the sheet P, thereby fixing the toner image on the sheet P. The sheet P on which the toner image is fixed is separated from the fixing belt 20. The sheet P is conveyed by a pair of conveyance rollers provided downstream of the fixing device 9 and is ejected to a paper ejection tray provided outside the apparatus. In FIG. 1, the conveyance path 5 from the transfer position to the fixing device 9 is a linear path for descriptive purposes. In an actual configuration, the conveyance direction varies as described below, and the fixing device 9 is made by a fixing entrance guide.

The following describes the configuration of the fixing device 9 in greater detail.

Figure 2:
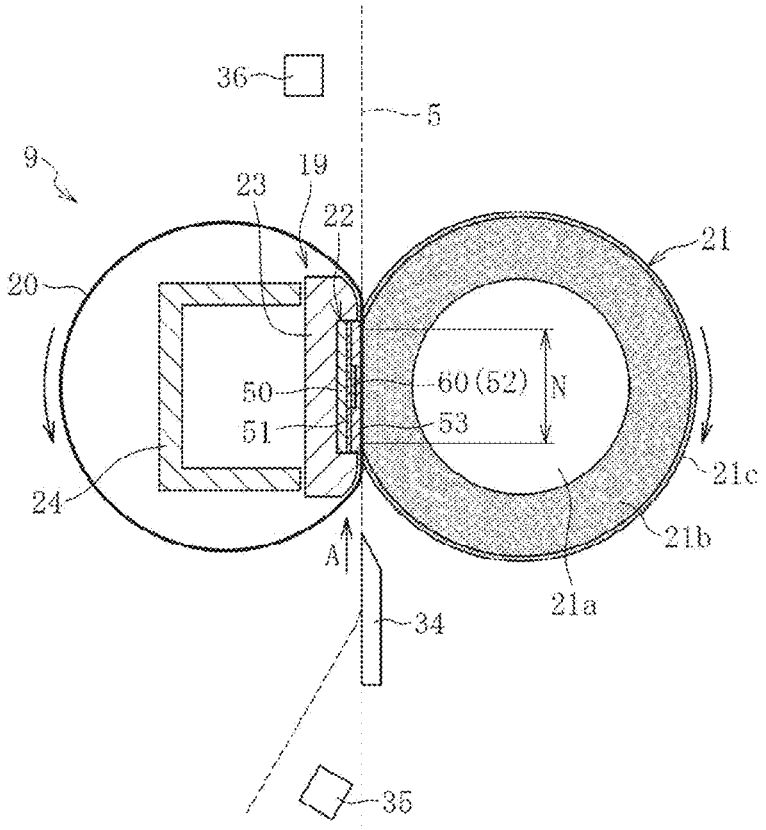
FIG. 2 is a schematic configuration diagram of a fixing device.

As illustrated in FIG. 2, the fixing device 9 according to the present embodiment includes the fixing belt 20, the pressure roller 21, and a heating unit 19. The fixing belt 20 serves as a rotator member or a fixing member. The pressure roller 21 serves as an opposed member or a pressure member brought into contact with the outer peripheral surface of the fixing belt 20 to form a nip N. The heating unit 19 heats the fixing belt 20. The heating unit 19 includes a planar heater 22, a heater holder 23, a stay 24, a fixing entrance guide plate 34, and other components. The heater 22 serves as a heating member. The heater holder 23 serves as a holding member that holds the heater 22. The stay 24 serves as a support member that supports the heater holder 23.

The fixing belt 20 is an endless belt member and has a tubular base made of polyimide (PI) and having an outer diameter of 25 mm and a thickness of 40 to 120 μm, for example. To increase the durability and secure the releasability, the outermost surface layer of the fixing belt 20 has a release layer having a thickness of 5 to 50 μm and made of fluororesin, such as PFA and PTFE. An elastic layer made of rubber or the like having a thickness of 50 to 500 μm may be provided between the base and the release layer. The base of the fixing belt 20 is not necessarily made of polyimide and may be made of heat-resistant resin, such as PEEK, and a metal base, such as nickel (Ni) and SUS. The inner peripheral surface of the fixing belt 20 may be coated with polyimide or PTFE, for example, as a sliding layer.

The pressure roller 21 has an outer diameter of 25 mm, for example. The pressure roller 21 includes a solid iron cored bar 21*a*, an elastic layer 21*b*, and a release layer 21*c*. The elastic layer 21*b* is formed on the surface of the cored bar 21*a*. The release layer 21*c* is formed outside the elastic layer 21*b*. The elastic layer 21*b* is made of silicone rubber and has a thickness of 3.5 mm, for example. To increase the releasability of the surface of the elastic layer 21*b*, the release layer 21*c* is preferably made of fluororesin and has a thickness of approximately 40 μm, for example.

The fixing belt 20 and the pressure roller 21 are pressed against each other by a spring serving as a biasing member, which will be described later. As a result, the nip N is formed between the fixing belt 20 and the pressure roller 21. The pressure roller 21 also serves as a driving roller that drives to rotate by receiving a driving force from a driving means provided to the image forming apparatus main body. By contrast, the fixing belt 20 is driven to rotate with the rotation of the pressure roller 21. When the fixing belt 20 rotates, the fixing belt 20 slides with respect to the heater 22. To increase the slidability of the fixing belt 20, lubricant, such as oil and grease, may be interposed between the heater 22 and the fixing belt 20.

The heater 22 has a long side along the rotation axis direction or the longitudinal direction of the fixing belt 20 (the direction is orthogonal to the surface of FIG. 2 and corresponds to the longitudinal direction of the heater 22 and the fixing device 9. The direction intersects the conveying direction of the sheet and corresponds to the width direction of the sheet. In the following description, the direction is referred to as a "belt longitudinal direction" or simply referred to as a longitudinal direction). The heater 22 is in contact with the inner peripheral surface of the fixing belt 20 at the position corresponding to the pressure roller 21. The heater 22 is a member that heats the fixing belt 20 serving as a heated member to a predetermined fixing temperature.

Unlike the present embodiment, a heat generating unit 60 may be provided opposite to the fixing belt 20 across a base 50 (closer to the heater holder 23). In this case, the heat of the heat generating unit 60 is transmitted to the fixing belt 20 via the base 50. For this reason, the base 50 is preferably made of a material having high thermal conductivity, such as aluminum nitride. In the configuration of the heater 22 according to the present embodiment, an insulating layer may be provided on the surface of the base 50 on the side opposite to the fixing belt 20 (side closer to the heater holder 23).

The heater 22 may be not in contact with or be indirectly in contact with the fixing belt 20 with a low-friction sheet or the like interposed therebetween. To increase the efficiency of heat transfer to the fixing belt 20, the heater 22 is preferably directly in contact with the fixing belt 20 like the present embodiment. The heater 22 may be in contact with the outer peripheral surface of the fixing belt 20. If the outer peripheral surface of the fixing belt 20 is damaged by contact with the heater 22, the fixing quality may possibly deteriorate. For this reason, the heater 22 is preferably in contact with the inner peripheral surface of the fixing belt 20.

The heater holder 23 and the stay 24 are disposed inside the fixing belt 20. The stay 24 is made of a metal channel material and has both ends supported by both side walls of the fixing device 9. The stay 24 supports the surface of the heater holder 23 on the side opposite to the heater 22. With this configuration, the heater 22 and the heater holder 23 are maintained without being significantly bent by pressure applied by the pressure roller 21. As a result, the nip N is formed between the fixing belt 20 and the pressure roller 21.

The heater holder 23 is preferably made of a heat-resistant material because the heater holder 23 is likely to be heated to a high temperature by the heat of the heater 22. If the heater holder 23 is made of heat-resistant resin having low thermal conductivity, such as LCP, heat transmission from the heater 22 to the heater holder 23 is reduced, thereby enabling efficiently heating the fixing belt 20.

The fixing entrance guide plate 34 is disposed upstream of the nip N in the sheet conveyance direction and guides the sheet P sent to the fixing device 9 to the nip N.

A fixing entrance sensor 35 and a fixing exit sensor 36 that detect the sheet P are provided upstream and downstream, respectively, of the nip N in the sheet conveyance direction. These sensors can detect the timing when the sheet P enters the nip N and the timing when the sheet P exits the nip N.

When an image formation operation is started, power is supplied to the heater 22, thereby causing the heat generating unit 60 to generate heat and heat the fixing belt 20. The pressure roller 21 drives to rotate, whereby the fixing belt 20 starts to be driven to rotate. When the temperature of the fixing belt 20 reaches a predetermined target temperature (fixing temperature), the sheet P with an unfixed toner image carried thereon is sent to the space (nip N) between the fixing belt 20 and the pressure roller 21 as illustrated in FIG. 2 (refer to the direction of the arrow A in FIG. 2). As a result, the unfixed toner image is heated and pressurized, thereby being fixed on the sheet P.

Figure 3:
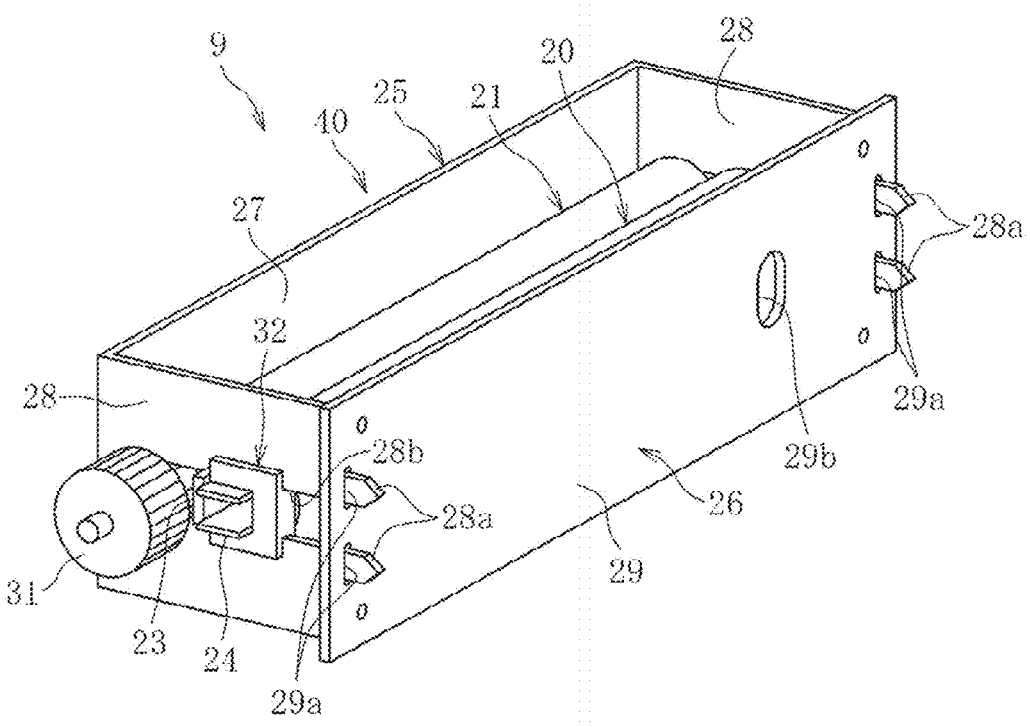
FIG. 3 is a perspective view of the fixing device.
Figure 4:
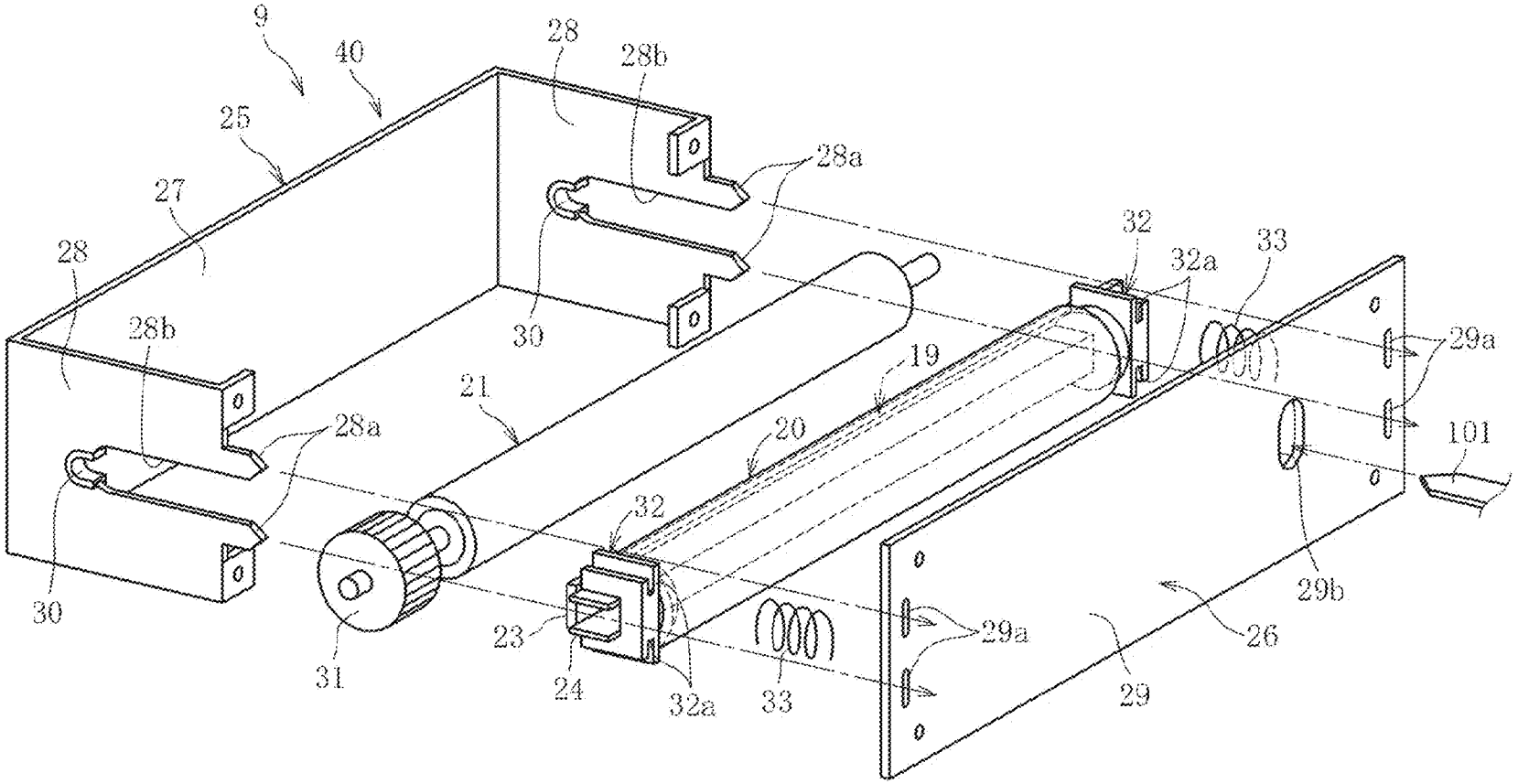
FIG. 4 is an exploded perspective view of the fixing device.

FIG. 3 is a perspective view of the fixing device, and FIG. 4 is an exploded perspective view of the fixing device.

As illustrated in FIGS. 3 and 4, a device frame 40 of the fixing device 9 includes a first device frame 25 and a second device frame 26. The first device frame 25 includes a pair of side walls 28 and a front wall 27. The second device frame 26 includes a rear wall 29. The pair of side walls 28 are disposed at a first end and a second end in the belt longitudinal direction. Both side walls 28 support both ends of the fixing belt 20, the pressure roller 21, and the heating unit 19. The side walls 28 each have a plurality of engagement protrusions 28*a*. The engagement protrusions 28*a* engage with respective engagement holes 29*a* formed in the rear wall 29, thereby fixing the first device frame 25 to the second device frame 26.

The side walls 28 each have an insertion groove 28*b* into which the rotating shaft of the pressure roller 21 or the like is inserted. The insertion groove 28*b* opens on the side facing the rear wall 29 and does not open and serves as an abutment part on the opposite side. The end of the abutment part is provided with a bearing 30 that supports the rotating shaft of the pressure roller 21. The pressure roller 21 has both ends of a rotating shaft attached to the bearings 30 and is rotatably supported by both side walls 28.

One end of the rotating shaft of the pressure roller 21 is provided with a drive transmission gear 31 serving as a drive transmission member. The drive transmission gear 31 is disposed in a manner exposed outside the side wall 28 when the pressure roller 21 is supported by both side walls 28. When the fixing device 9 is mounted on the image forming apparatus main body, the drive transmission gear 31 engages with a gear disposed in the image forming apparatus main body. As a result, the drive transmission gear 31 can transmit a driving force from a drive source. The drive transmission member that transmits the driving force to the pressure roller 21 is not limited to the drive transmission gear 31 and may be a pulley with a drive transmission belt wound therearound or a coupling mechanism, for example.

Both ends of the heating unit 19 in the longitudinal direction are provided with a pair of flanges 32 that supports the fixing belt 20, the heater holder 23, the stay 24, and other components. The flanges 32 each have guide grooves 32*a*. The guide grooves 32*a* are caused to enter along the edges of the insertion groove 28*b* of the side wall 28, thereby fixing the flange 32 to the side wall 28.

The spaces between the flanges 32 and the rear wall 29 are provided with a pair of springs 33 serving as a biasing member. The springs 33 each bias the stay 24 and the flange 32 toward the pressure roller 21. As a result, the fixing belt 20 is pressed against the pressure roller 21, thereby forming the nip between the fixing belt 20 and the pressure roller 21.

As illustrated in FIG. 4, the rear wall 29 constituting the second device frame 26 has a hole 29*b* at a first end in the longitudinal direction. The hole 29*b* serves as a positioning part that positions the fixing device main body with respect to the image forming apparatus main body. By contrast, the image forming apparatus main body has a protrusion 101 serving as a positioning part. The protrusion 101 is inserted into the hole 29*b* of the fixing device 9. As a result, the protrusion 101 fits the hole 29*b*, thereby positioning the fixing device main body with respect to the image forming apparatus main body in the belt longitudinal direction. A second end of the rear wall 29 opposite to the first end having the hole 29*b* is provided with no positioning part. This structure does not restrict expansion and contraction of the fixing device main body in the belt longitudinal direction with a change in temperature.

Figure 5:
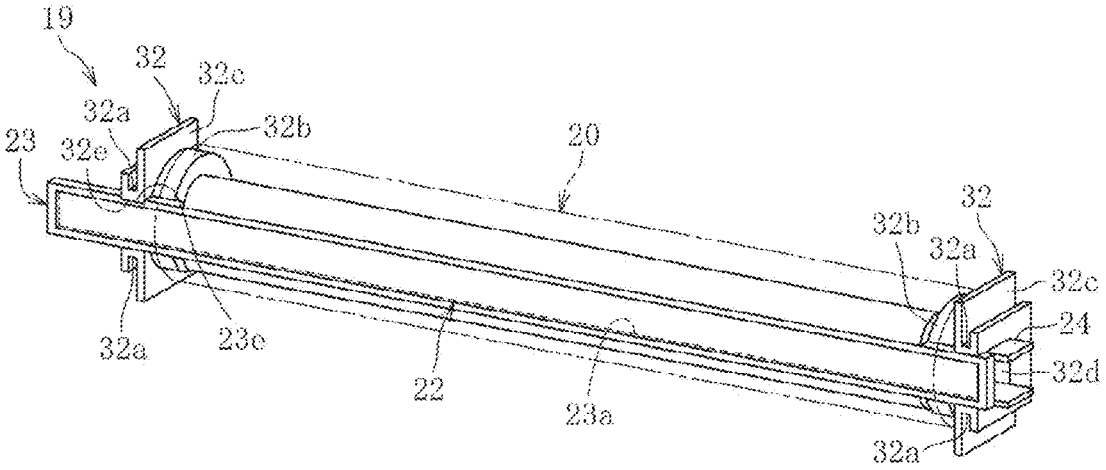
FIG. 5 is a perspective view of a heating unit.
Figure 6:
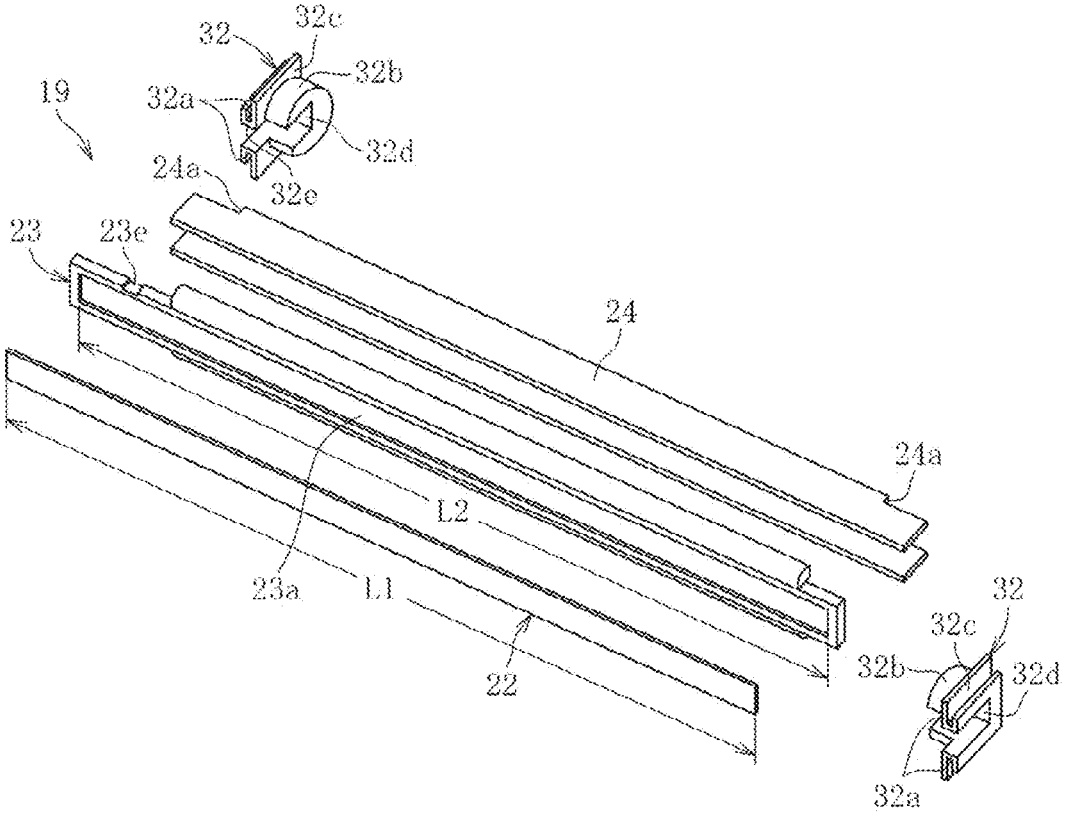
FIG. 6 is an exploded perspective view of the heating unit.

FIG. 5 is a perspective view of the heating unit 19, and FIG. 6 is an exploded perspective view of the heating unit 19.

As illustrated in FIGS. 5 and 6, the surface of the heater holder 23 on the side closer to the fixing belt (surface on the front side in FIGS. 5 and 6) has a rectangular housing recess 23*a* that houses the heater 22. The housing recess 23*a* has substantially the same shape and the same size as those of the heater 22. A length L2 of the housing recess 23*a* in the longitudinal direction is slightly longer than a length L1 of the heater 22 in the longitudinal direction. As described above, the housing recess 23*a* is slightly longer than the heater 22. This structure prevents the heater 22 and the housing recess 23*a* from interfering with each other if the heater 22 thermally expands in the longitudinal direction. The heater 22 is housed in the housing recess 23*a* and held with the heater holder 23 in a manner sandwiched by a connecter serving as a power supply member, which will be described later.

The pair of flanges 32 has a C-shaped belt support 32*b*, a flange-shaped belt restrictor 32*c*, and a supporting recess 32*d*. The belt support 32*b* is inserted into the fixing belt 20 to support the fixing belt 20. The belt restrictor 32*c* comes into contact with the end surface of the fixing belt 20 to restrict movement (deviation) in the belt longitudinal direction. The supporting recess 32*d* supports the heater holder 23 and the stay 24 with both ends of the heater holder 23 and the stay 24 inserted thereinto. The belt supports 32*b* are inserted into both ends of the fixing belt 20, thereby supporting the fixing belt 20 by what is called a free-belt system in which no tension is basically generated in the circumferential direction (belt rotation direction) when the belt is not rotating.

As illustrated in FIGS. 5 and 6, one end of the heater holder 23 in the longitudinal direction has a positioning recess 23*e* serving as a positioning part. An engagement part 32*e* of the flange 32 illustrated on the left in FIGS. 5 and 6 engages with the positioning recess 23*e*, thereby positioning the heater holder 23 and the flange 32 in the belt longitudinal direction. By contrast, the flange 32 illustrated on the right in FIGS. 5 and 6 is not provided with the engagement part 32*e* and does not position the flange 32 with respect to the heater holder 23 in the belt longitudinal direction. As described above, the heater holder 23 is positioned with respect to the flange 32 at only one side in the belt longitudinal direction. If the heater holder 23 expands or contracts in the belt longitudinal direction with a change in temperature, this structure does not restrict the expansion and contraction.

As illustrated in FIG. 6, both ends of the stay 24 in the longitudinal direction each have a step 24*a* that restricts movement of the stay 24 with respect to the flange 32. The step 24*a* abuts on the flange 32, thereby restricting movement of the stay 24 in the longitudinal direction with respect to the flange 32. At least one of the steps 24*a* is disposed with a gap (play) interposed between the step 24*a* and the flange 32. As described above, at least one of the steps 24*a* is disposed with a gap interposed between the step 24*a* and the flange 32. If the stay 24 expands or contracts in the belt longitudinal direction with a change in temperature, this structure does not restrict the expansion and contraction.

Figure 7:
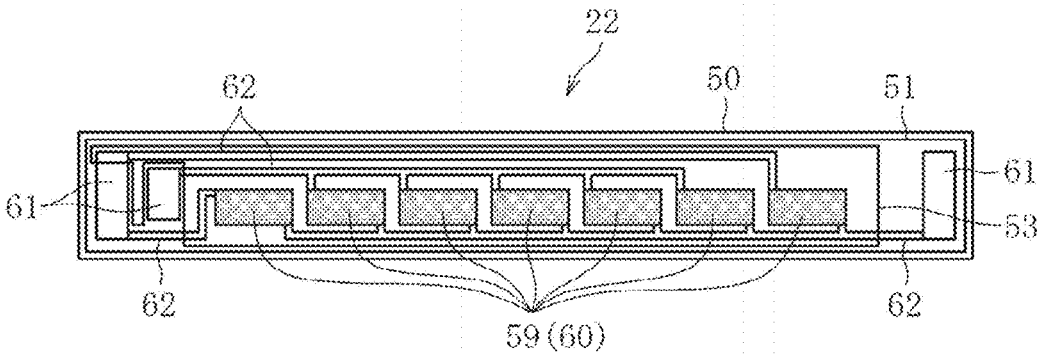
FIG. 7 is a plan view of a heater.
Figure 8:
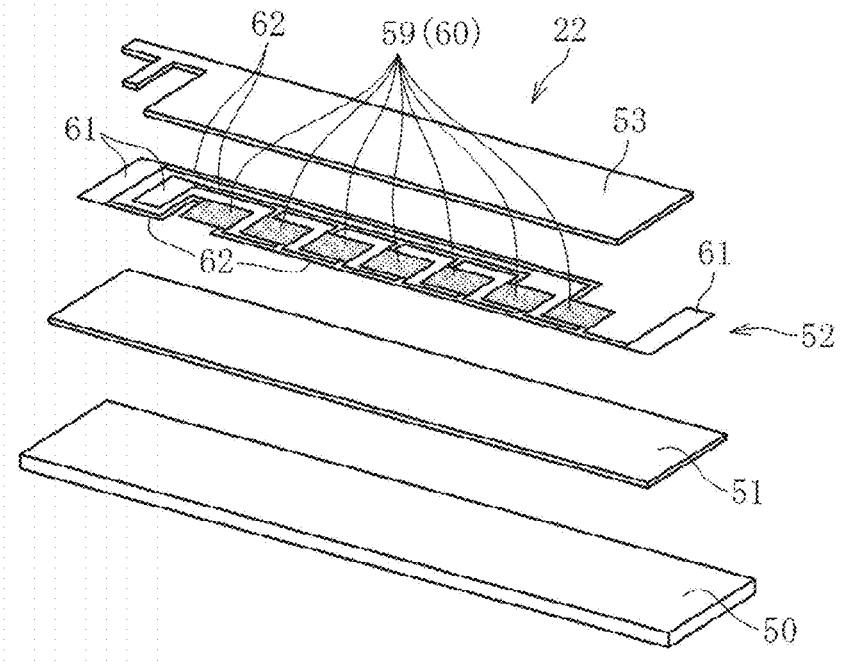
FIG. 8 is an exploded perspective view of the heater.

FIG. 7 is a plan view of the heater 22, and FIG. 8 is an exploded perspective view of the heater 22.

As illustrated in FIG. 8, the heater 22 includes a base 50, a first insulating layer 51, a conductor layer 52, and a second insulating layer 53. The first insulating layer 51 is provided on the base 50. The conductor layer 52 is provided on the first insulating layer 51 and includes the heat generating unit 60 and other components. The second insulating layer 53 covers the conductor layer 52. In the configuration according to the present embodiment, the base 50, the first insulating layer 51, the conductor layer 52 (heat generating unit 60), and the second insulating layer 53 are layered in this order toward the fixing belt 20 (nip N). Heat emitted from the heat generating unit 60 is transmitted to the fixing belt 20 via the second insulating layer 53 (refer to FIG. 2).

The base 50 is a rectangular plate material made of metal material, such as stainless steel (SUS), iron, and aluminum. The base 50 may be made of ceramic, glass, or other material instead of the metal material. If the base 50 is made of insulating material, such as ceramic, the first insulating layer 51 between the base 50 and the conductor layer 52 is not necessarily provided. The metal material is preferable to reduce the cost because the metal material has high durability against rapid heating and is easy to process. Out of the metal materials, aluminum and copper are preferably used in particular because they have high thermal conductivity and are less likely to cause unevenness in temperature. Stainless steel has the advantage of enabling the base 50 to be manufactured at a lower cost.

The insulating layers 51 and 53 are made of insulating material, such as heat-resistant glass. Alternatively, the insulating layers 51 and 53 may be made of ceramic or polyimide (PI), for example.

The conductor layer 52 includes the heat generating unit 60, a plurality of electrodes 61, and a plurality of power supply lines 62. The heat generating unit 60 includes a plurality of resistive heat generators 59. The power supply lines 62 serve as a plurality of conductors that electrically couple the heat generating unit 60 and the electrodes 61. The resistive heat generators 59 are each electrically coupled to any two of the three electrodes 61 in parallel via a plurality of power supply lines 62 provided on the base 50.

The resistive heat generator 59 is a conductor part having a higher resistance value than the power supply line 62. The resistive heat generator 59 is manufactured by: applying paste containing silver palladium (AgPd), glass powder, and other material to the base 50 by screen printing, for example, and then firing the base material 50. The resistive heat generator 59 may be made of resistive material, such as silver alloy (AgPt) and ruthenium oxide ($RuO_2$), instead of the materials described above.

The power supply line 62 is made of a conductor having a lower resistance value than the resistive heat generator 59. The power supply line 62 and the electrode 61 may be made of silver (Ag) or silver palladium (AgPd), for example. The power supply line 62 and the electrode 61 are formed by screen-printing the material described above.

Figure 9:
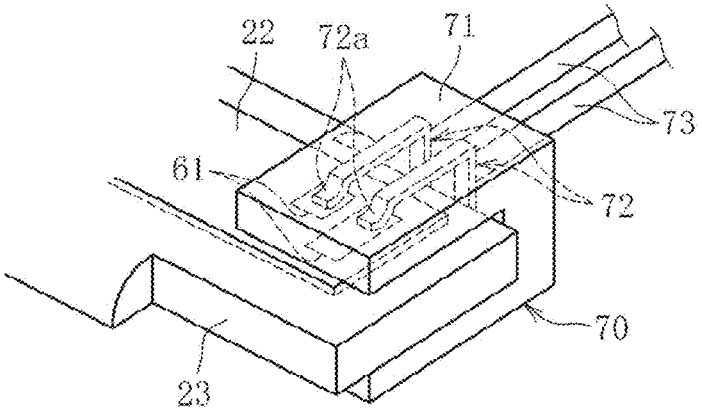
FIG. 9 is a perspective view of a state where a connector is coupled to the heater.

FIG. 9 is a perspective view of a state where a connector 70 is coupled to the heater 22.

As illustrated in FIG. 9, the connector 70 includes a resin housing 71 and a plurality of contact terminals 72 provided to the housing 71. The contact terminals 72 are plate springs and are each coupled to a power supply harness 73.

As illustrated in FIG. 9, the connector 70 is attached in a manner sandwiching the heater 22 and the heater holder 23 from the front and back sides. Contacts 72*a* provided at the distal end of the respective contact terminals 72 are each elastically brought into contact with (pressed against) the corresponding electrode 61. As a result, the heat generating unit 60 and the power source provided to the image forming apparatus are electrically coupled via the connector 70. Consequently, the power source can supply electric power to the heat generating unit 60. At least part of the electrodes 61 is exposed without being covered with the second insulating layer 53 to secure connection to the connector 70 (refer to FIG. 7).

Figure 10:
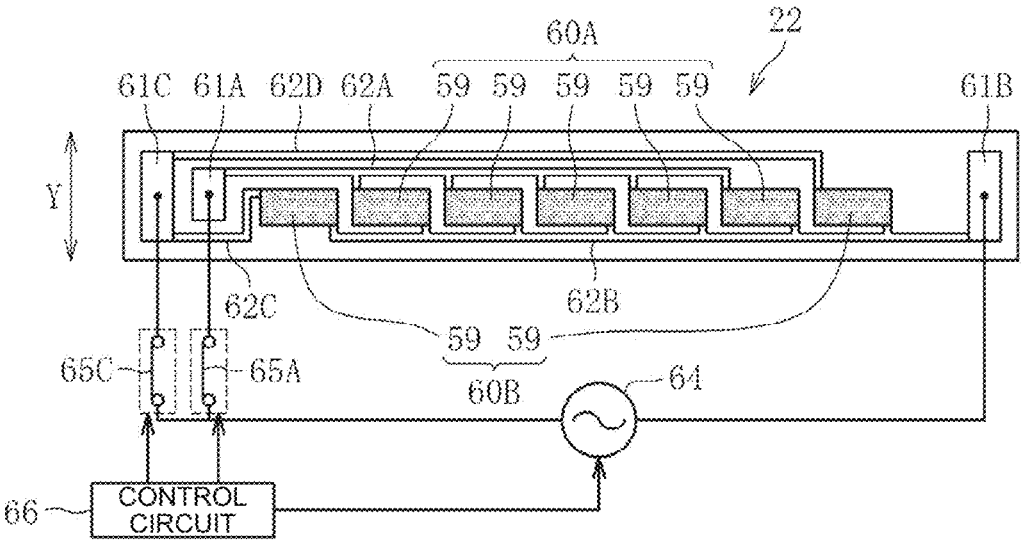
FIG. 10 is a diagram of power supply to the heater.

As illustrated in FIG. 10, in the present embodiment, among a plurality of resistive heat generators 59 disposed side by side in the longitudinal direction of the base 50, a first heat generating unit 60A including the resistive heat generators 59 disposed at other than both ends out of the resistive heat generators 59 (a first resistive heat generator group including the resistive heat generators 59 disposed at the inner side when the center of the sheet passing through the fixing device in the width direction is defined as the inner side), and a second heat generating unit 60B including the resistive heat generators 59 disposed at both ends (a second resistive heat generator group including the resistive heat generators 59 disposed at both outer sides when the ends of the sheet passing through the fixing device in the width direction are defined as the outer sides) are configured to be controlled to individually generate heat. Specifically, the resistive heat generators 59 disposed at other than both ends and constituting the first heat generating unit 60A are coupled to a first electrode 61A provided at a first end of the base 50 in the longitudinal direction via a first supply line 62A. The resistive heat generators 59 constituting the first heat generating unit 60A are also coupled to a second electrode 61B provided at a second end opposite to the first end provided with the first electrode 61A via a second supply line 62B. By contrast, the resistive heat generators 59 disposed at both ends and constituting the second heat generating unit 60B are coupled to a third electrode 61C (different from the first electrode 61A) provided at the first end of the base 50 in the longitudinal direction via a third supply line 62C or a fourth supply line 62D. The resistive heat generators 59 disposed at both ends are also coupled to the second electrode 61B via the second supply line 62B similarly to the resistive heat generators 59 of the first heat generating unit 60A.

The electrodes 61A to 61C are coupled to a power source 64 via the connector 70 and supplied with electric power from the power source 64. A switch 65A serving as a switching unit is provided between the first electrode 61A and the power source 64. Turning on and off the switch 65A can switch between applying and not applying a voltage. Similarly, a switch 65C serving as a switching unit is provided between the third electrode 61C and the power source 64. Turning on and off the switch 65C can switch between applying and not applying a voltage. The timings of turning on and off the switches 65A and 65C and supplying electric power to the heater 22 are controlled by a control circuit 66 of the image forming apparatus 1. The control circuit 66 controls supplying electric power to the heater 22 and turning on and off the switches based on detection results of various sensors in the image forming apparatus 1. The control circuit 66 can determine the timing when the sheet passes through the fixing device based on the detection results of the fixing entrance sensor and the fixing exit sensor, for example. The control circuit 66 can control switching between supplying and not supplying electric power to the heater 22 and turning on and off the switches 65A and 65C.

When a voltage is applied to the first electrode 61A and the second electrode 61B, the resistive heat generators 59 disposed at other than both ends are energized. As a result, only the first heat generating unit 60A generates heat. When a voltage is applied to the second electrode 61B and the third electrode 61C, the resistive heat generators 59 disposed at both ends are energized. As a result, only the second heat generating unit 60B generates heat. When a voltage is applied to all the electrodes 61A to 61C, the resistive heat generators 59 of both (all) the first heat generating unit 60A and the second heat generating unit 60B can be caused to generate heat. If sheet having a relatively small width size of A4 (passing sheet width: 210 mm) or smaller passes through the fixing device, for example, only the first heat generating unit 60A is caused to generate heat. If a sheet having a relatively large width size exceeding A4 (passing sheet width: 210 mm), such as an A3 sheet of portrait orientation, a B4 sheet of portrait orientation, and an A4 sheet of landscape orientation, passes through the fixing device, both the first heat generating unit 60A and the second heat generating unit 60B are caused to generate heat, sot that the heat generation region can be made to correspond to the passing sheet width.

To further downsize the image forming apparatus and the fixing device, it is important to downsize the heater serving as one of the members disposed inside the fixing belt. In other words, the diameter of the fixing belt can be reduced by downsizing the heater in the short-side direction (direction of the arrow Y in FIG. 10, that is, the direction intersecting the longitudinal direction along the surface of the heater 22 provided with the heat generating units 60A and 60B). As a result, the fixing device and the image forming apparatus can be downsized. Examples of the specific method for reducing the size of the heater in the short-side direction include, but are not limited to, the following three methods, etc.

The first method is reducing the size of the heat generating units (resistive heat generators) in the short-side direction. If the size of the heat generating units is reduced in the short-side direction, however, the width of the heating region for heating the fixing belt is also reduced. To secure the same amount of heat applied to the fixing belt, the temperature rise peak value disadvantageously rises. If the temperature rise peak value increases, the temperature of an overheating detecting device, such as a thermostat and a fuse, provided on the back surface of the heater may possibly exceed a heat resistance temperature, and the overheating detecting device may possibly malfunction. If the temperature rise peak value increases, the efficiency of heat transmission from the heater to the fixing belt decreases, which is undesirable in terms of energy efficiency. As described above, the method of reducing the size of the heat generating units in the short-side direction is difficult to employ.

The second method is reducing the size of the part not provided with the heat generating units, the electrodes, or the power supply lines in the short-side direction. This method, however, makes the gaps between the heat generating units and the power supply lines and between the electrodes and the power supply lines smaller. As a result, insulation therebetween may possibly fail to be secured. In view of the structure of the present heater, it is difficult to make the gaps between the heat generating units and the power supply lines and between the electrodes and the power supply lines smaller.

The third method is reducing the size of the power supply lines in the short-side direction. This method is more likely to be employed than the two methods described above. However, if the size of the power supply lines is reduced in the short-side direction, the resistance value of the power supply lines increases. As a result, an unintended branch current may possibly be generated on the conductive path of the heater. In particular, if the resistance value of the heat generating units is reduced to increase the amount of heat generated by the heat generating units for high-speed operations of the image forming apparatus, the resistance value of the power supply lines relatively comes closer to the resistance value of the heat generating units. As a result, an unintended branch current is likely to be generated. To avoid such an unintended branch current, the size of the power supply lines may be increased in the thickness direction (direction intersecting the longitudinal and short-side directions) as much as the size of them is reduced in the short-side direction. This method can secure the cross-sectional area, thereby preventing the resistance value of the power supply lines from increasing. This method, however, makes the power supply lines difficult to form by screen-printing, resulting in a change in the method of forming the power supply lines. For this reason, the solution of thickening the power supply lines is difficult to employ. Consequently, to downsize the heater in the short-side direction, the size of the power supply lines should be reduced in the short-side direction allowing for an increase in the resistance value. This method requires measures against an unintended branch current due to the increase in the resistance value.

The following describes an unintended branch current and problems associated therewith reference to a heater having the same layout as that of the heater 22.

Figure 11:
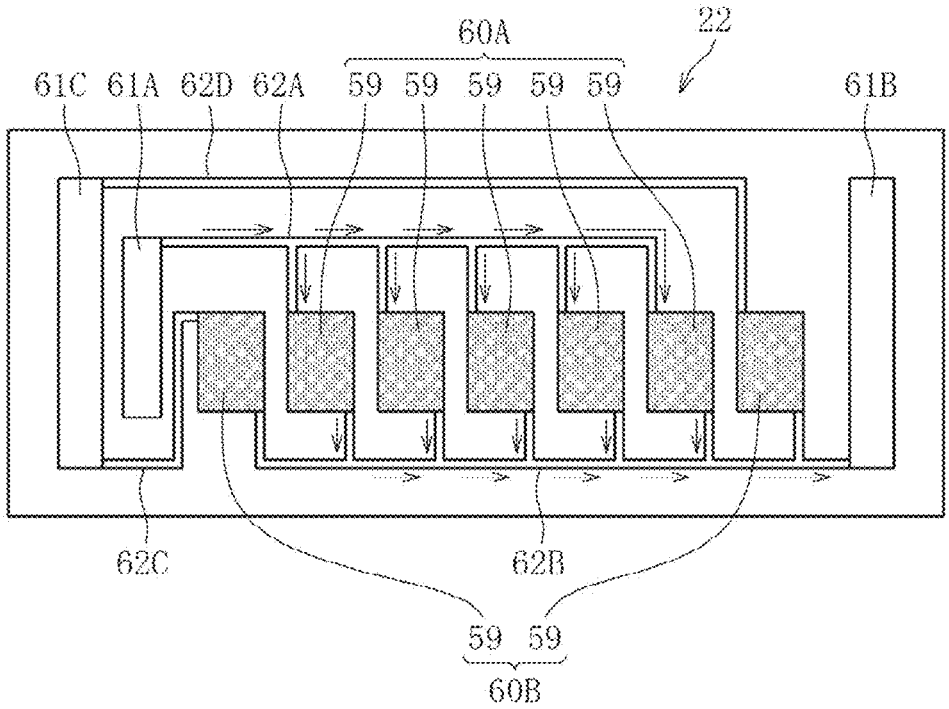
FIG. 11 is a view of an ordinary energizing path.

If a voltage is applied to the first electrode 61A and the second electrode 61B to cause only the resistive heat generators 59 of the first heat generating unit 60A to generate heat in the heater 22 illustrated in FIG. 11, an electric current normally flows through the first power supply line 62A, passes through the resistive heat generators 59 disposed at other than both ends, and flows through the second power supply line 62B (hereinafter, this energization is referred to as partial energization).

Figure 12:
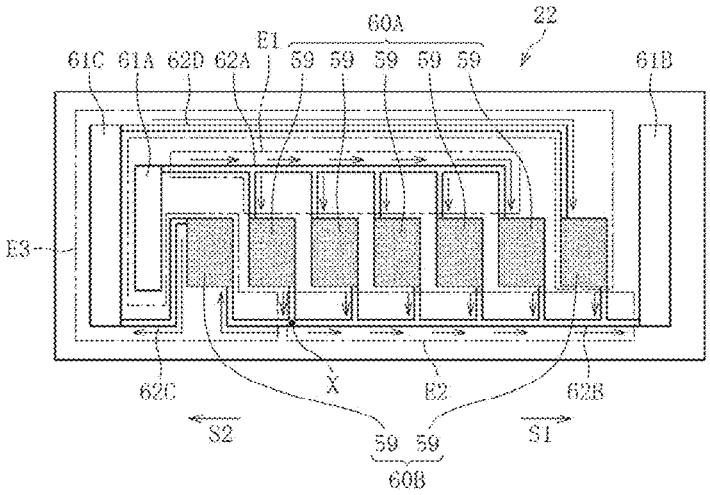
FIG. 12 is a view of the energizing path when an unintended branch current is generated.

If the difference between the resistance value of the power supply lines and that of the heat generating units is reduced by an increase in the resistance value of the power supply lines due to the downsizing described above and a decrease in the resistance value of the heat generating units due to increasing the amount of generated heat, a branch current flowing through an unintended path is generated as illustrated in FIG. 12. In other words, part of the electric current passing through the second resistive heat generator 59 from the left in FIG. 12 flows opposite to the second electrode 61B at a branch part X of the second power supply line 62B ahead. The branched current passes through the leftmost resistive heat generator 59 in FIG. 12. Subsequently, the branched current passes through the third power supply line 62C, the third electrode 61C, the fourth power supply line 62D, and the rightmost resistive heat generator 59 in order and then flows into the second power supply line 62B.

In the heater 22 illustrated in FIG. 12, a branch conductive path E3 includes a part extending toward the left in FIG. 12 from the branch part X on the second power supply line 62B and a part including the resistive heat generators 59 disposed at both ends and constituting the second heat generating unit 60B, the third electrode 61C, the third power supply line 62C, and the fourth power supply line 62D. The branch conductive path E3 allows an electric current to flow through an unintended path.

If the conductive path of the heater 22 includes at least a first conductive part E1, a second conductive part E2, and the branch conductive path E3, an unintended branch current can be generated when the first heat generating unit 60A is energized. The first conductive part E1 couples the first heat generating unit 60A and the first electrode 61A. The second conductive part E2 extends from the first heat generating unit 60A in a first direction S1 (right in FIG. 12) in the longitudinal direction of the heater 22 and is coupled to the second electrode 61B. The branch conductive path E3 branches off from the second conductive part E2 in a second direction S2 (left in FIG. 12) opposite to the first direction S1 and is coupled to the second conductive part E2 or the second electrode 61B not via the first conductive part E1. In the configuration according to the present embodiment, the second heat generating unit 60B and the third electrode 61C are provided on the branch conductive path E3. An unintended branch current may possibly be generated on a conductive path not provided with the second heat generating unit 60B or the third electrode 61C and a conductive path provided with other conductive members.

If an unintended branch current is generated, the electric current flows through an unexpected path. As a result, the temperature distribution of the heater 22 may possibly be made uneven by heat generated by the power supply lines. Let us assume a case where an electric current flows from the first electrode 61A to the resistive heat generators 59 of the first heat generating unit 60A evenly by 20% each in the heater 22 illustrated in FIG. 13, for example. If the electric current passing through the second resistive heat generator 59 from the left in FIG. 13 branches off by 5% at the branch part X ahead, the amounts of heat generated by the power supply lines in blocks divided corresponding to the respective resistive heat generators 59 are indicated by the table in FIG. 13.

Figure 13:
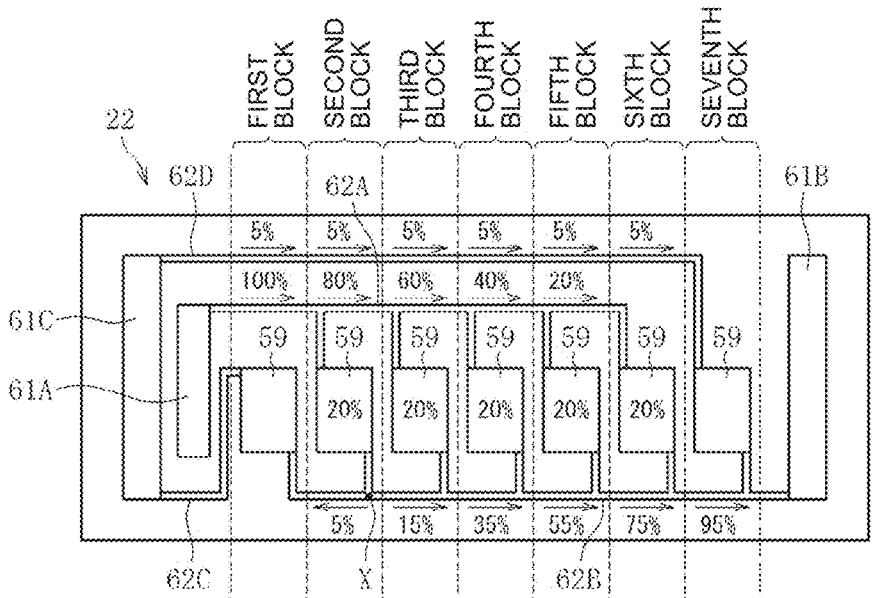
FIG. 13 is a diagram of the amount of heat generated by power supply lines in blocks when the unintended branch path is generated.

The amount of heat generated by a part of the power supply lines extending in the short-side direction of the heater 22 is ignored because the part has a short length and generates a slight amount of heat. The table indicates only the amount of heat generated by a part of the power supply lines extending in the longitudinal direction of the heater 22. Specifically, the table indicates the amount of heat generated by a part of the first power supply line 62A, the second power supply line 62B, and the fourth power supply line 62D extending in the longitudinal direction of the heater 22. The amount of generated heat (W) is expressed by Expression (1). The amount of generated heat indicated by the table in FIG. 13 is obtained by calculating the square of an electric current (I) flowing through the power supply line for descriptive purposes. The values of the amount of generated heat indicated by the table in FIG. 13 are only simply calculated values and are different from the actual amount of generated heat.

$$W(\text{Amount of Generated Heat})=R(\text{Resistance})\times I^2(\text{Current}) \quad (1)$$

The following specifically describes the method for calculating the amount of generated heat with reference to FIG. 13. In the first block, the percentage of the electric current flowing through the first power supply line 62A is 100%, and the percentage of the electric current flowing through the fourth power supply line 62D is 5%. As a result, the total amount of heat generated by the power supply lines in the first block is 10025 (10000+25), which is the total of the squares of the respective percentages. In the second block, the percentage of the electric current flowing through the first power supply line 62A is 80%, the percentage of the electric current flowing through the second power supply line 62B is 5%, and the percentage of the electric current flowing through the fourth power supply line 62D is 5%. As a result, the total amount of heat generated by the power supply lines in the second block is 6450 (6400+25+25), which is the total of the squares of the respective percentages. The amounts of heat generated in the other blocks are calculated in the same manner.

Figure 14:
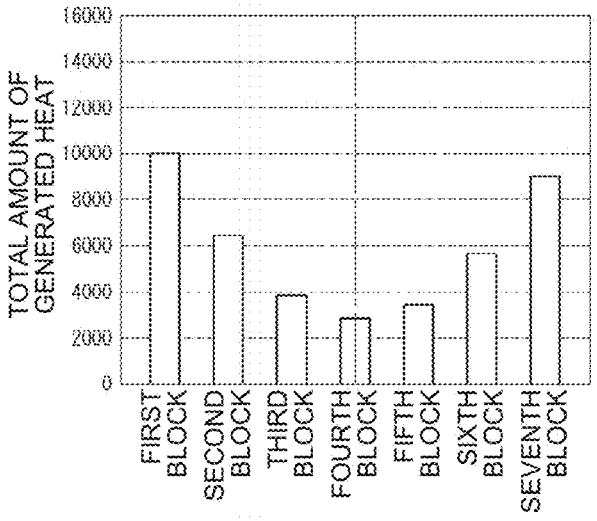
FIG. 14 is a graph of the total amount of heat generated by the power supply lines in the blocks in the case illustrated in FIG. 13.

FIG. 14 is a graph of the total amount of heat generated in the blocks indicated by the table in FIG. 13. As illustrated in FIG. 14, the total amount of heat generated in the blocks are asymmetrical with respect to the fourth block positioned at the center of the heat generation region due to the effects of the unintended branch current.

The unevenness of the amount of heat generated by the power supply lines having an asymmetrical shape causes the unevenness in temperature of the heater 22 in the longitudinal direction. If the temperature of the heater 22 is uneven in the longitudinal direction, an image fixed on a sheet has high glossiness at the part having high temperature and has low glossiness at the part having low temperature. As a result, the image may possibly have uneven gloss as a whole, resulting in deterioration of image quality. In the configuration according to the present embodiment, the lengths of the respective blocks are equal so as to enable uniformly heating small-size and large-size sheets.

The following describes the amount of heat generated by the power supply lines in the blocks obtained when all the heat generating units are energized (hereinafter, referred to as whole energization).

Figure 15:
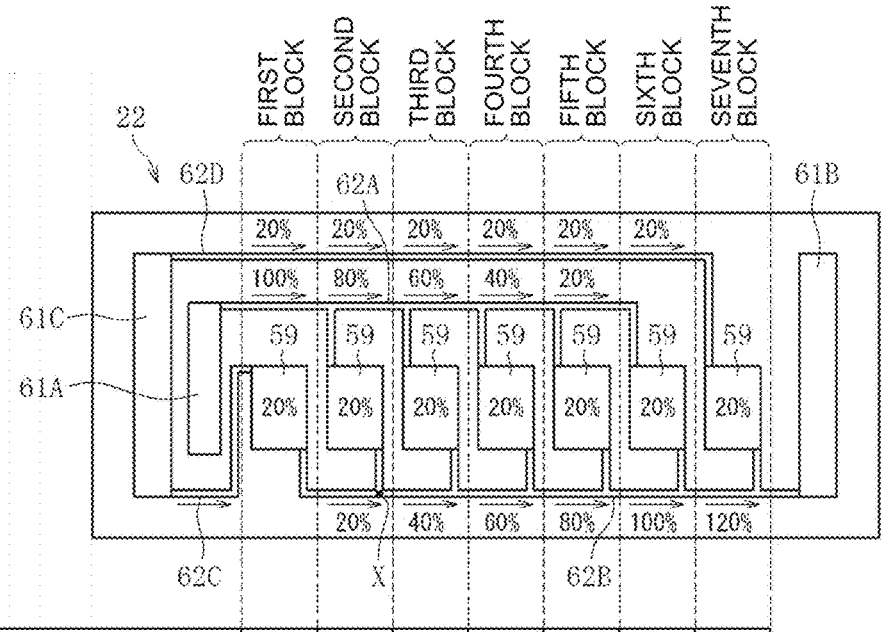
FIG. 15 is a diagram of the amount of heat generated by the power supply lines in the blocks when all the heat generating units are energized.

The case where all the heat generating units are energized as illustrated in FIG. 15 is different from the case described before in that 20% electric currents also flow through the resistive heat generators 59 disposed both ends and the power supply lines 62C and 62D coupled thereto. By contrast, the value of the electric current flowing through the first power supply line 62A is the same as that in the partial energization. In the first block, the percentage of the electric current flowing through the first power supply line 62A is 100%, and the percentage of the electric current flowing through the fourth power supply line 62D is 20%. As a result, the total amount of heat generated by the power supply lines in the first block is 10400 (10000+400), which is the total of the squares of the respective percentages. In the second block, the percentage of the electric current flowing through the first power supply line 62A is 80%, the percentage of the electric current flowing through the second power supply line 62B is 20%, and the percentage of the electric current flowing through the fourth power supply line 62D is 20%. As a result, the total amount of heat generated by the power supply lines in the second block is 7200 (6400+400+400), which is the total of the squares of the respective percentages. The amounts of heat generated in the other blocks are calculated in the same manner.

Figure 16:
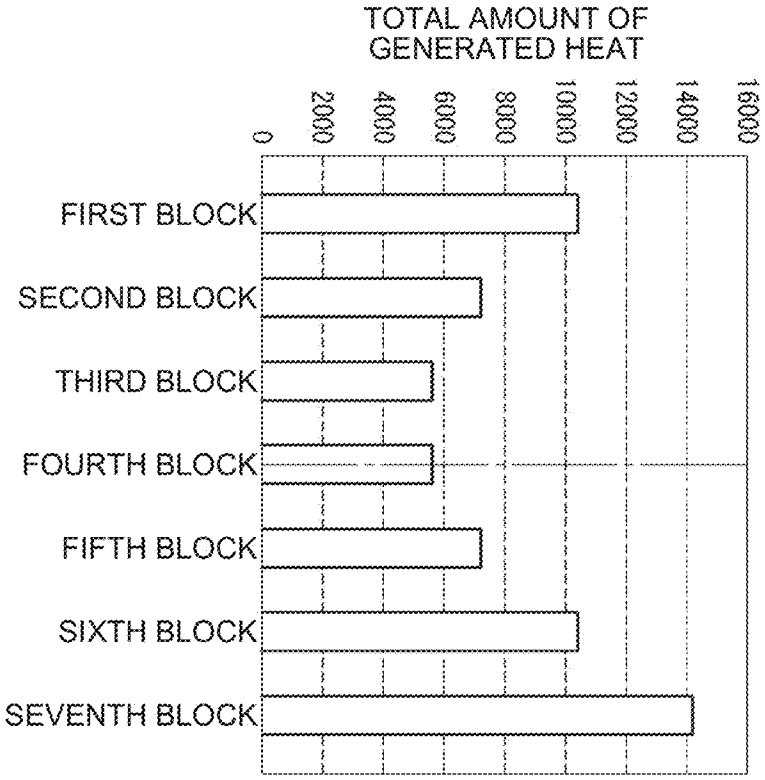
FIG. 16 is a graph of the total amount of heat generated by the power supply lines in the blocks in the case illustrated in FIG. 15.

As illustrated in FIG. 16, the total amount of heat generated in the blocks are asymmetrical with respect to the fourth block positioned at the center of the heat generation region. In particular, the current value is larger as being 120% on the downstream side in the second supply line 62B coupled to all the resistive heat generators 59, that is, in the seventh block, resulting in the difference between the amounts of heat generated on the left and right sides.

In the present embodiment, in the case of the partial energization (when a small-size sheet passes through the fixing device), the heat generation state is changed during an operation of executing a job to suppress unevenness in temperature and uneven heating of the heating device due to temperature deviation between a first side and a second side of the heater 22 in the longitudinal direction. That is, the fixing belt 20 is heated by heat generation (first heat generation state) by partial energization of energizing only the first heat generating unit 60A serving as the heat generation region corresponding to the width of the small-size sheet, and heat generation (second heat generation state) by whole energization of energizing the first heat generating unit 60A and the second heat generating unit 60B is performed at a predetermined timing. In other words, the heater 22 according to the present embodiment performs heating in a range wider than the range corresponding to the sheet width at a predetermined timing, which will be described later. The following describes switching between partial energization and whole energization in greater detail.

Figure 17:
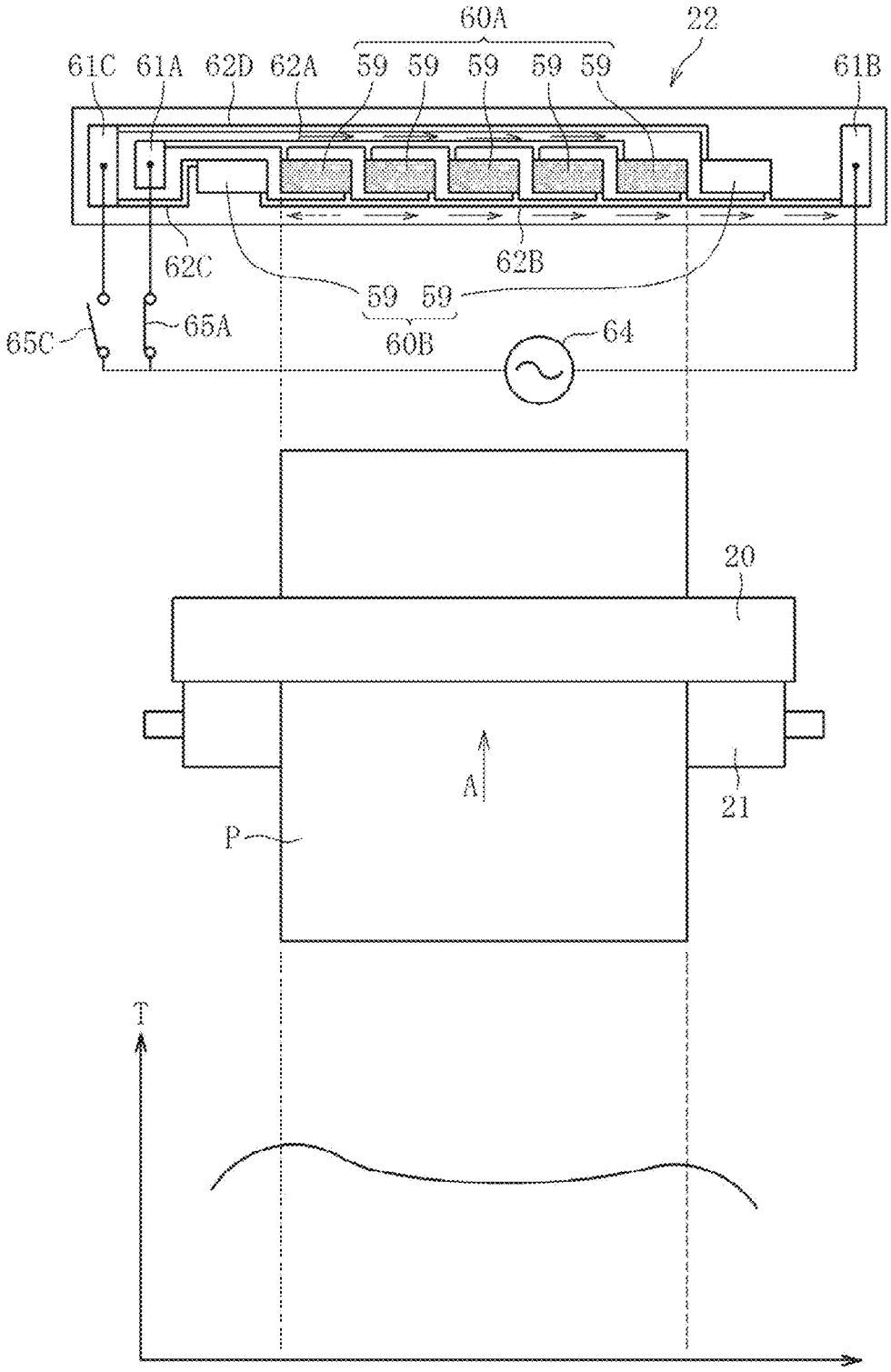
FIG. 17 is a diagram of a state where partial energization is performed when an image formation operation is being performed on a small-size sheet, and the upper part indicates the positional relation of the heater in the longitudinal direction, the center part indicates the positional relation of the fixing device in the longitudinal direction, and the lower part indicates the temperature distribution of a fixing belt in the longitudinal direction.

As illustrated in FIG. 17, when an image formation operation is being performed on a small-size sheet, the amount of heat generated by the heater 22 is larger on a first side (left in the drawing) in the longitudinal direction as described above. As illustrated in the lower part of the drawing, temperature T of the fixing belt 20 is also larger on the left in FIG. 17. The amount of heat generated by the heater 22 means the amount of heat generated by the heater 22 alone.

Figure 18:
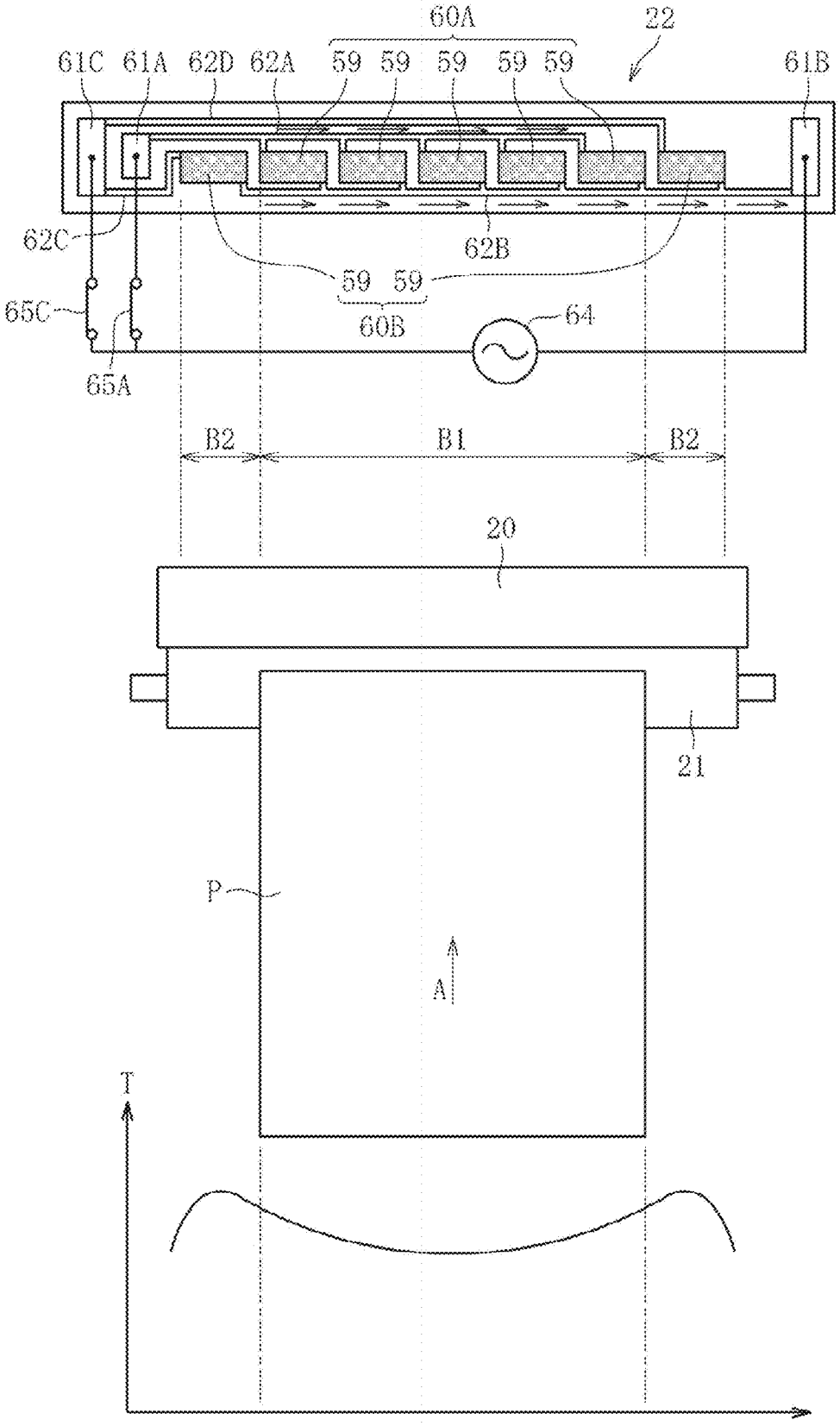
FIG. 18 is a diagram of a state where whole energization is performed when an image formation operation is being performed on a small-size sheet, and the upper part indicates the positional relation of the heater in the longitudinal direction, the center part indicates the positional relation of the fixing device in the longitudinal direction, and the lower part indicates the temperature distribution of the fixing belt in the longitudinal direction.

With respect to the temperature deviation between left and right, in the present embodiment, switching to whole energization is performed at a predetermined timing, which will be described later, to reduce the temperature deviation between left and right. Specifically, as illustrated in FIG. 18, the switch 65C is turned on, and not only the first heat generating unit 60A but also the second heat generating unit 60B is energized. As a result, not only a sheet passing range B1 of a small-size sheet (an A4 sheet of landscape orientation) but also a non-sheet passing range B2 outside the sheet passing range B1 serves as the heat generation region by the resistive heat generators 59.

In whole energization, the amount of heat generated on a second side in the longitudinal direction is larger than that on the first side as described above (refer to FIGS. 15 and 16). Performing whole energization on the heater 22 at a predetermined timing cancels the rising-to-left temperature distribution in which the temperature on the first side in the longitudinal direction is higher than that on the second side illustrated in FIG. 17. As a result, the deviation between left and right in the temperature distribution can be reduced as illustrated in the lower part of FIG. 18. This can suppress unevenness in temperature and uneven heating of the heating device due to the temperature deviation between the first side and the second side of the heater 22 in the longitudinal direction. In other words, the fixing device can reduce the difference in fixability and glossiness between the first side and the second side in the longitudinal direction. Consequently, the fixing device can suppress uneven fixing and unevenness in glossiness of an image formed on a sheet.

The following describes a plurality of examples of the timing of performing whole energization in order.

Figure 19:
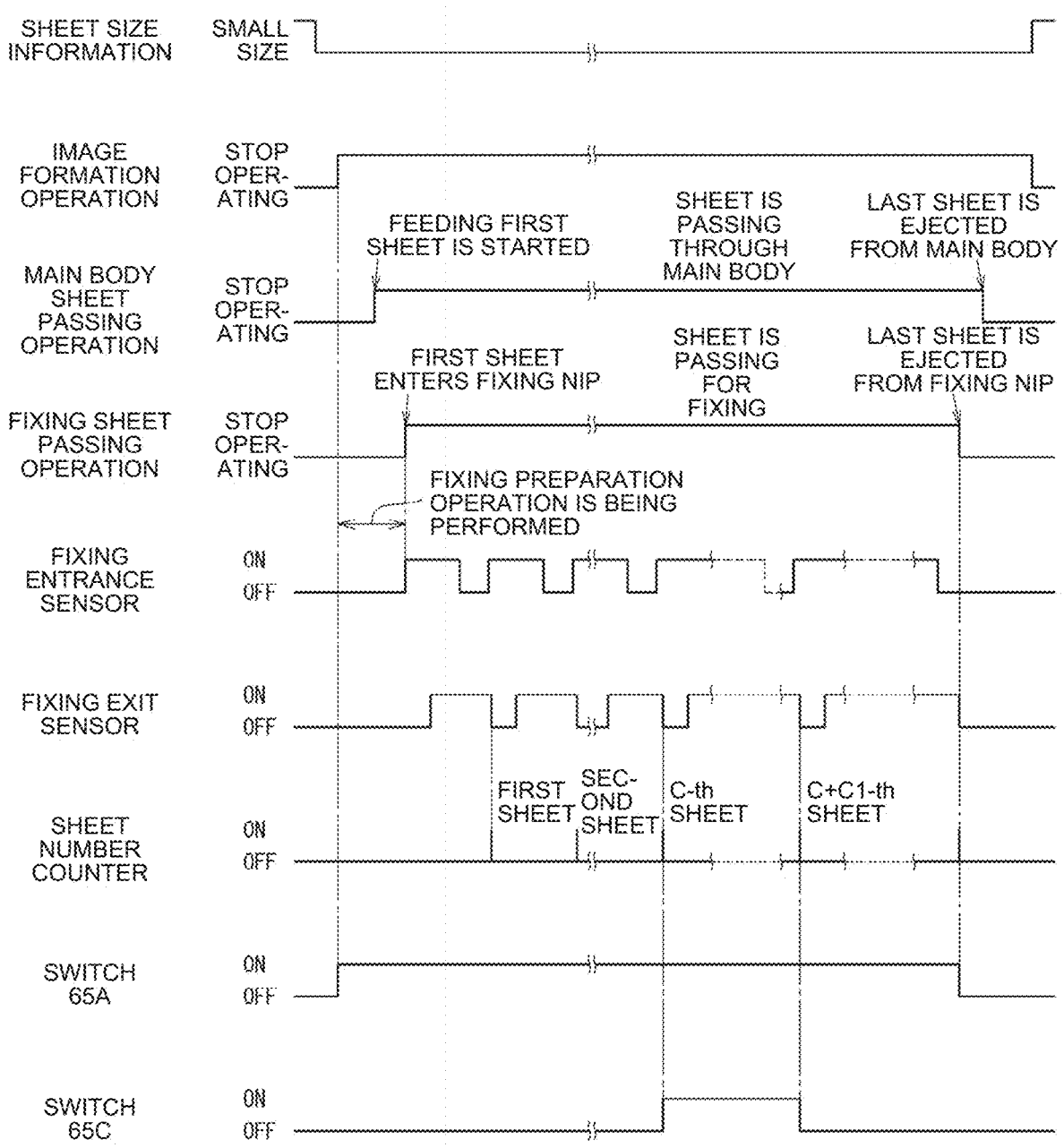
FIG. 19 is a timing chart of the timing of switching partial energization and whole energization in the fixing device according to a first embodiment of the present invention.

FIG. 19 is a timing chart of operations performed in the image forming apparatus when performing an image formation operation on a plurality of sheets having the same size (e.g., A4) in a direction intersecting the conveyance direction. The dotted lines in FIG. 19 each indicate a part where illustration of a change in the chart is omitted.

As illustrated in FIG. 19, when the image forming apparatus is instructed to perform printing (that is, when the image forming apparatus receives a job of instructing the image forming apparatus to perform an image formation operation), the image forming apparatus recognizes the size of a sheet to be subjected to printing (refer to the first row in FIG. 19). As indicated by the first row in FIG. 19, the job according to the present embodiment is continuously performing printing on a small-size sheet. Subsequently, the image formation operation is started, and the first sheet is fed to the conveyance path 5 (refer to FIG. 1) in the image forming apparatus, and a toner image is formed on the sheet (refer to the second and the third rows in FIG. 19). When the first sheet reaches the fixing device 9, the fixing device 9 starts a fixing operation (refer to the fourth row in FIG. 19). The fixing device 9 performs a fixing preparation operation simultaneously with the start of the image formation operation. In the fixing preparation operation, the switch 65A is turned on, and the heater 22 starts a heating operation (refer to the eighth row in FIG. 19), thereby heating the fixing belt 20 to a fixing temperature.

Whether the sheet reaches the fixing device 9 is determined by the fixing entrance sensor 35 (refer to FIG. 2). Specifically, when the leading end of the sheet reaches the position facing the fixing entrance sensor 35 of the conveyance path 5, the fixing entrance sensor 35 is turned on (refer to the fifth row in FIG. 19), and the image forming apparatus main body recognizes that the sheet reaches the fixing device 9.

When the fixing exit sensor 36 (refer to FIG. 2) detects the trailing end of the sheet, it is recognized that the fixing operation on the sheet is finished, and a sheet number counter is turned on. Specifically, when the signal of the fixing exit sensor 36 is turned on once and then off after the fixing entrance sensor 35 is turned on (refer to the fifth and the sixth rows in FIG. 19), the image forming apparatus determines that the trailing end of the sheet has passed through the position on the conveyance path 5 facing the fixing exit sensor 36, and the sheet number counter is turned on (refer to the seventh row in FIG. 19). When the sheet number counter counts the predetermined C-th sheet, the switch 65C is turned on to perform whole energization (refer to the ninth row in FIG. 19).

The time for performing whole energization according to the present embodiment is determined to be a time until the predetermined C1-th sheet has passed through the fixing nip N. In other words, the switch 65C remains on from when the sheet number counter counts the C-th sheet to when the sheet number counter counts the C+C1-th sheet (refer to the seventh and the ninth rows in FIG. 19).

After the last sheet is ejected from the image forming apparatus main body, the conveyance rollers and other components stop, and the image formation operation is ended. The switch 65A remains on from when the image formation operation is started to when the last sheet of the job is ejected from the image forming apparatus main body, thereby heating the position of the fixing belt corresponding to the sheet passing region of the small-size sheet (refer to the eighth row in FIG. 19). The image formation operation performed by the image forming apparatus includes receiving the job, starting various operations for printing (e.g., heating the fixing belt to the fixing temperature and rotating various rollers that convey a sheet), finishing printing on the last sheet and ejecting the last sheet outside the apparatus, and ending the various operations for printing. The image formation operation is also an operation of executing the job.

The setting to switch to whole energization after the C-th sheet has passed through the fixing device is made, and switching to whole energization is made while the job of continuously performing printing on the small-size sheet is executed. Thus enables to switch to whole energization when a certain amount or more of temperature difference is generated between the first side and the second side of the fixing belt 20 in the longitudinal direction. Consequently, the deviation between left and right in the temperature distribution of the fixing belt can be reduced, and uneven fixing and unevenness in glossiness of an image formed on the sheet can be suppressed.

By limiting the whole energization time to the period of time when the C1-th sheet is passing through the fixing device, the temperature distribution of the fixing belt 20 is prevented from becoming a rising distribution in which the temperature on the second side in the longitudinal direction is higher than that on the first side, and the non-sheet passing range B2 (refer to FIG. 18) can be also prevented from overheating.

In the present embodiment described above, the timing of whole energization is set by counting the number of sheets having passed through the fixing device 9, but is not limited thereto, and may be set to the timing after the C-th sheet is ejected outside the apparatus or the timing after the C-th sheet has passed through the entrance of the fixing device, for example. These timings can be selected by providing sensors at the corresponding positions.

Figure 20:
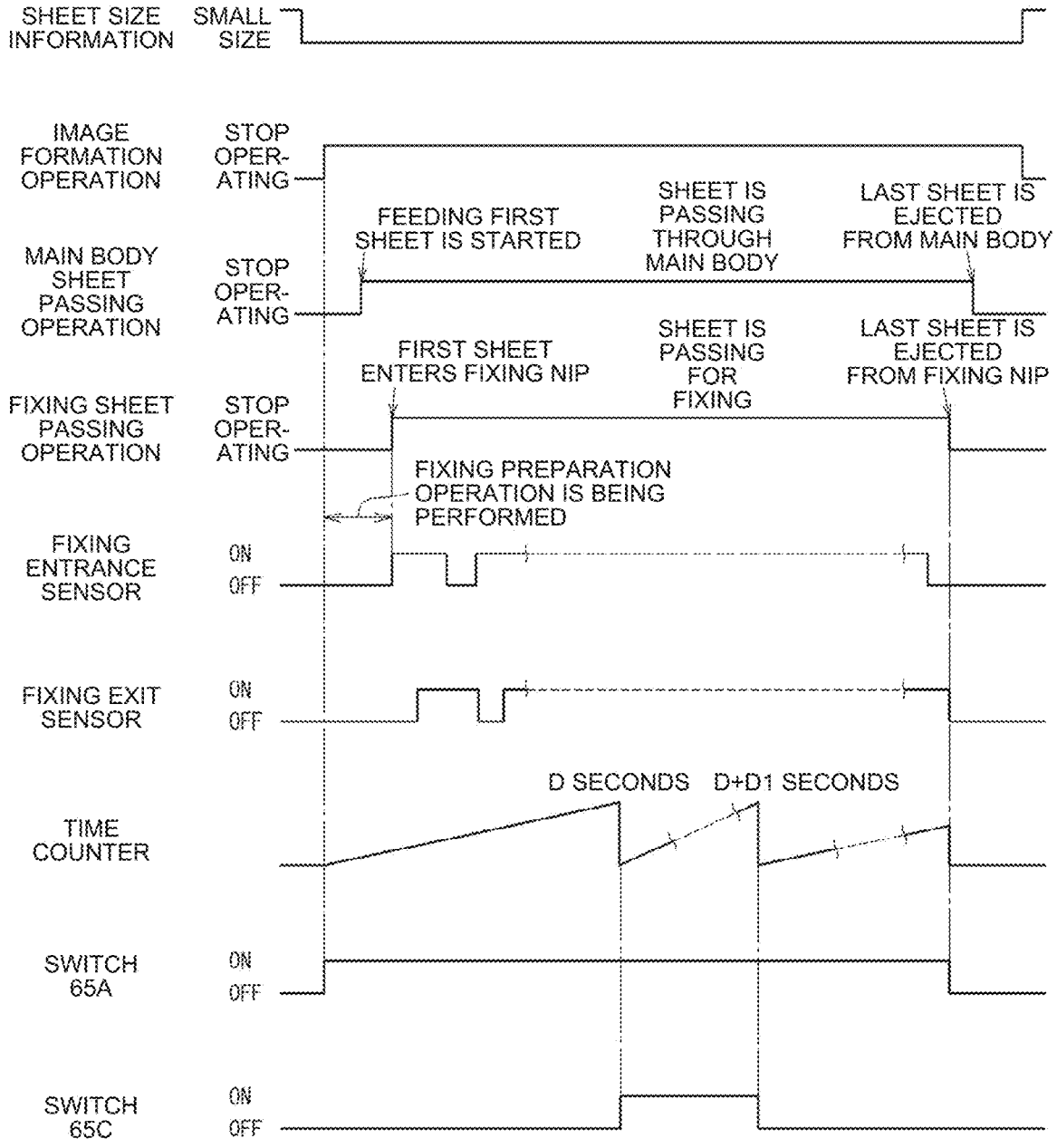
FIG. 20 is a timing chart of the timing of switching partial energization and whole energization in the fixing device according to a second embodiment.

The image forming apparatus can also set the timing of whole energization not by counting the number of sheets but by measuring the image formation operation time. For example, as illustrated in FIG. 20, in the present embodiment, the switch 65C is turned on and whole energization starts when D seconds has passed since the start of the image formation operation as indicated by the seventh row in FIG. 7. The whole energization time is predetermined D1 seconds.

Also in the present embodiment, the deviation between left and right in the temperature distribution of the fixing belt can be reduced, uneven fixing and unevenness in glossiness of an image formed on the sheet can be suppressed. By limiting the whole energization time to D1 seconds, the temperature on the second side in the longitudinal direction becoming too high and the non-sheet passing region can be prevented from overheating.

The time D is not necessarily measured from the start of the image formation operation and can be measured from an optional timing, such as the timing when the first sheet passes through predetermined registration rollers and the timing when the first sheet reaches the fixing device.

The number of sheets C and the time D can be set to appropriate values depending on the productivity of the image forming apparatus, the heat capacity of the fixing belt, the linear velocity of the sheet, and the thickness of the sheet, for example. The values can be set as follows: C=10 sheets, C1=5 sheets, D=30 seconds, and D1=15 seconds, for example.

Figure 21:
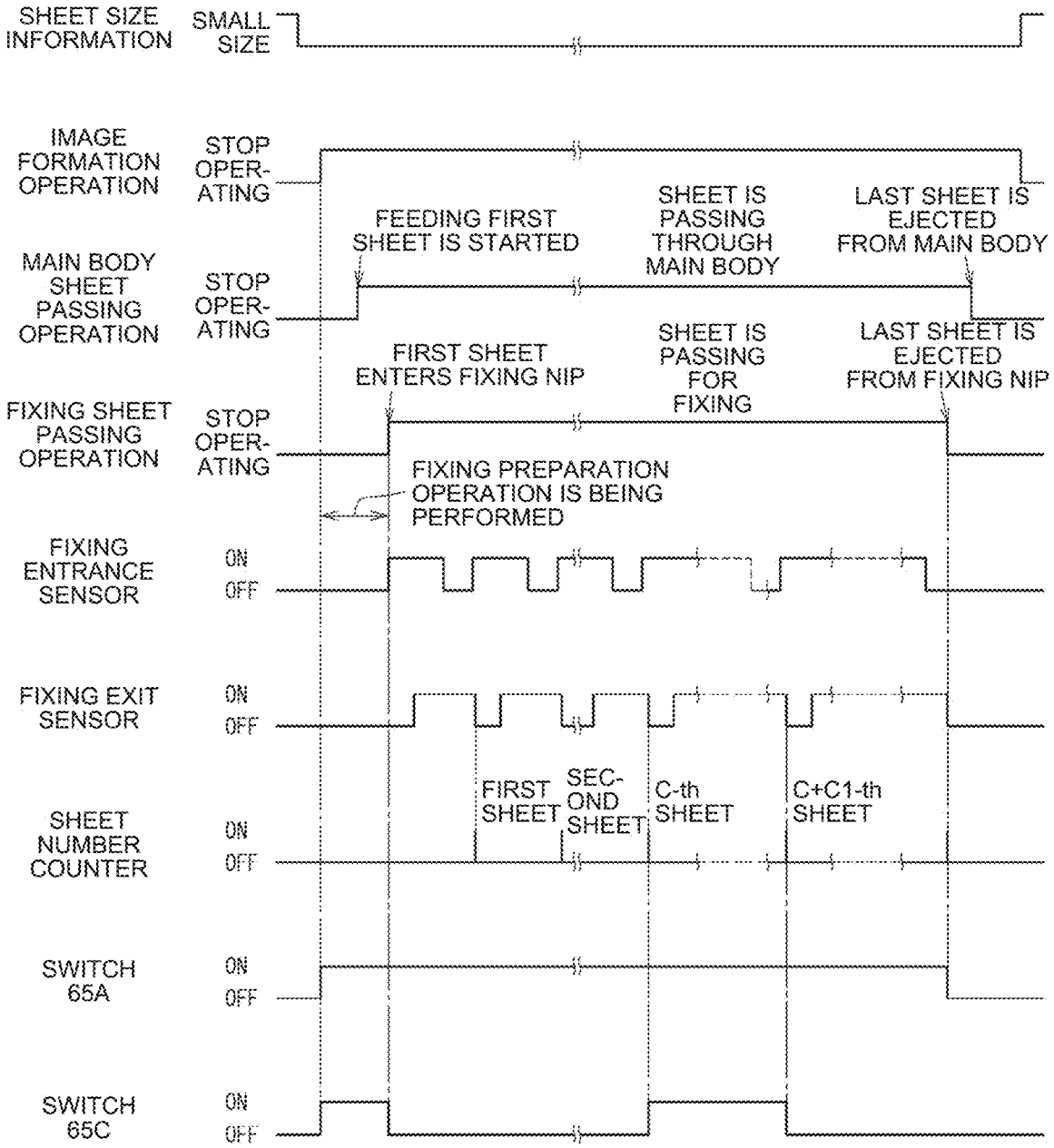
FIG. 21 is a timing chart of the timing of switching partial energization and whole energization in the fixing device according to a third embodiment.

Further, as illustrated in FIG. 21, the image forming apparatus can also perform whole energization from when the image formation operation is stared to when the first sheet passes through the fixing device 9 (refer to the ninth row in FIG. 21). In other words, whole energization can be performed during a preparation operation of the fixing device 9, which is part of the image formation operation (operation of executing the job). The timing when the first sheet passes through the fixing device 9 is determined as the timing when the fixing entrance sensor is turned on for the first time (refer to the fifth row in FIG. 21).

Figure 22:
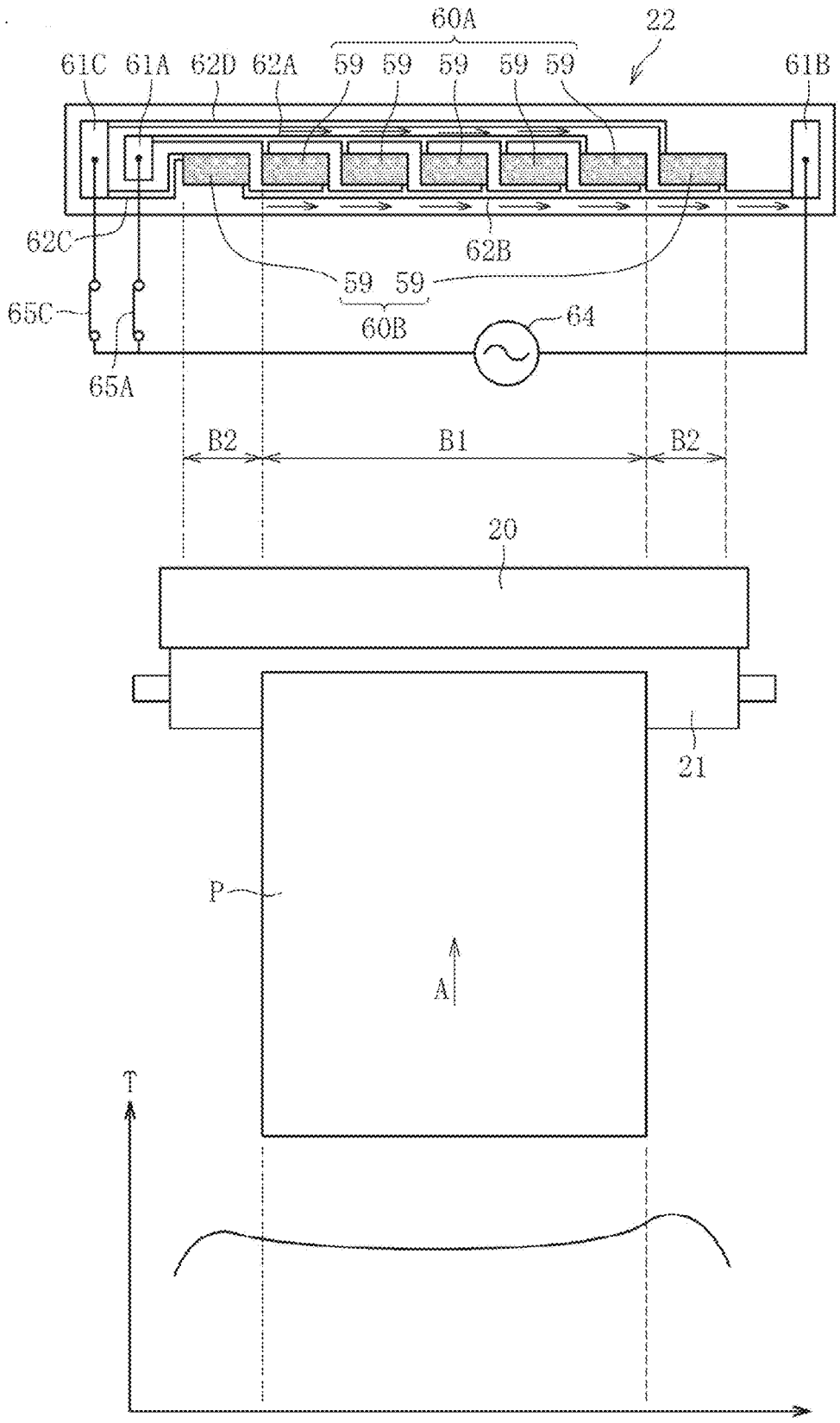
FIG. 22 is a diagram of a state where the temperature on a second side in the longitudinal direction is higher than that on a first side in the fixing device according to the third embodiment, and the upper part indicates the positional relation of the heater in the longitudinal direction, the center part indicates the positional relation of the fixing device in the longitudinal direction, and the lower part indicates the temperature distribution of the fixing belt in the longitudinal direction.

By performing whole energization just after the start of the image formation operation like the present embodiment, the image forming apparatus can make the temperature on the second side in the longitudinal direction higher than that on the first side just after the start of the image formation operation (that is, just after the job has arrived) as illustrated in FIG. 22. Consequently, the temperature deviation to be generated thereafter can be reduced, and uneven fixing and unevenness in glossiness of an image formed on the sheet can be suppressed. While switching to whole energization is made just after the start of the image formation operation and after the C-th sheet has passed through the fixing device in the present embodiment, whole energization may be performed only just after the start of the image formation operation, or switching to whole energization after the time D has passed as described before may be combined.

Figure 23:
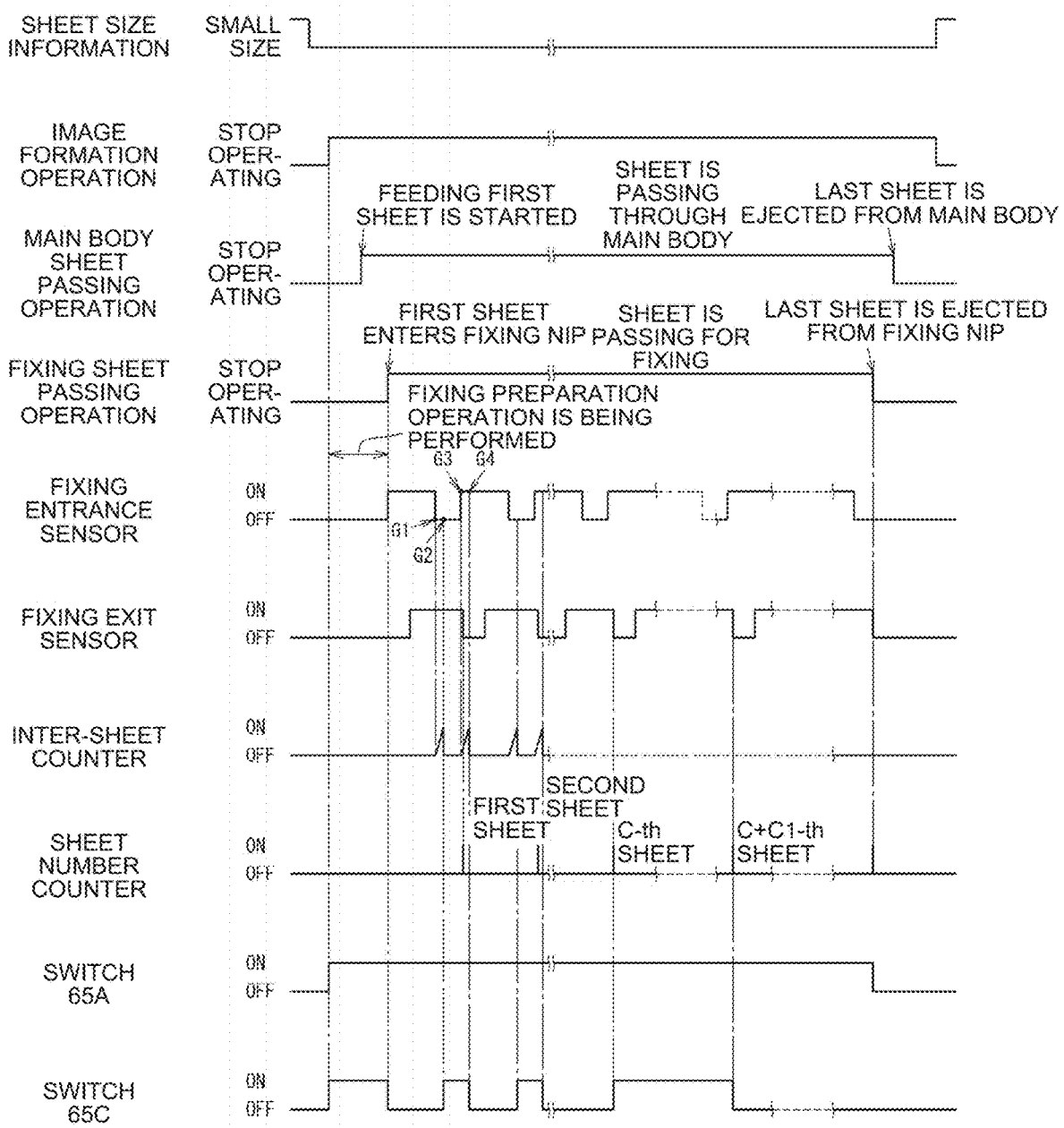
FIG. 23 is a timing chart of the timing of switching partial energization and whole energization in the fixing device according to a fourth embodiment.

Switching to whole energization may be made at an interval between the sheets in continuous sheet passing of the small-size sheet, that is, at the timing when no sheet passes through the fixing device 9. As illustrated in FIG. 23, for example, the timing when the trailing end of a sheet has passed through the fixing device 9 and the timing when the leading end of another sheet has reached the fixing device 9 are counted by an inter-sheet counter (refer to the seventh row in FIG. 23), and the switch 65C is turned on in the period of time (refer to the tenth row in FIG. 23).

The following describes the relation between the timing of turning on the inter-sheet counter and the position of the sheet passing through the fixing device in greater detail. Specifically, the following describes the positions of the sheet in the fixing device at respective points G1 to G4 illustrated in the fifth row in FIG. 23 with reference to FIGS. 24 to 27.

Figure 24:
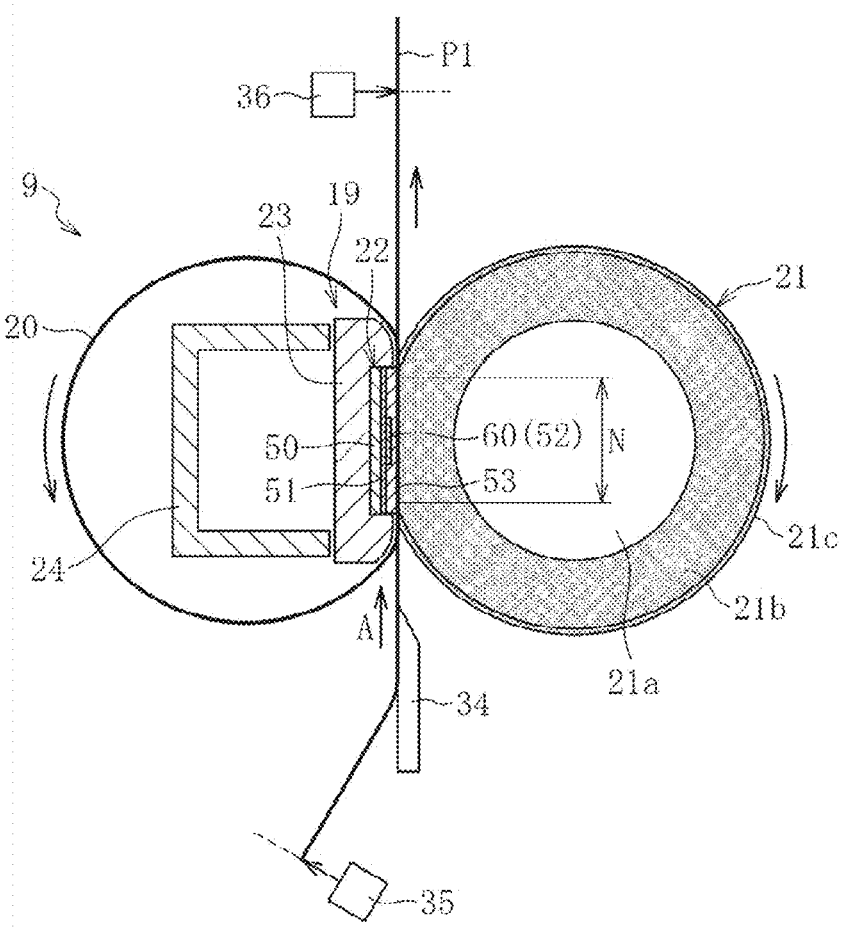
FIG. 24 is a diagram of a state of the fixing device at the point G1 in FIG. 23.

At the point G1, that is, when a detection state (on state) of the fixing entrance sensor 35 continues and is finished, output of the inter-sheet counter is switched. As illustrated in FIG. 24, the point G1 corresponds to the timing just after the trailing end of a sheet P1 has passed through the fixing entrance sensor 35.

Figure 25:
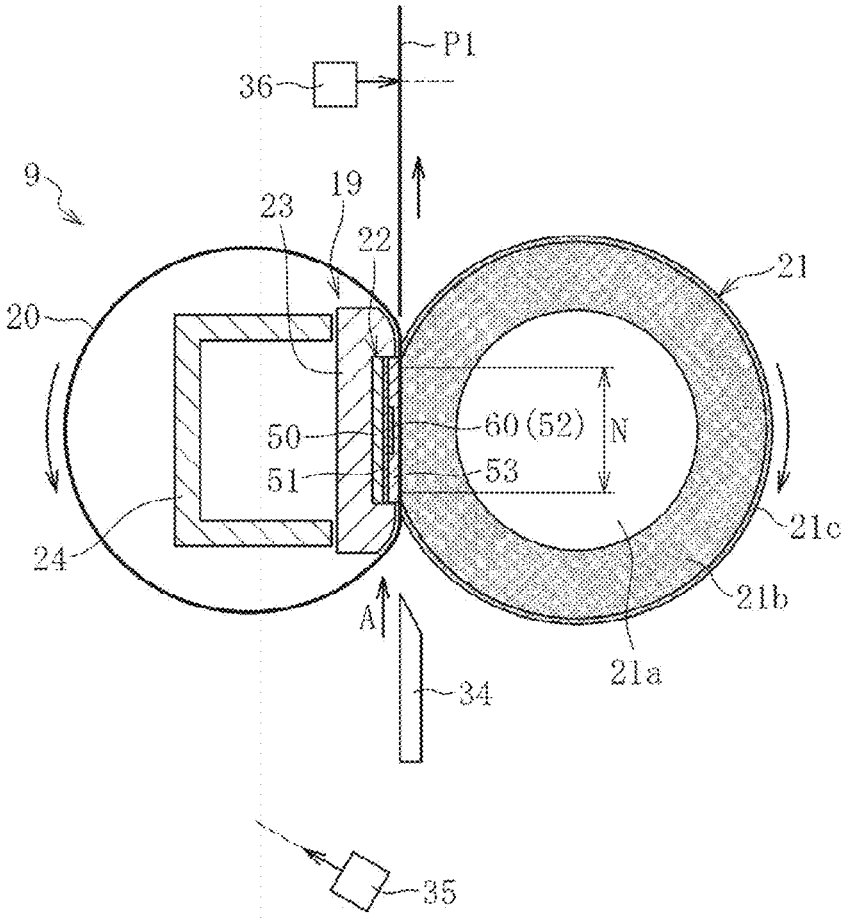
FIG. 25 is a diagram of a state of the fixing device at the point G2 in FIG. 23.

At the point G2 that is a predetermined time later from the point G1, the inter-sheet counter is turned on to perform counting. As illustrated in FIG. 25, the timing of the point G2 is just after the trailing end of the sheet P1 has passed through the fixing nip N.

Figure 26:
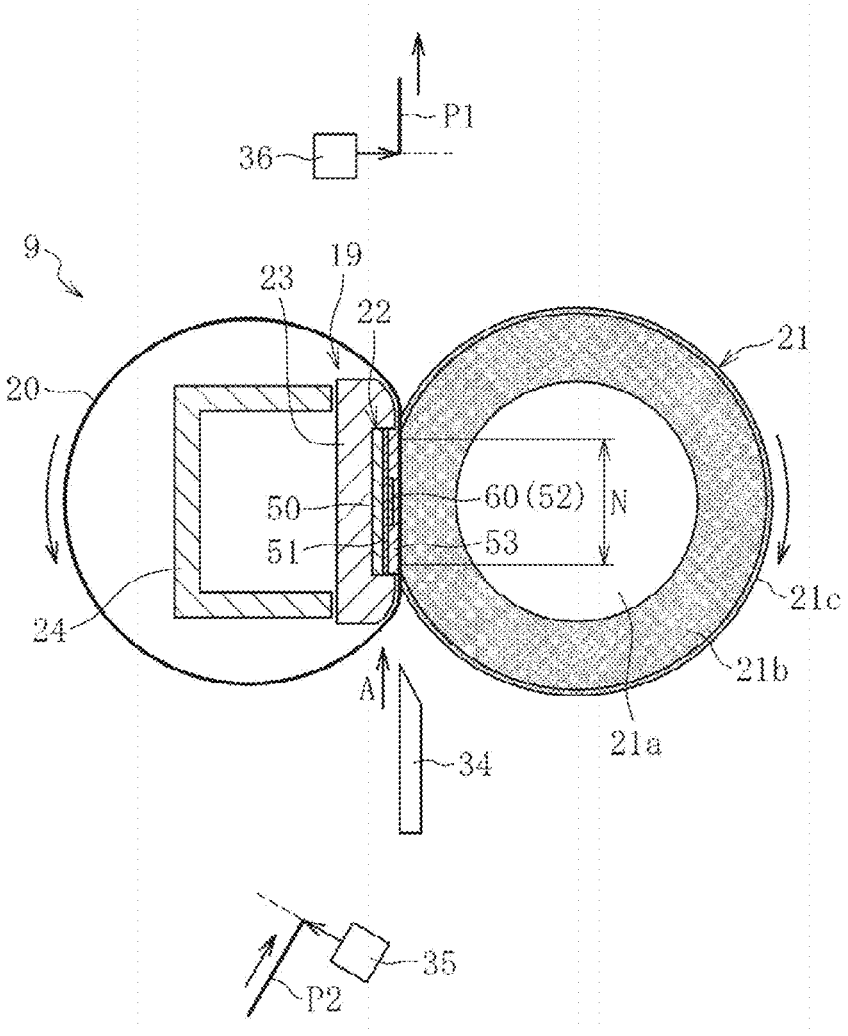
FIG. 26 is a diagram of a state of the fixing device at the point G3 in FIG. 23.

Subsequently, at the timing of the point G3 when the fixing entrance sensor 35 is brought into the detection state again, output of the inter-sheet counter is switched. As illustrated in FIG. 26, the point G3 corresponds to the timing when the leading end of the next sheet P2 has reached the fixing entrance sensor 35. When the first sheet P has reached the fixing entrance sensor 35, that is, when the fixing entrance sensor 35 is turned on for the first time, the inter-sheet counter does not perform counting.

Figure 27:
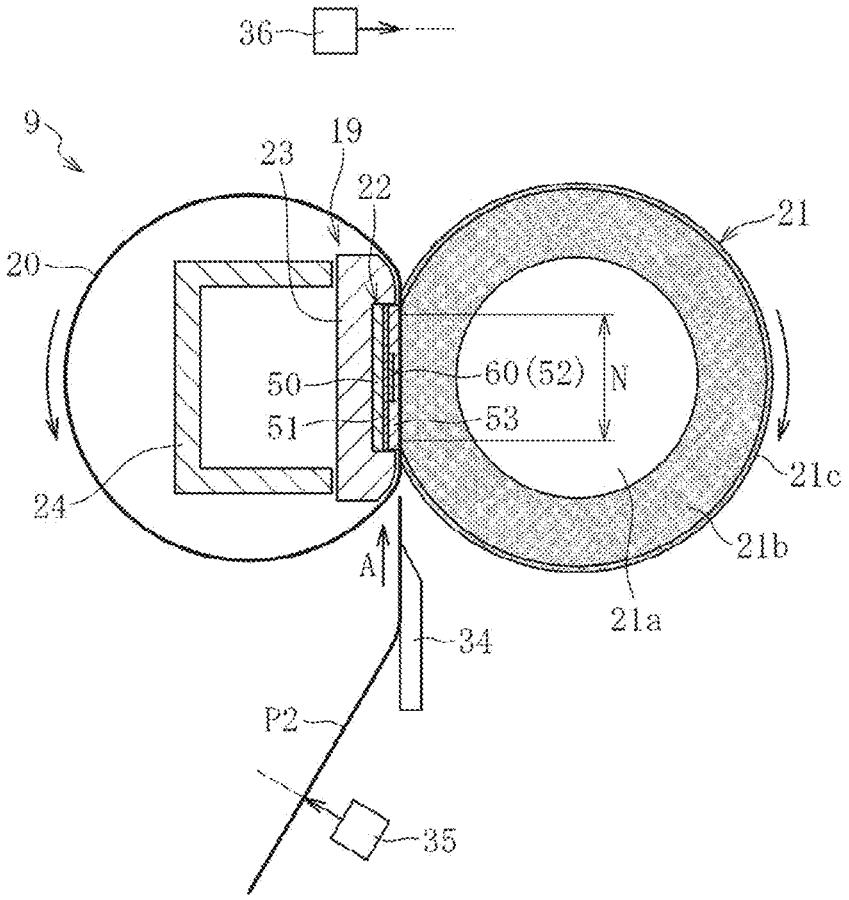
FIG. 27 is a diagram of a state of the fixing device at the point G4 in FIG. 23.

At the point G4 that is a predetermined time later from the point G3, the inter-sheet counter is turned on to perform second counting. As illustrated in FIG. 27, the timing of the point G4 is just before the leading end of the sheet P2 reaches the fixing nip N.

The period of time from the point G2 to the point G4 described above is determined to be an interval between the sheets and the switch 65C is turned on in the period of time (refer to the tenth row in FIG. 23). In other words, the switch 65C is turned on at the point G2 and turned off at the point G4. This enables to perform whole energization at the timing just after the sheet P1 has passed through the fixing device to when the next sheet P2 reaches the fixing device (that is, the timing between fixing operations). The time from the point G1 to the point G2 and the time from the point G3 to the point G4 are determined to be the timings illustrated in FIGS. 25 and 27 based on the conveyance speed of the sheet, the distance from the fixing entrance sensor 35 to the fixing nip N, and other factors.

In this way, in the present embodiment, whole energization is performed at an interval between the sheets. The interval between the sheets is also included in the period of the image formation operation and the period of the operation of executing the job. By performing whole energization in the period of time, the deviation between left and right in the temperature distribution of the fixing belt can be reduced, and uneven fixing and unevenness in glossiness of an image formed on the sheet can be suppressed. Also in the case of performing whole energization at an interval between the sheets, the image forming apparatus may appropriately combine other switching conditions, such as switching to whole energization after the time D has passed.

The image forming apparatus can also determine the timing of switching to whole energization based on the temperature detected by a temperature detector that detects the temperature of the fixing belt 20.

Figure 28:
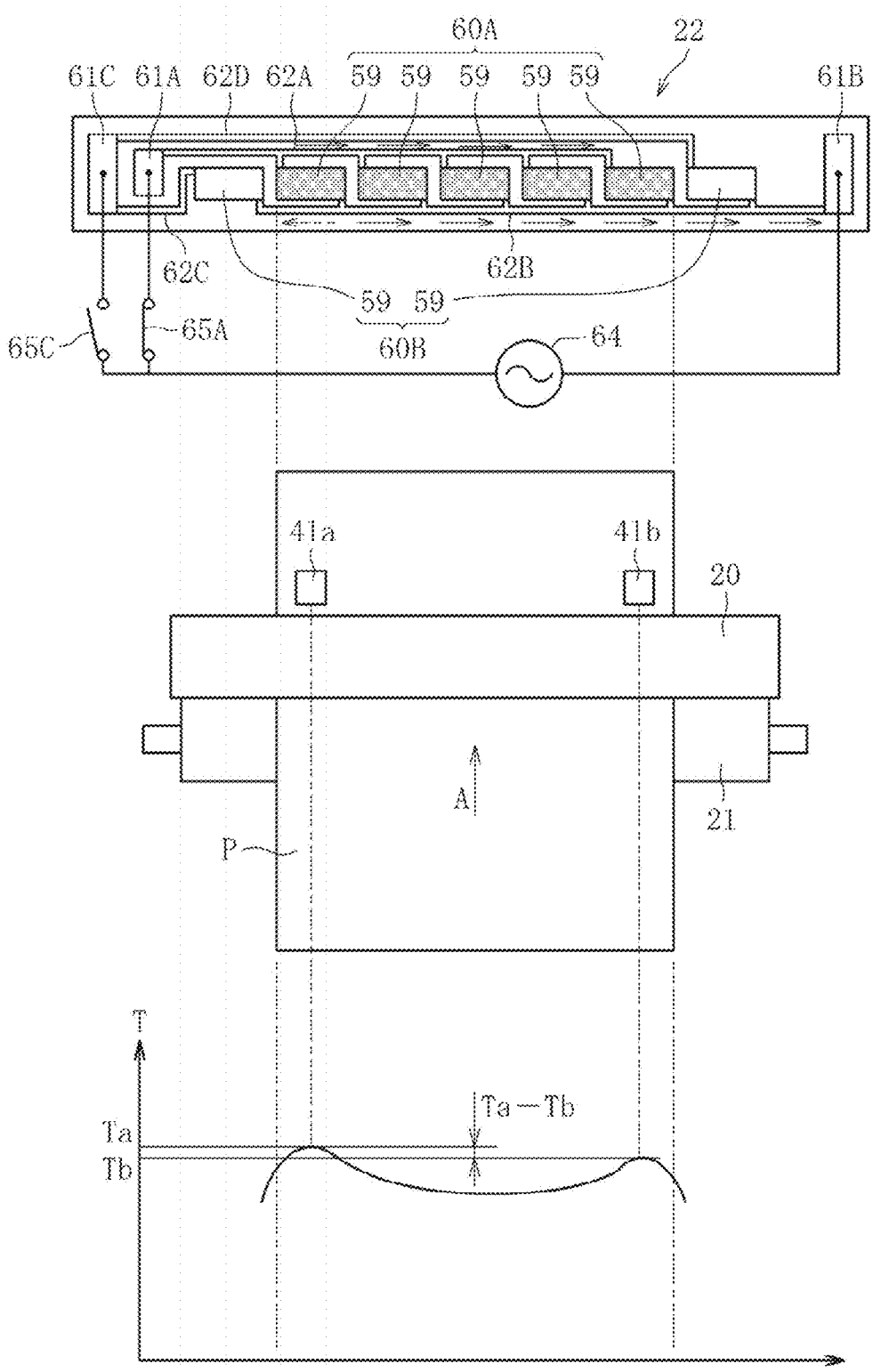
FIG. 28 is a diagram of the fixing device according to a fifth embodiment, and the upper part indicates the positional relation of the heater in the longitudinal direction, the center part indicates the positional relation of the fixing device in the longitudinal direction, and the lower part indicates the temperature distribution of the fixing belt in the longitudinal direction.

As illustrated in FIG. 28, for example, in the present embodiment, temperature detector 41*a* and 41*b* are disposed on the first side and the second side, respectively, of the center position of the passing sheet in the longitudinal direction at the positions facing the outer peripheral surface of the fixing belt 20. In other words, the temperature detector 41*a* and 41*b* are provided at the positions corresponding to the end on the first side and the end on the second side in the longitudinal direction of the small-size sheet P passing the fixing nip in the longitudinal direction of the heater 22. In other words, the temperature detector 41*a* and 41*b* are provided at the positions corresponding to the second block and the sixth block, respectively, illustrated in FIG. 13. The temperature detector 41*a* and 41*b* are thermistors, for example. The temperature detector 41*a* and 41*b* are not limited thereto and may be other known temperature detector.

The timing of switching between whole energization and partial energization is determined based on the difference Ta−Tb between temperature Ta and temperature Tb detected by the temperature detector 41*a* and 41*b* (refer to the graph illustrated at the lower part in FIG. 28).

Figure 29:
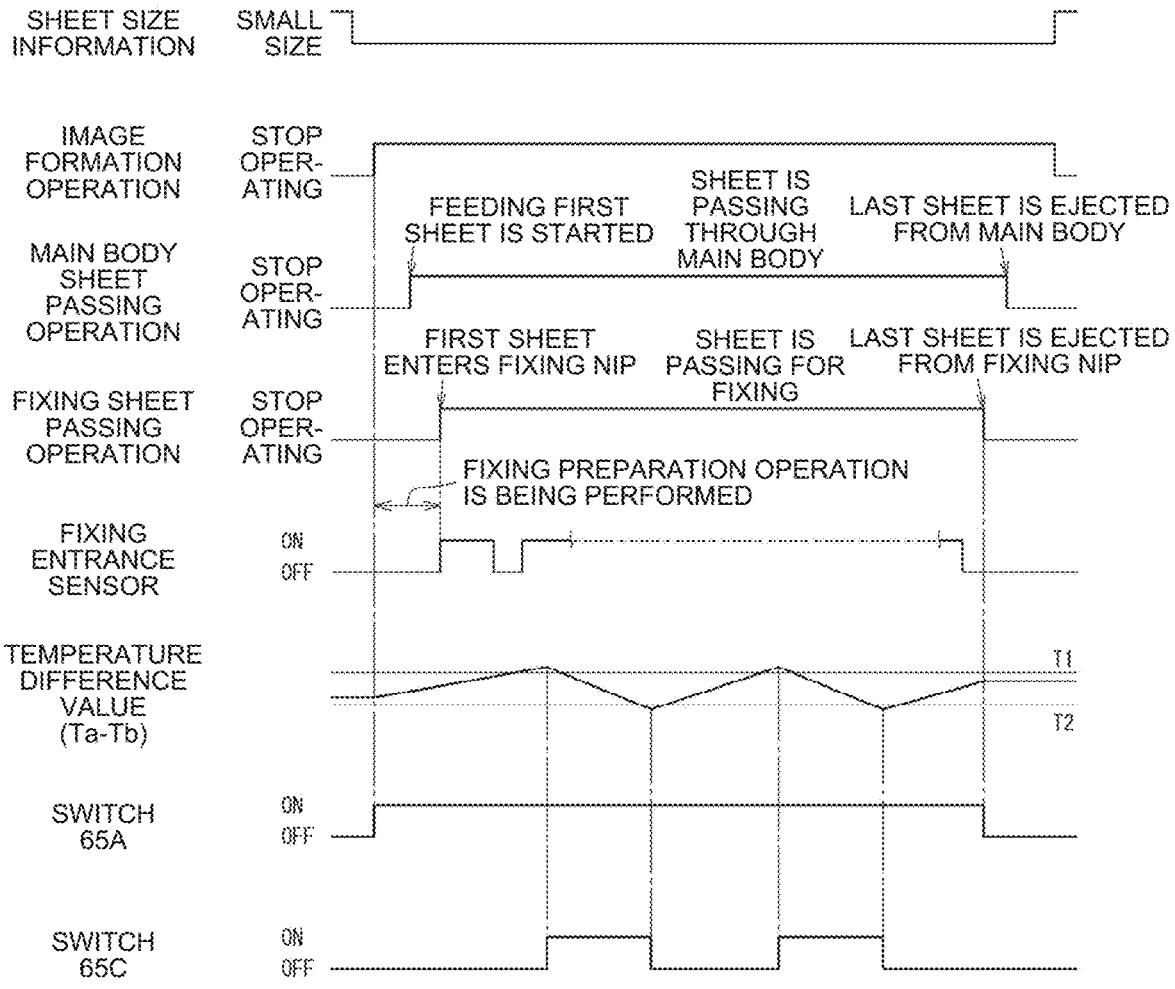
FIG. 29 is a timing chart of the timing of switching partial energization and whole energization in the fixing device according to the fifth embodiment.

Specifically, as illustrated in FIG. 29, the switch 65C is turned on to switch to whole energization when the temperature difference Ta−Tb (refer to the sixth row in FIG. 29) calculated based on the continuously detected temperatures Ta and Tb exceeds an upper temperature difference threshold T1. As a result, the temperature on the second side in the longitudinal direction rises.

Further, the switch 65C is turned off to switch to partial energization again when the temperature difference Ta−Tb falls below a lower temperature difference threshold T2. As a result, the temperature on the first side in the longitudinal direction rises again.

The switching can be performed at a more appropriate timing by determining the timing of switching between partial energization and whole energization based on the temperatures Ta and Tb in the sheet passing region of the fixing belt 20 actually detected by the temperature detector 41*a* and 41*b*. In particular, in the present embodiment, by setting the threshold T1 for the case where the temperature on the first side in the longitudinal direction is higher and setting the threshold T2 for the case where the temperature on the second side in the longitudinal direction is higher, both switching from partial energization to whole energization and switching from whole energization to partial energization can be performed at appropriate timings. Consequently, the deviation between left and right in the temperature distribution of the fixing belt can be effectively reduced, and unevenness in glossiness and uneven fixing of an image formed on the sheet can be suppressed. In addition, the non-sheet passing region can be prevented from overheating.

The temperature T1 is preferably set to 20 degrees or lower to effectively prevent unevenness in glossiness and fixability of an image. In addition, the temperature T1 needs to be set considering an error in temperature detection and the positions of the temperature detector 41*a* and 41*b*, variations in the sheet conveyance position with respect to the fixing nip, and an error in the positions of the resistive heat generators 59. In other words, the temperature T1 is preferably set to approximately 10 degrees to suppress erroneous detection due to these factors. For the same reason, the temperature T2 is preferably set to −20 degrees or higher and more preferably to approximately −10 degrees.

Next, an embodiment in which the temperature detectors are disposed at the positions different from those in FIG. 28 is described with reference to FIG. 30.

Figure 30:
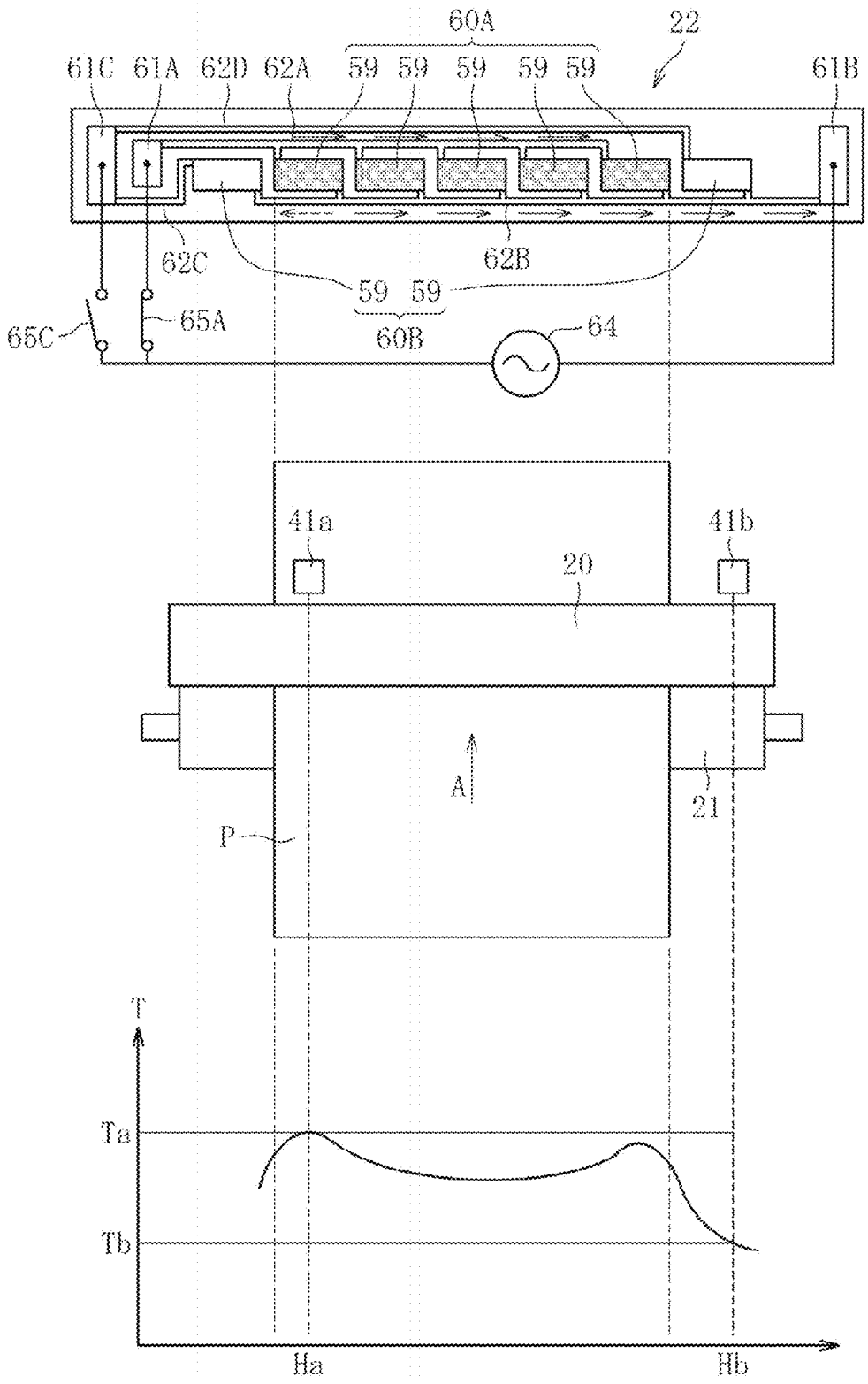
FIG. 30 is a diagram of the fixing device according to a sixth embodiment, and the upper part indicates the positional relation of the heater in the longitudinal direction, the center part indicates the positional relation of the fixing device in the longitudinal direction, and the lower part indicates the temperature distribution of the fixing belt in the longitudinal direction.

As illustrated in FIG. 30, the temperature detector 41*a* according to the present embodiment disposed on the first side in the longitudinal direction, that is, the side having a larger amount of generated heat in partial energization is disposed at a position Ha similarly to the embodiment above. The position Ha corresponds to the resistive heat generator 59 (second block in FIG. 13) on the first side in the longitudinal direction of the first heat generating unit 60A. The temperature detector 41*b* disposed on the second side in the longitudinal direction, that is, the side having a larger amount of generated heat in whole energization is disposed at a position Hb. The position Hb corresponds to the resistive heat generator 59 (seventh block in FIG. 13) disposed on the second side in the longitudinal direction outside the sheet passing region of the small-size sheet.

In the present embodiment, the thresholds are set for both the temperature Ta detected by the temperature detector 41*a* and the temperature Tb detected by the temperature detector 41*b*, and the timing of switching between partial energization and whole energization is determined based on the thresholds.

Figure 31:
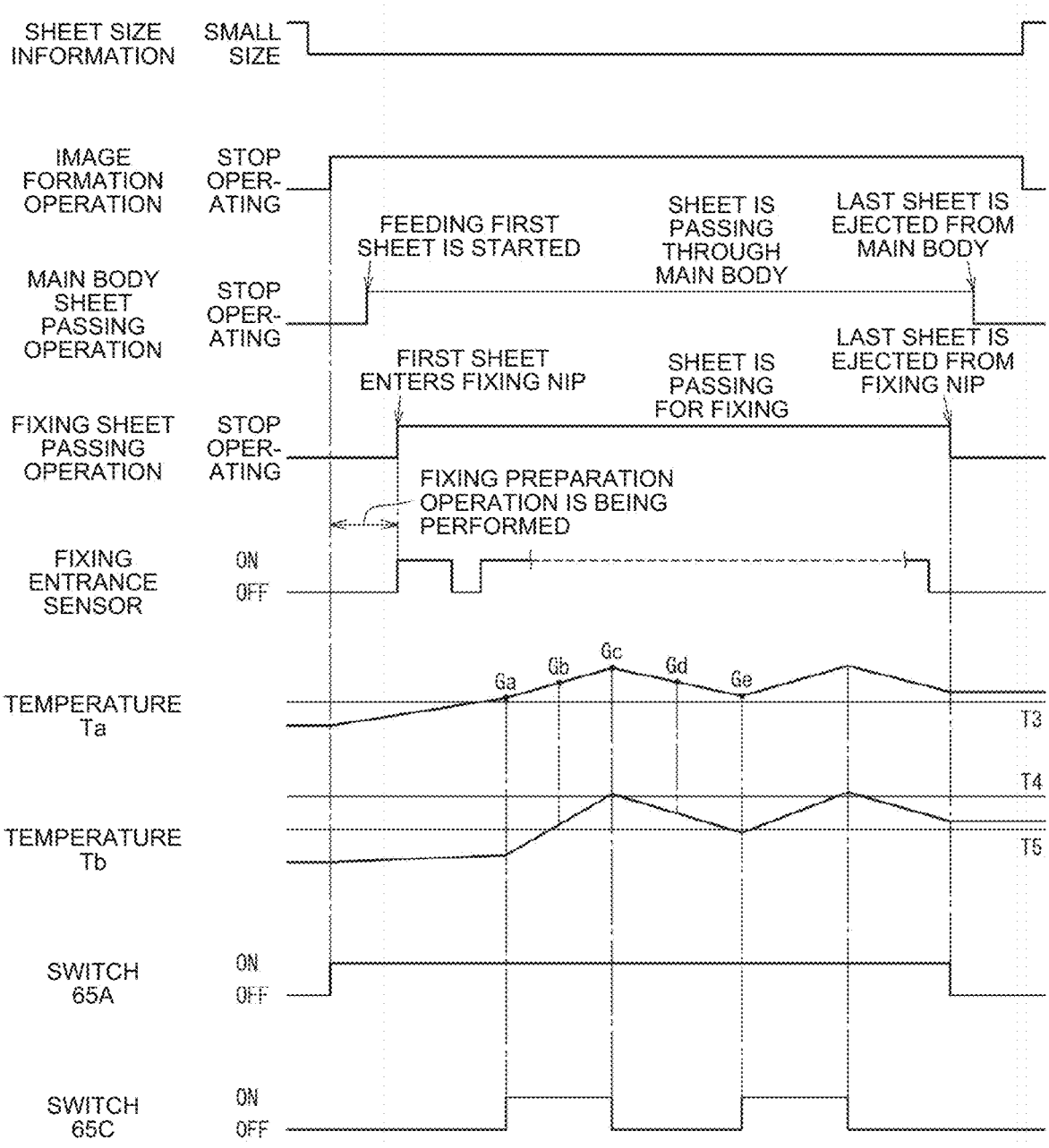
FIG. 31 is a timing chart of the timing of switching partial energization and whole energization in the fixing device according to the sixth embodiment.

Specifically, as illustrated in FIG. 31, the switch 65C is turned on to switch from partial energization to whole energization at the point Ga in FIG. 31 when the temperature Tb detected by the temperature detector 41*b* is lower than a lower threshold T5, and the temperature Ta detected by the temperature detector 41*a* exceeds a threshold T3 (refer to the sixth, the seventh, and the ninth rows in FIG. 31).

Figure 32A:
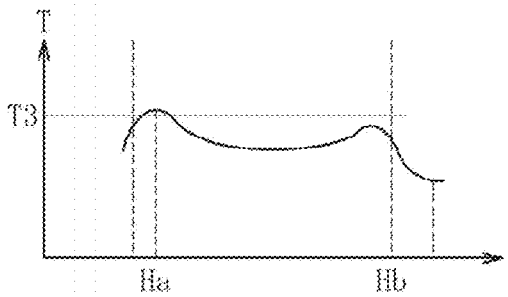
FIGS. 32A to 32E are diagrams of the temperature distribution of the fixing belt in the longitudinal direction at the points Ga to Ge in FIG. 31, respectively.
Figure 32B:
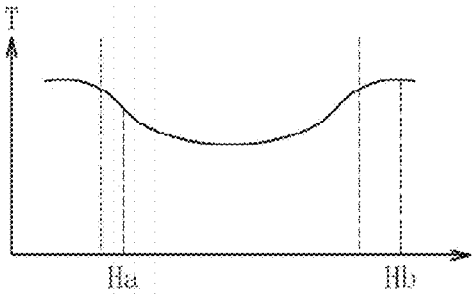

When the temperature Ta on the first side of the fixing belt 20 in the longitudinal direction reaches a certain temperature, that is, exceeds the threshold T3, a certain temperature difference is generated between the first side and the second side in the longitudinal direction as illustrated in FIG. 32A, for example. Therefore, by continuously performing whole energization for a certain period of time in this case, the temperature deviation between the first side and the second side in the longitudinal direction is canceled at the point Gb in FIG. 31, for example, as illustrated in FIG. 32B. This can suppress unevenness in glossiness and uneven fixing of an image formed on the sheet.

Figure 32C:
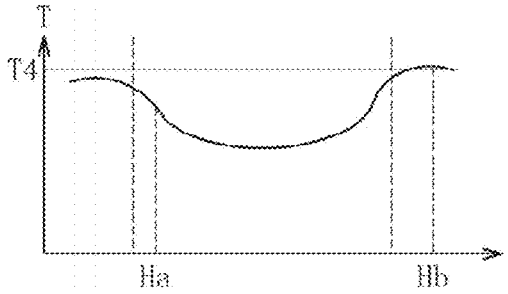
Figure 32D:
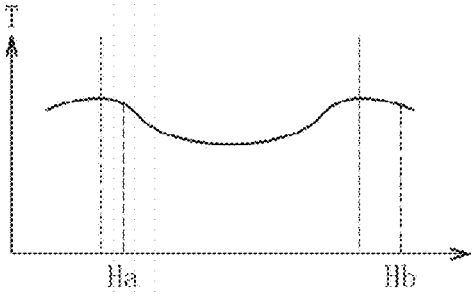

If whole energization is further continuously performed, the temperature on the second side in the longitudinal direction, and in particular the temperature of the non-sheet passing region rises. Specifically, at the point Gc in FIG. 31 when whole energization is continuously performed, and the temperature Tb exceeds an upper threshold T4, the temperature on the second side in the longitudinal direction is higher than that on the first side, and in particular the temperature of the non-sheet passing region on the second side in the longitudinal direction is much higher as illustrated in FIG. 32C. In the present embodiment, when the temperature Tb exceeds the upper threshold T4, the switch 65C is turned on to switch from whole energization to partial energization. Switching to partial energization makes the amount of heat generated on the first side in the longitudinal direction larger than that on the second side. In addition, the resistive heat generators 59 in the non-sheet passing region do not generate heat. By continuously performing this partial energization for a certain period of time, the temperature deviation between the first side and the second side in the longitudinal direction is reduced again at the point Gd in FIG. 31, for example, as illustrated in FIG. 32D. In particular, the temperature of the non-sheet passing region on the second side in the longitudinal direction falls.

By setting the upper threshold T4 for the temperature Tb as the condition for switching to partial energization in this way, unevenness in glossiness and uneven fixing of an image formed on the sheet can be suppressed, and the non-sheet passing region can be prevented from overheating. The temperature T4 can be set to 210° C., for example, as a temperature that can prevent the overheating considering the heat resistance of the fixing belt 20 and the pressure roller 21.

Figure 32E:
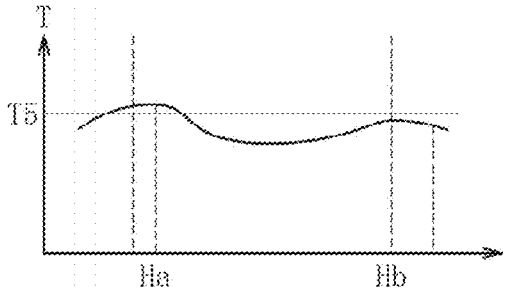

Subsequently, if partial energization is continuously performed, the temperature on the second side in the longitudinal direction, and in particular the temperature of the non-sheet passing region continues to fall. As a result, the temperature on the second side in the longitudinal direction becomes smaller again than that on the first side at the point Ge in FIG. 31, for example, as illustrated in FIG. 32E.

As described before, in the partial energization state, switching to whole energization is made again when the temperature Tb is lower than the threshold T5 (and the temperature Ta is higher than the threshold T3). As a result, the amount of heat generated on the second side in the longitudinal direction is made larger, thereby reducing the temperature deviation between the first side and the second side in the longitudinal direction.

As described above, in the present embodiment, by setting the thresholds for the temperatures Ta and Tb detected by the temperature detector 41*a* and 41*b*, respectively, to switch between partial energization and whole energization, the switching can be performed at appropriate timings. Therefore, the deviation between left and right in the temperature distribution of the fixing belt can be effectively reduced, and unevenness in glossiness and uneven fixing of an image formed on the sheet can be suppressed. In addition, the non-sheet passing region can be prevented from overheating. Further, the timing of switching to whole energization at the start of the image formation operation (during the preparation operation of the fixing device), and the like may be combined with the timing of switching using the temperatures detected by the temperature detector 41*a* and 41*b*.

As described above, in the embodiment of the present invention, switching between whole energization and partial energization is made at the timing when a difference is generated between the temperature on the first side of the heater 22 in the longitudinal direction and that on the second side in an operation of executing the job of continuously forming an image on a plurality of small-size sheets (image formation operation). Specifically, heat generation (first heat generation state) by partial energization of energizing only the first heat generating unit 60A serving as the heat generation region corresponding to the width of the small-size sheet is performed, while heat generation (second heat generation state) by whole energization of energizing the first heat generating unit 60A and the second heat generating unit 60B is performed at a predetermined timing. This enables to suppress unevenness in temperature and uneven heating of the heating device due to the temperature deviation between the first side and the second side of the heater 22 in the longitudinal direction. Particularly in the fixing device 9, the temperature deviation between left and right of the fixing belt 20 in the longitudinal direction can be reduced. Therefore, unevenness in glossiness and uneven fixing of an image due to the temperature deviation can be suppressed.

Figure 43:
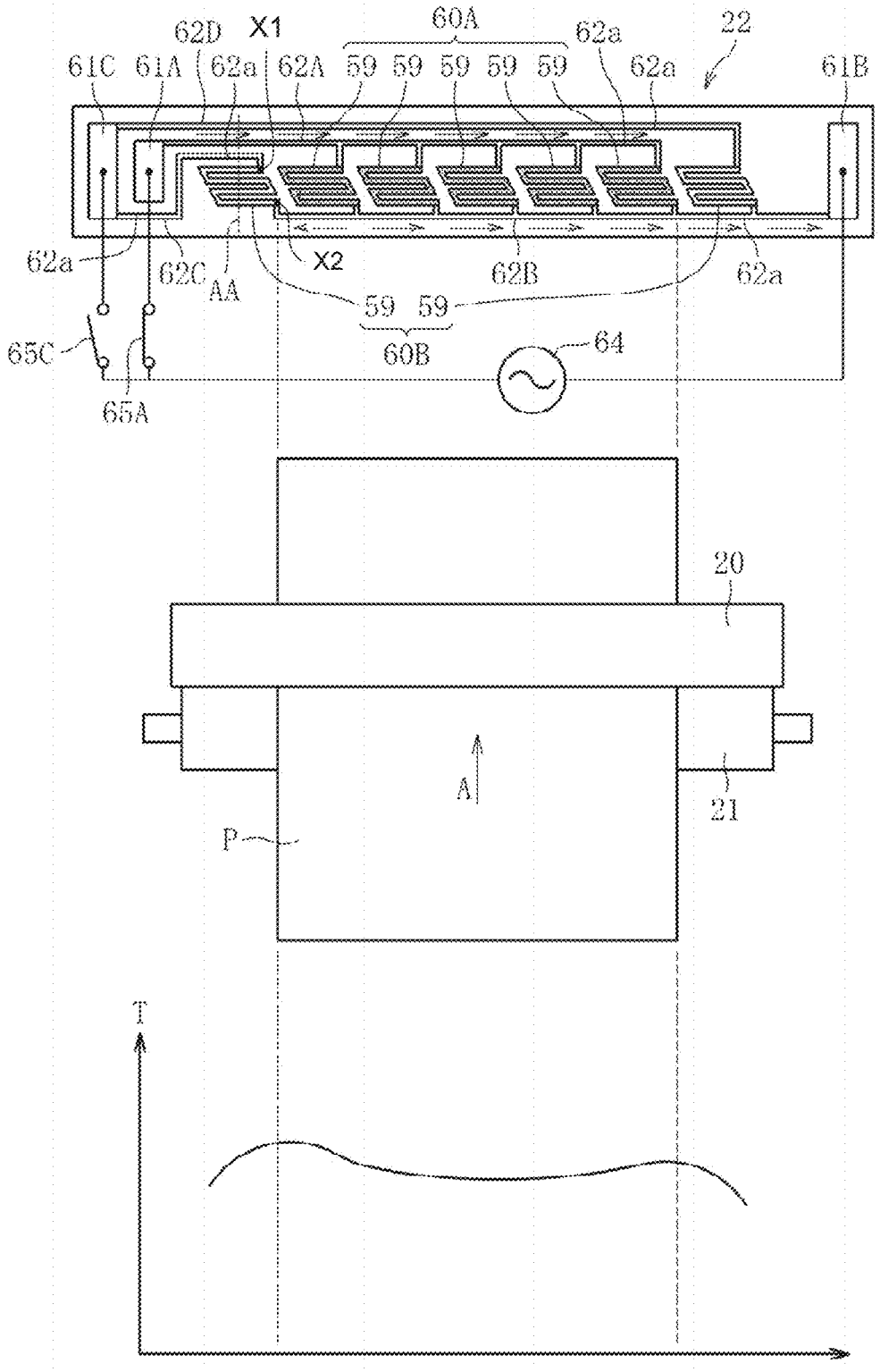
FIG. 43 is a diagram of a case where partial energization is performed in the heater including linear resistive heat generators, and the upper part indicates the positional relation of the heater in the longitudinal direction, the center part indicates the positional relation of the fixing device in the longitudinal direction, and the lower part indicates the temperature distribution of the fixing belt in the longitudinal direction.

The resistive heat generators 59 provided to the heater 22 do not necessarily have a block shape as illustrated in FIG. 7, As illustrated in FIG. 43, for example, the resistive heat generators 59 each have a parallelogram shape formed of a folded linear part. The linear part constituting the resistive heat generator 59 according, to the present embodiment is folded an odd number of times (three times) in the longitudinal direction. With this structure, a coupling position X1 at which the resistive heat generator 59 is coupled to the first power supply line 62A, the third power supply line 62C, and the fourth power supply line 62D and a coupling position X2 at which the resistive heat generator 59 is coupled to the second power supply line 62B are disposed on the second side of a center position AA of the resistive heat generator 59 in the longitudinal direction. In other words, both the coupling position X1 and the coupling position X2 are disposed on the same side of the center position AA of the resistive heat generator 59 in the longitudinal direction.

Figure 44:
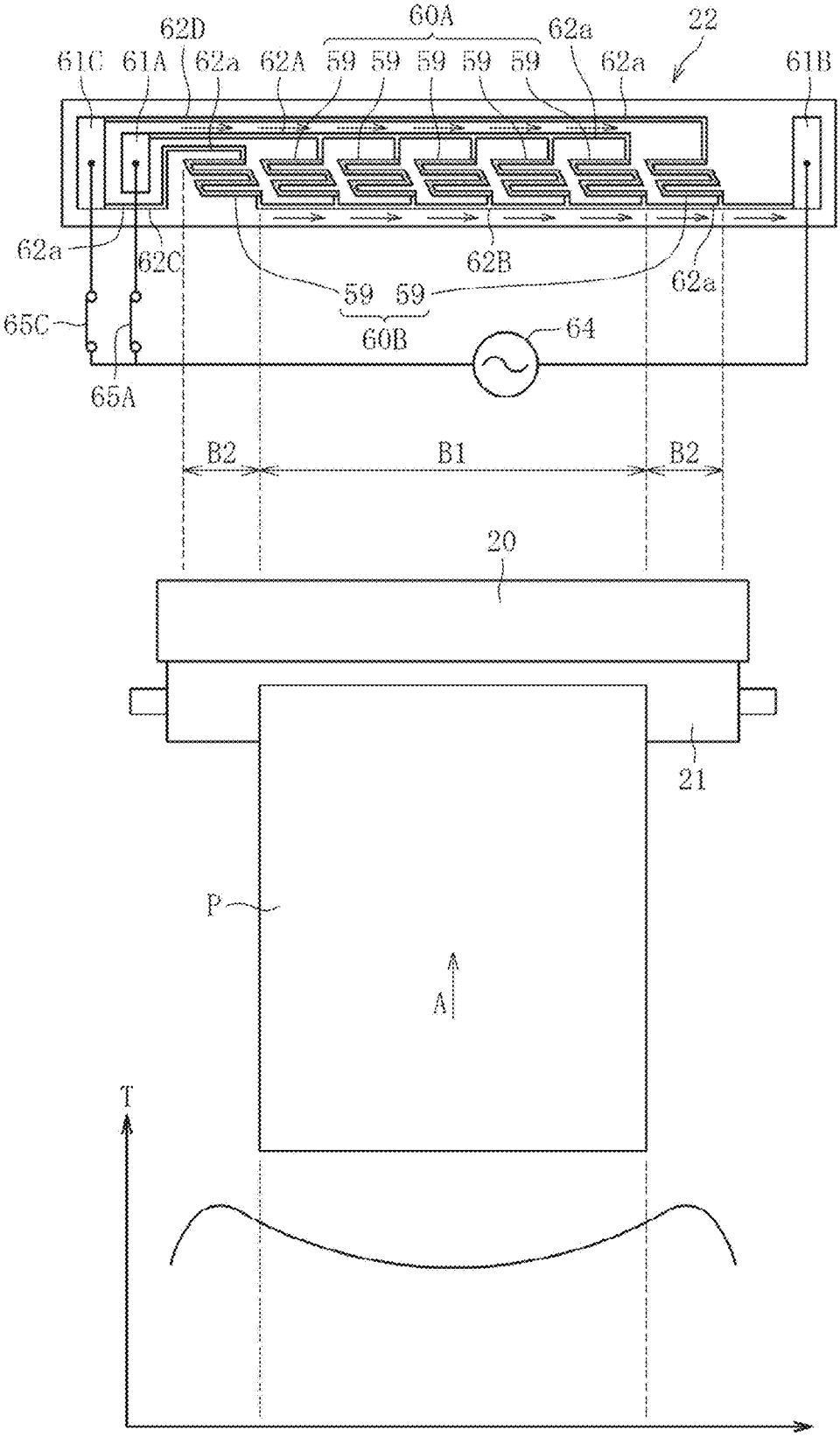
FIG. 44 is a diagram of a case where whole energization is performed in the heater illustrated in FIG. 43, and the upper part indicates the positional relation of the heater in the longitudinal direction, the center part indicates the positional relation of the fixing device in the longitudinal direction, and the lower part indicates the temperature distribution of the fixing belt in the longitudinal direction.

Also in the present embodiment, if only the first heat generating unit 60A is energized (partial energization) as illustrated in FIG. 43, an unintended branch current is generated. As a result, the amount of heat generated on the first side (left in FIG. 43) in the longitudinal direction is made larger, thereby making the temperature T of the fixing belt 20 higher on the first side in the longitudinal direction. If the first heat generating unit 60A and the second heat generating unit 60B are energized (whole energization) as illustrated in FIG. 44, the amount of heat generated on the second side (right in FIG. 44) in the longitudinal direction is made larger, thereby making the temperature T of the fixing belt 20 higher on the second side in the longitudinal direction.

Figure 45:
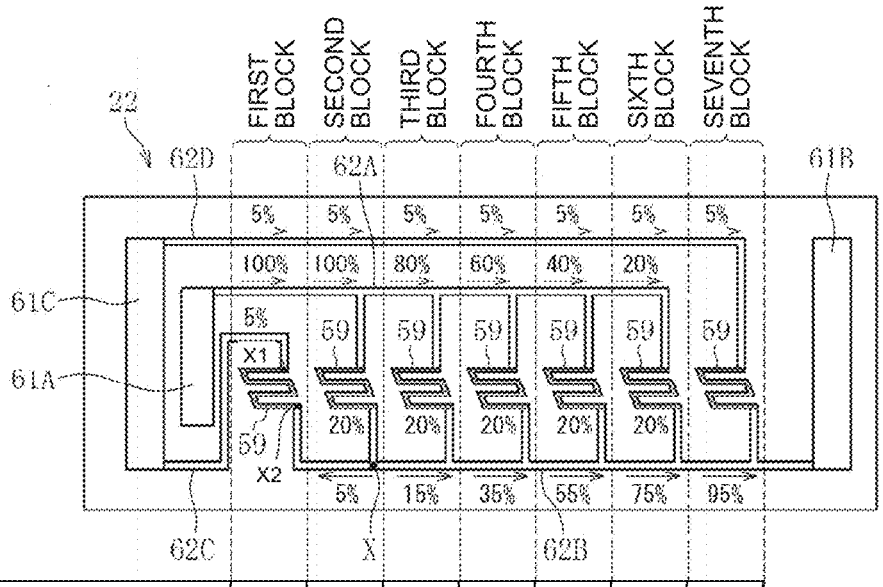
FIG. 45 is a diagram of the amount of heat generated by the power supply lines in the blocks when an unintended branch current is generated in the heater illustrated in FIG. 43.
Figure 45:
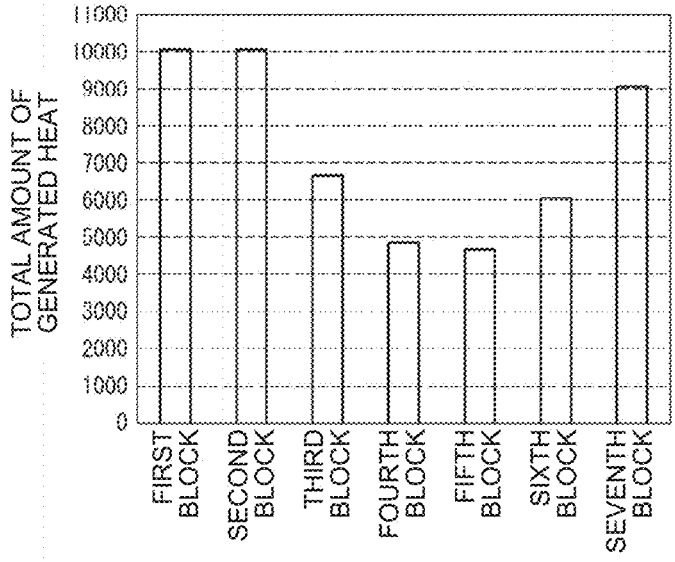
Figure 46:
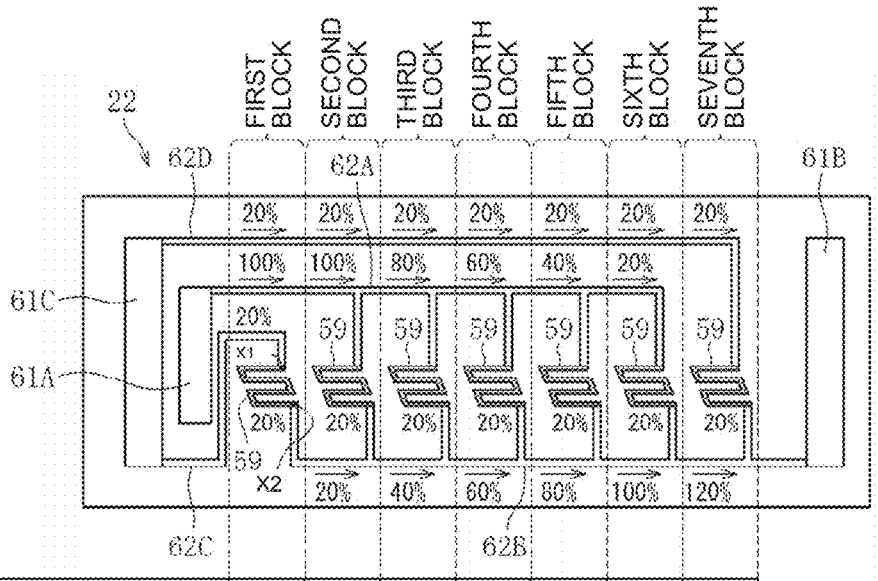
FIG. 46 is a diagram of the amount of heat generated by the power supply lines in the blocks when all the heat generating units are energized in the heater illustrated in FIG. 43.
Figure 46:
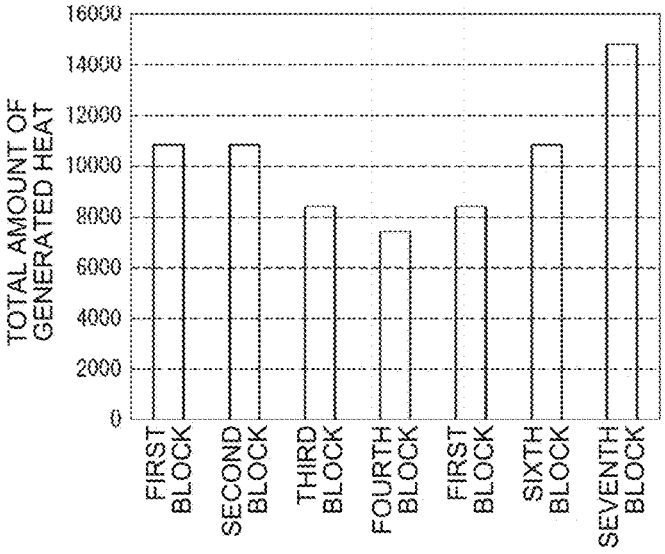

Let us assume a case where an electric current flows to the resistive heat generators 59 evenly by 205 each. In partial energization, the amount of heat generated by the power supply lines in the second block is the largest in the heating region of the resistive heat generators 59 of the first heat generating unit 60A as illustrated in FIG. 45. In whole energization, the amount of heat generated in the seventh block is the largest as illustrated in FIG. 46.

The same control as that described in the embodiments above can be performed on the heater 22 according to the present embodiment. Specifically, as illustrated in FIG. 19, when the sheet number counter counts the C-th sheet after the image forming apparatus receives the job of continuously performing printing on a small-size sheet, the switch 65C is turned on to perform whole energization. Whole energization is performed until the sheet number counter counts the C+C1-th sheet (refer to the seventh and the ninth rows in FIG. 19). This enables to switch to whole energization when a certain amount or more of temperature difference is generated between the first side and the second side of the fixing belt 20 in the longitudinal direction. This can reduce the deviation between left and right in the temperature distribution of the fixing belt, thereby suppressing uneven fixing and unevenness in glossiness of an image formed on the sheet.

Similarly to the embodiment described before, as illustrated in FIG. 20, switching to whole energization in a certain period of time can be made using the time counter. For example, switching to whole energization can be made from the point of D seconds to the point of D+D1 seconds since the start of the image formation operation, (refer to the seventh row in FIG. 20). This enables to reduce the deviation between left and right in the temperature distribution of the fixing belt, thereby suppressing uneven fixing and unevenness in glossiness of an image formed on the sheet.

Figure 47:
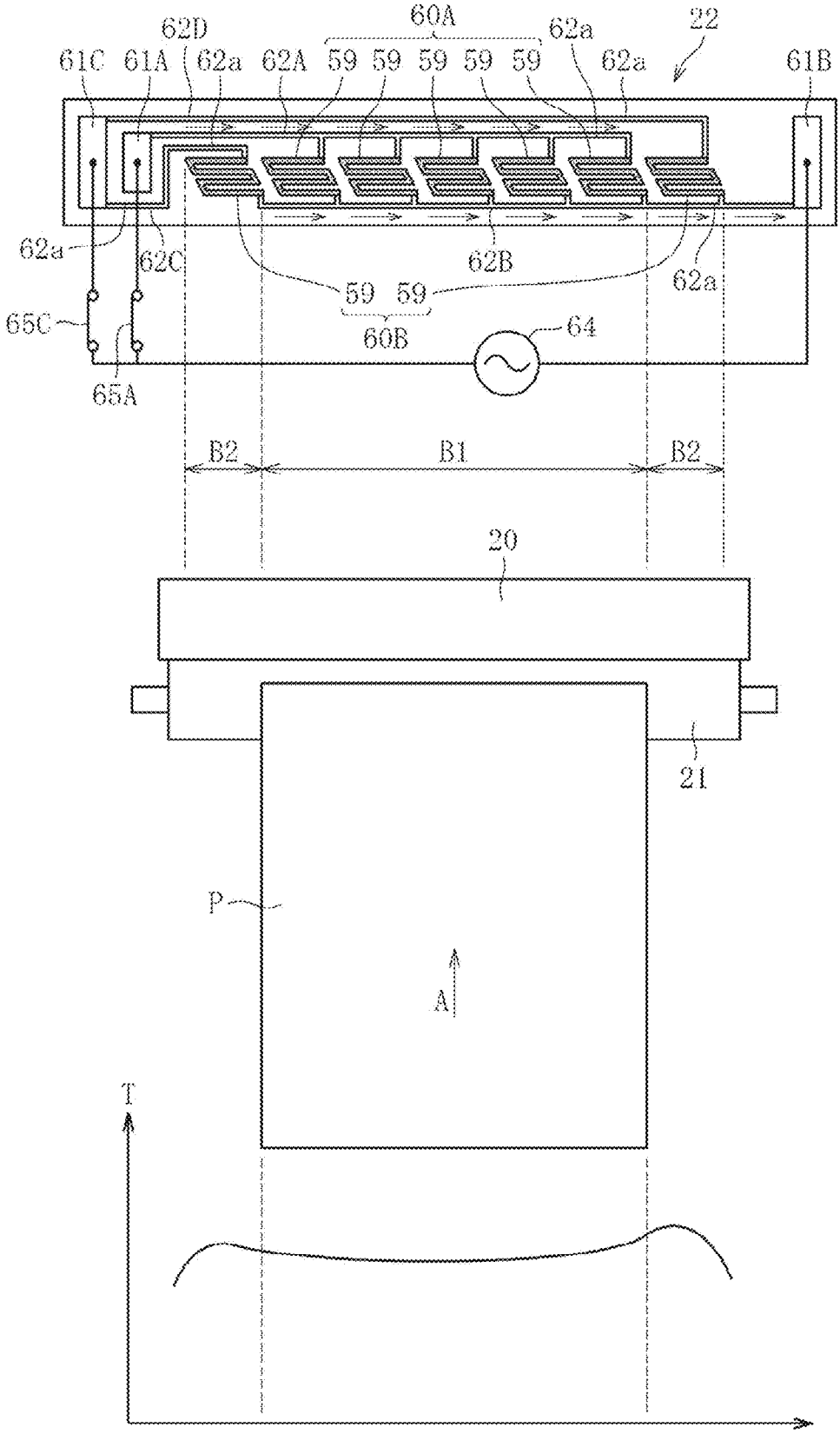
FIG. 47 is a diagram of a case where whole energization is performed just after the image formation operation is started in the heater illustrated in FIG. 43, and the upper part indicates the positional relation of the heater in the longitudinal direction, the center part indicates the positional relation of the fixing device in the longitudinal direction, and the lower part indicates the temperature distribution of the fixing belt in the longitudinal direction.

Further, as illustrated in FIG. 21, whole energization can be performed just after the start of the image formation operation (refer to the ninth row in FIG. 21). By performing whole energization just after the start of the image formation operation, the temperature on the second side in the longitudinal direction can be made higher than that on the first side just after the start of the image formation operation (that is, just after the job has arrived) as illustrated in FIG. 47. Therefore, the temperature deviation to be generated thereafter can be reduced, and uneven fixing and unevenness in glossiness of an image formed on the sheet can be suppressed.

Further, as described above, switching to whole energization can be made at an interval between the sheets. Specifically, as illustrated in FIG. 23, switching to whole energization can be made in the period of time from the point G2 to the point G4 (refer to the fifth and the tenth rows in FIG. 23). By performing whole energization in the period of time, the deviation between left and right in the temperature distribution of the fixing belt can be reduced, and uneven fixing and unevenness in glossiness of an image formed on the sheet can be suppressed.

Figure 48:
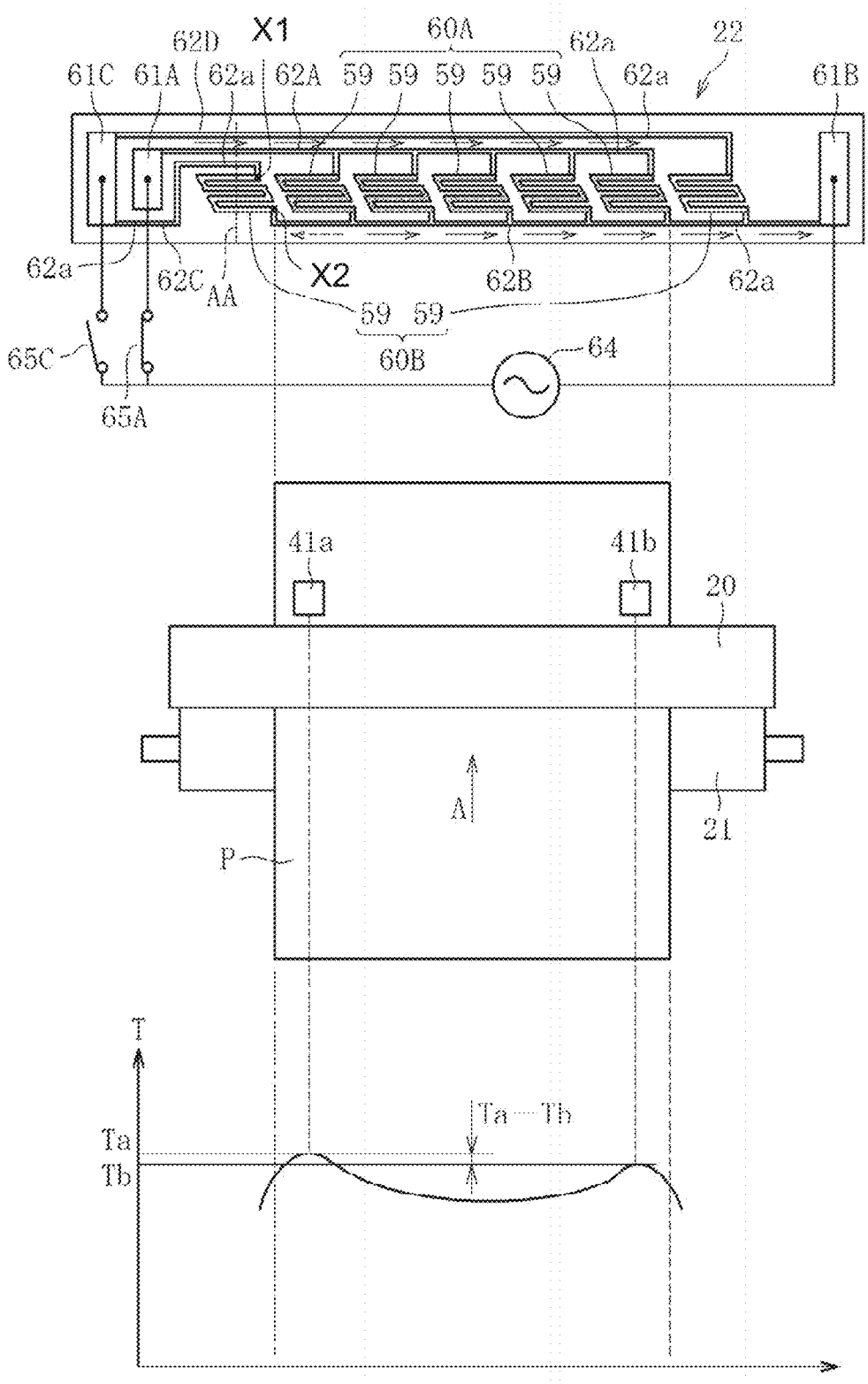
FIG. 48 is a diagram of the fixing device fabricated by providing a temperature detector to the heater illustrated in FIG. 43, and the upper part indicates the positional relation of the heater in the longitudinal direction, the center part indicates the positional relation of the fixing device in the longitudinal direction, and the lower part indicates the temperature distribution of the fixing belt in the longitudinal direction.

As illustrated in FIG. 48, in the present embodiment, the temperature detector 41*a* and 41*b* are disposed on the first side and the second side, respectively, of the center position of the passing sheet in the longitudinal direction at the positions facing the outer peripheral surface of the fixing belt 20. More specifically, the temperature detector 41*a* and 41*b* are provided at the positions corresponding to the end on the first side and the end on the second side in the longitudinal direction of the small-size sheet P passing the fixing nip in the longitudinal direction of the heater 22. In other words, the temperature detector 41*a* and 41*b* are provided at the positions corresponding to the second block and the sixth block, respectively, illustrated in FIG. 13.

The timing of switching between whole energization and partial energization is determined based on the difference Ta−Tb between the temperature Ta and the temperature Tb detected by the temperature detector 41*a* and 41*b*. Specifically, as illustrated in FIG. 29, the switch 65C is turned on to switch to whole energization when the temperature difference Ta−Tb (refer to the sixth row in FIG. 29) calculated based on the continuously detected temperatures Ta and Tb exceeds the upper temperature difference threshold T1. With this, the temperature on the second side in the longitudinal direction rises. Further, the switch 65C is turned off to switch to partial energization again when the temperature difference Ta−Tb falls below the lower temperature difference threshold T2. As a result, the temperature on the first side in the longitudinal direction rises again.

The switching can be made at a more appropriate timing by determining the timing of switching between partial energization and whole energization based on the temperatures Ta and Tb in the sheet passing region of the fixing belt 20 actually detected by the temperature detector 41*a* and 41*b*. This can effectively reduce the deviation between left and right in the temperature distribution of the fixing belt, and suppress unevenness in glossiness and uneven fixing of an image formed on the sheet. In addition, the non-sheet passing region can be prevented from overheating.

Figure 49:
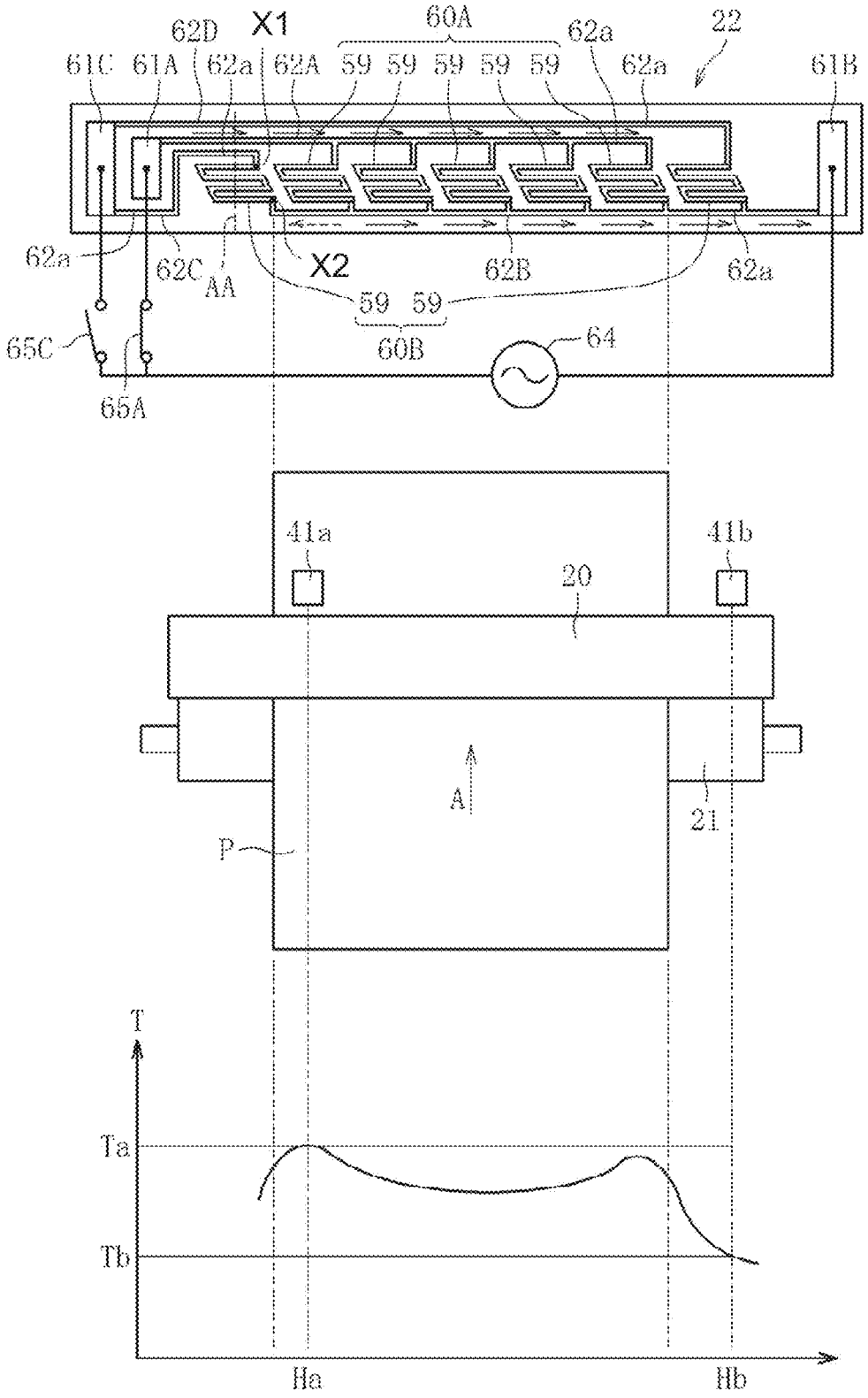
FIG. 49 is a diagram of the fixing device different from the fixing device illustrated in FIG. 48 in the position of the temperature detector, and the upper part indicates the positional relation of the heater in the longitudinal direction, the center part indicates the positional relation of the fixing device in the longitudinal direction, and the lower part indicates the temperature distribution of the fixing belt in the longitudinal direction.

As illustrated in FIG. 49, the temperature detector 41*a* according to the present embodiment disposed on the first side in the longitudinal direction, that is, the side having a larger amount of generated heat in partial energization is disposed at the position Ha similarly to the embodiment above. The position Ha corresponds to the resistive heat generator 59 on the first side in the longitudinal direction of the first heat generating unit 60A. The temperature detector 41*b* disposed on the second side in the longitudinal direction, that is, the side having a larger amount of generated heat in whole energization is disposed at the position Hb. The position Hb corresponds to the resistive heat generator 59 on the second side in the longitudinal direction outside the sheet passing region of the small-size sheet.

In the present embodiment, similarly to the embodiment above illustrated in FIG. 31, the switch 65C is turned on to switch from partial energization to whole energization at the point Ga in FIG. 31 when the temperature Tb detected by the temperature detector 41*b* is lower than the lower threshold T5, and the temperature Ta detected by the temperature detector 41*a* exceeds the threshold T3 (refer to the sixth, the seventh, and the ninth rows in FIG. 31). This can reduce the deviation between the first side and the second side in the longitudinal direction, and suppress unevenness in glossiness and uneven fixing of an image formed on the sheet.

Further, when the temperature Tb exceeds the upper threshold T4, the switch 65C is turned off to switch from whole energization to partial energization. Switching to partial energization makes the amount of heat generated on the first side in the longitudinal direction larger than that on the second side. In addition, the resistive heat generators 59 in the non-sheet passing region do not generate heat. This reduces the temperature deviation between the first side and the second side in the longitudinal direction again, and in particular, the temperature of the non-sheet passing region on the second side in the longitudinal direction falls.

By setting the upper threshold T4 for the temperature Tb as the condition for switching to partial energization, unevenness in glossiness and uneven fixing of an image formed on the sheet can be suppressed, and the non-sheet passing region can prevented from overheating.

As described above, in the present embodiment, by setting the thresholds for the temperatures Ta and Tb detected by the temperature detector 41*a* and 41*b*, respectively, to switch between partial energization and whole energization, the switching can be made at appropriate timings. Therefore, the deviation between left and right in the temperature distribution of the fixing belt can be effectively reduced, and unevenness in glossiness and uneven fixing of an image formed on the sheet can be suppressed.

Figure 50:
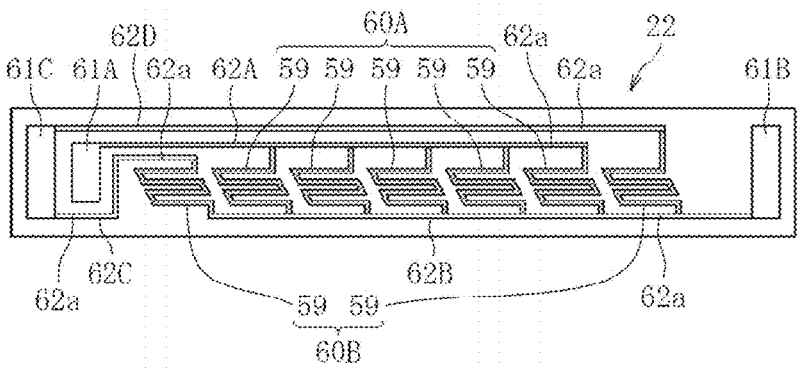
FIG. 50 is a plan view of a modification of the heater different from the heater illustrated in FIG. 43 in the resistive heat generators and the power supply lines.

The first power supply line 62A and the second power supply line 62B according to the present embodiment each have parts extending in a short-side direction Y of the heater 22. The parts extending in the short-side direction Y are coupled to the respective resistive heat generators 59. The parts extending in the short-side direction Y of the heater 22 to couple the power supply lines 62A and 62B to the respective resistive heat generators 59 are not necessarily part of the power supply lines 62A and 62B. The parts may be part of the resistive heat generators 59 as illustrated in FIG. 50.

Figure 51:
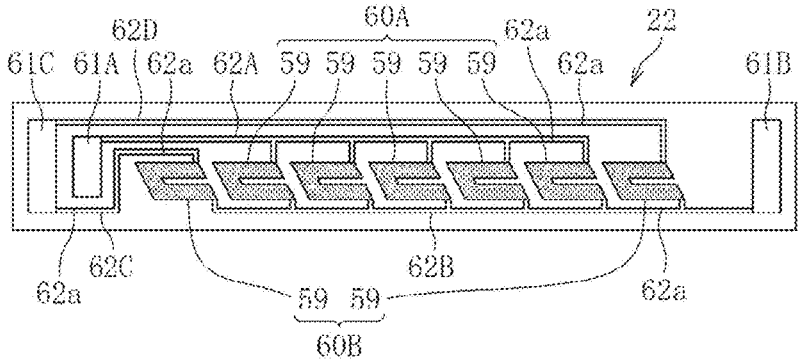
FIG. 51 is a plan view of a modification of the heater different from the heater illustrated in FIG. 43 in the number of times of folding of the resistive heat generators.
Figure 52:
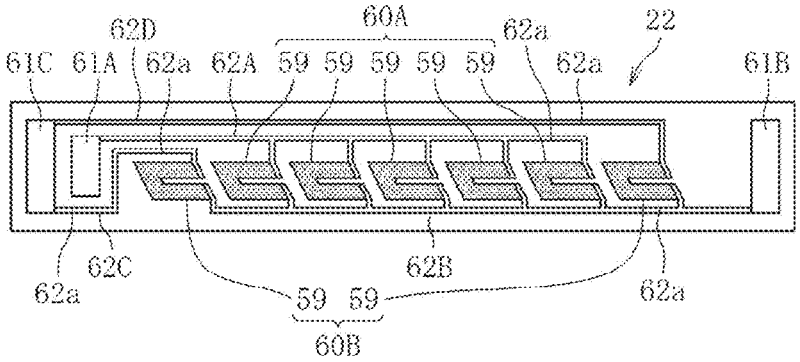
FIG. 52 is a plan view of another modification of the heater different from the heater illustrated in FIG. 43 in the number of times of folding of the resistive heat generators.

The number of times of folding (number of bent parts) of the resistive heat generator 59 is not necessarily plural and may be one as illustrated in FIGS. 51 and 52. The coupling positions X1 and X2 at which the power supply lines 62A and 62B are coupled to the resistive heat generator 59 may be the corners at the end of the resistive heat generator 59 as illustrated in FIG. 51, or may be the entire edge extending in the short-side direction Y at the end of the resistive heat generator 59 as illustrated in FIG. 52.

Also in the heaters 22 described above, the deviation between left and right in the temperature distribution of the fixing belt can be effectively reduced, and unevenness in glossiness and uneven fixing of an image formed on the sheet can be suppressed by switching to whole energization at the timing described before, when the image forming apparatus receives the job of continuously performing printing on a small-size sheet.

Figure 33:
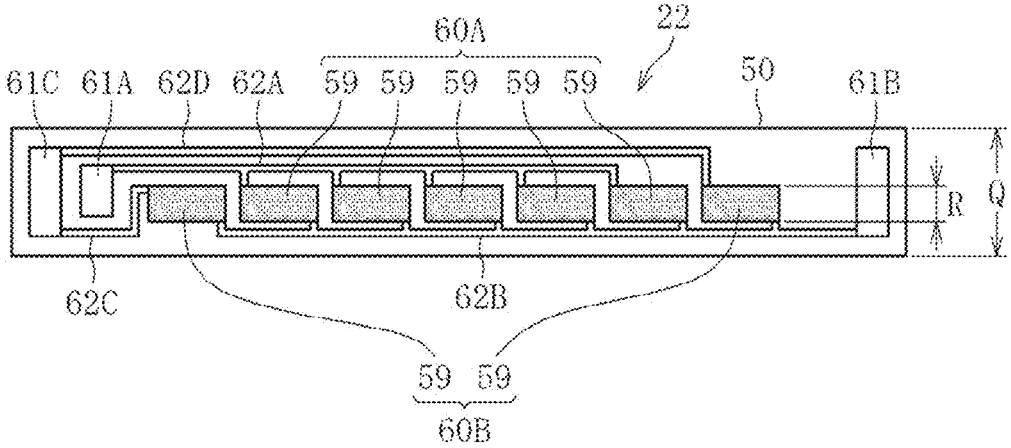
FIG. 33 is a plan view illustrating the size of the heater in the short-side direction and the size of a resistive heat generator in the short-side direction.
Figure 53:
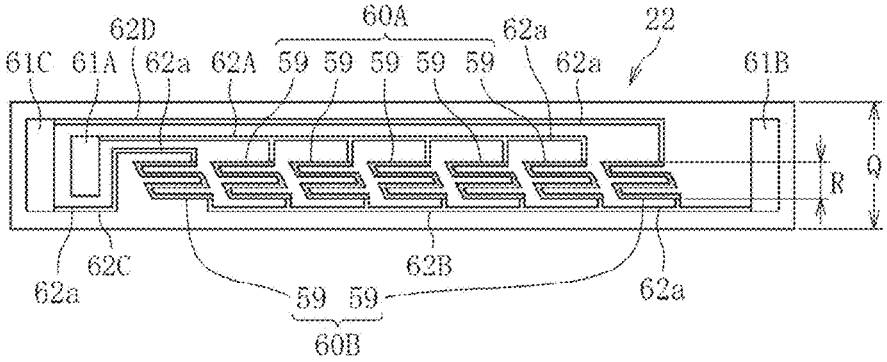
FIG. 53 is a plan view illustrating the size of the heater illustrated in FIG. 43 in the short-side direction and the size of the resistive heat generator in the short-side direction.

The present invention is suitably applied to a heater downsized in the short-side direction in particular. To reduce the size of the heater 22 in the short-side direction, it is necessary to reduce the size of the power supply lines in the short-side direction as described above. Reducing the size of the power supply lines, however, makes the amount of heat generated by the power supply lines relatively larger and increases the effects of heat. Specifically, the present invention is preferably applied to the heater 22 in which the ratio (R/Q) of the size R of the resistive heat generators 59 in the short-side direction to the size Q of the heater 22 (base 50) in the short-side direction is 25% or higher as illustrated in FIG. 33 or 53. The present invention is more preferably applied to the heater 22 in which the ratio (R/Q) of the size in the short-side direction is 40% or higher. Applying the present invention to such a small heater 22 can provide greater advantageous effects.

The following describes the results of an experiment on the temperature deviation between the center and the end of the heater 22 in the longitudinal direction obtained by varying the ratio (R/Q) of the size in the short-side direction. In the experiment, the heaters 22 having the configuration described above were prepared, including the heater 22 having a ratio (R/Q) of the size in the short-side direction of 20% or higher and lower than 25%, the heater 22 having a ratio (R/Q) of 25% or higher and lower than 40%, the heater 22 having a ratio (R/Q) of 40% or higher and lower than 70%, and the heater 22 having a ratio (R/Q) of 70% or higher and lower than 80%. All the resistive heat generators of the heaters were energized at a predetermined voltage under the condition of the heater alone. The surface temperatures at the center and the end of the heater in the longitudinal direction were measured using the infrared thermography camera FLIR T620 manufactured by FLIR Systems, Inc. The experimental results are indicated by Table 2. The results are defined in Table 2 as follows: the heater 22 having a temperature difference between the center and the end of lower than 2° C. is Good; the heater 22 having a temperature difference of 2° C. or higher and lower than 5° C. is Below average; and the heater 22 having a temperature difference of 5° C. or higher is Poor. A heater having a ratio (R/Q) of the size in the short-side direction of 80% or higher is not included in the target of the experiment because there is no space for disposing the power supply lines unless the size of the heater in the short-side direction is significantly increased, for example.

TABLE 1

| Ratio of Size in Short-side Direction | Temperature Difference between Center and End |
|---|---|
| 20 to 25% | Good |
| 25 to 40% | Below average |
| 40 to 70% | Bad |
| 70 to 80% | Bad |

As indicated by Table 1, as the ratio (R/Q) of the size in the short-side direction increased, the temperature difference between the center and the end of the heater increased. Specifically, the heater having a ratio (R/Q) of 20% or higher and lower than 25% was Good. The heater 22 having a ratio (R/Q) of 25% or higher and lower than 40% was Below average. The heater 22 having a ratio (R/Q) of 40% or higher and lower than 70% and the heater 22 having a ratio (R/Q) of 70% or higher and lower than 80% were Poor. As is clear from the results, the unevenness in temperature of the heater in the longitudinal direction becomes conspicuous when the ratio (R/Q) of the size in the short-side direction is 25% or higher and becomes more conspicuous when the ratio (R/Q) is 40% or higher. Consequently, the configuration according to the present embodiment is suitably applied to the heater having these size ratios to reduce the temperature deviation.

In the example illustrated in FIG. 53, the size Q of the heater 22 in the short-side direction is equal at any positions in the longitudinal direction because the base 50 of the heater 22 has a rectangular shape. If the outer peripheries of the base 50 have protrusions and recesses like the example illustrated in FIG. 54, the size Q in the short-side direction varies depending on the positions in the longitudinal direction. In this case, the size Q of the heater 22 in the short-side direction is defined as the size at which the heater 22 is the smallest in the short-side direction Y in a heat generation region H provided with all the resistive heat generators 59.

Figure 54:
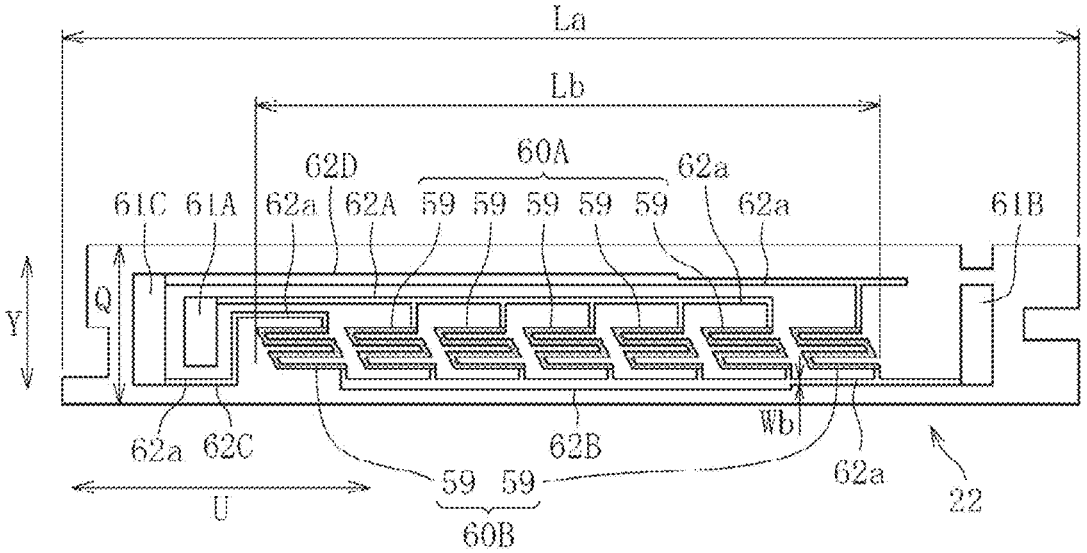
FIG. 54 is a plan view illustrating the size of the heater in the longitudinal and short-side directions and the size of the power supply lines in the short-side direction.

The present invention is also applicable to the following heaters 22: the heater 22 in which the ratio (Q/La) of the size Q of the heater 22 in the short-side direction to the size La of the heater 22 in the longitudinal direction is higher than 1.5% and lower than 6%, and the heater 22 in which the ratio (Wb/Q) of the size Wb of the power supply lines 62A and 62B in the short-side direction to the size Q of the heater 22 in the short-side direction is higher than 2% and lower than 20%. If the size of the base 50 in the longitudinal direction varies depending on the positions like the example illustrated in FIG. 54, the size La of the heater 22 in the longitudinal direction is defined as the size at which the heater 22 is the largest in a longitudinal direction U. The size Wb of the power supply lines 62A and 62B in the short-side direction corresponds to the thickness of the linear part of the power supply lines 62A and 62B extending in the longitudinal direction U of the heater 22. The size Wb does not include the part folded in the short-side direction Y of the heater 22 to be coupled to the resistive heat generator 59. If the thickness of the power supply lines 62A and 62B varies depending on the positions in the longitudinal direction of the heater 22 as illustrated in FIG. 54, the size Wb of the power supply lines 62A and 62B in the short-side direction is defined as the smallest size of the first power supply line 62A or the second power supply line 62B in the short-side direction in a heat generation region Lb.

To suppress unevenness in temperature of the heater 22, resistive heat generators having positive temperature coefficient (PTC) characteristics may be used. The PTC characteristics are the characteristics that the resistance value increases as the temperature increases (output from the heater decreases when a constant voltage is applied). The heat generating unit having the PTC characteristics can start at high speed by high output at low temperature and prevent overheating by low output at high temperature. By setting the temperature coefficient of resistance (TCR) of the PTC characteristics to approximately 300 to 4000 ppm/° C., for example, the resistance value required for the heater can be secured while reducing the cost. The TCR is more preferably set to 500 to 2000 ppm/° C.

The TCR can be calculated using Expression (2). In Expression (2), T0 represents the reference temperature, T1 represents a certain temperature, R0 represents the resistance value at the reference temperature T0, and R1 represents the resistance value at the certain temperature T1. When the resistance value between the first electrode 61A and the second electrode 61B is 10Ω (resistance value R0) at 25° C. (reference temperature T0) and is 12Ω (resistance value R1) at 125° C. (certain temperature T1) in the heater 22 illustrated in FIG. 7, for example, the TCR is calculated to be 2000 ppm/° C. by Expression (2).

$$\text{Temperature Coefficient of Resistance(TCR)}=(R1-R0)/R0/(T1-T0)\times 10^6 \quad (2)$$

Figure 34A:
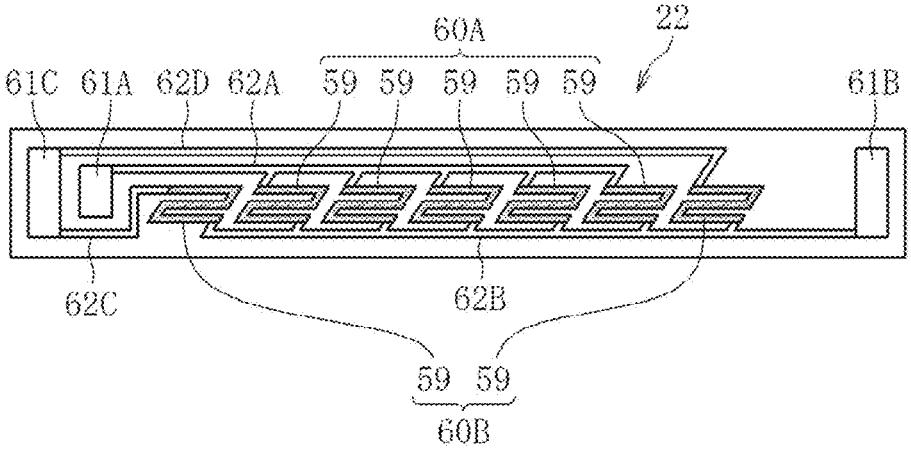
FIGS. 34A and 34B are plan views of modifications of the heater.
Figure 34B:
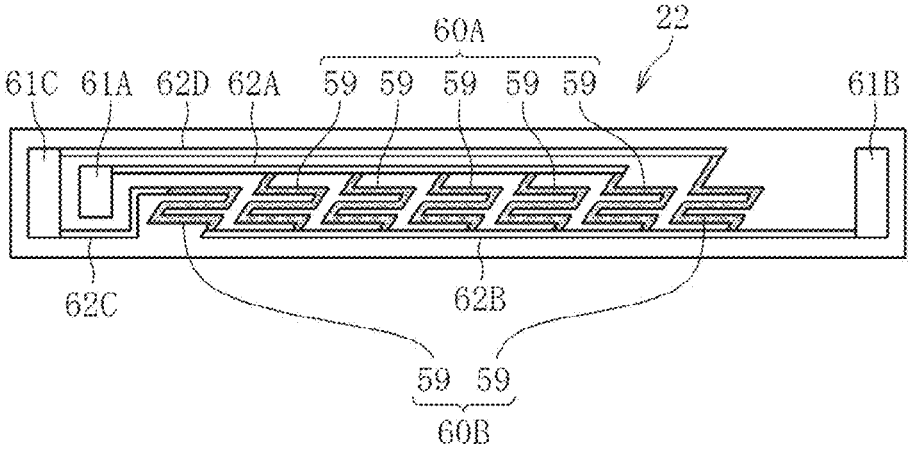

The heater to which the present invention is applied is not limited to the heater 22 including the resistive heat generators 59 having a block shape (rectangular shape) as illustrated in FIG. 7 and other figures. The present invention is also applicable to the heater 22 including the resistive heat generators 59 having a shape formed by folding a linear line as illustrated in FIGS. 34A and 34B, for example, or the heater including the resistive heat generators having other shapes. In FIGS. 34A and 34B, the colored parts indicate the resistive heat generators 59. FIG. 34A illustrates an example where the power supply lines 62A and 62D extending in the longitudinal direction of the heater 22 partially extend in the direction intersecting the longitudinal direction. By contrast, FIG. 34B illustrates an example where the part folded in the direction intersecting the longitudinal direction from the power supply lines 62A and 62D extending in the longitudinal direction of the heater 22 is also included in the resistive heat generators 59.

As described above, the present invention can suppress failures due to the temperature deviation between the first side and the second side in the longitudinal direction of the heater 22 in which the coupling positions of the power supply lines to the resistive heat generator are disposed on the same side. Consequently, the present invention enables making active use of the heater in which the coupling positions are disposed on the same side. This brings the following advantages.

Figure 55:
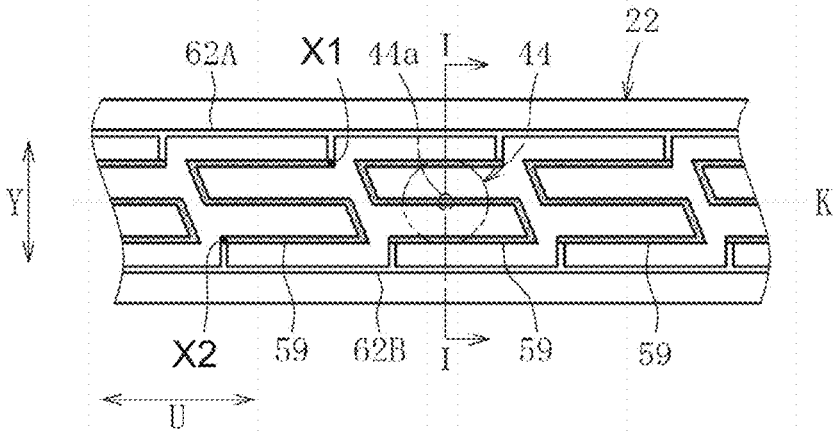
FIG. 55 is a view illustrating the position of the temperature detector in the short-side direction of the heater in which the coupling positions of the power supply lines to the resistive heat generator are opposite to each other.

A fixing device including a planar heater typically includes a temperature detector 44, such as a thermistor, as illustrated in FIG. 55. The temperature detector 44 serves as a heating member temperature detector that detects the temperature of the heater. The temperature detector 44 is provided in contact with the back surface opposite to the surface provided with the heat generating unit 60 of the heater 22, for example. The temperature detector 44 detects the temperature of the heater 22 to control the temperature of the heater 22 or the fixing belt 20. The temperature of the heater 22 is normally higher at the center than at the ends of the heat generating unit 60 in the short-side direction Y. To prevent the heater 22 from being overheated, the temperature detector 44 is provided at the position corresponding to the center K of the heat generating unit 60 in the short-side direction Y of the heater 22 (hereinafter, simply referred to as a "center position in the short-side direction").

Let us assume a case where the coupling positions X1 and X2 of the power supply lines 62A and 62B to the resistive heat generator 59 are opposite to each other in the heater 22 like the example illustrated in FIG. 55, for example. In this case, one of the folded linear parts of the resistive heat generator 59 is disposed at the center position. K of the heat generating unit 60 in the short-side direction. If the temperature detector 44 is disposed at the center position K of the heat generating unit 60 in the short-side direction as described above, a temperature detecting unit 44*a* of the temperature detector 44 is disposed on the resistive heat generator 59 provided at the center position K of the heat generating unit 60 in the short-side direction. The position "on the resistive heat generator" means the position overlapping the resistive heat generator in the thickness direction intersecting the longitudinal direction U and the short-side direction Y of the heater 22.

Figure 56:
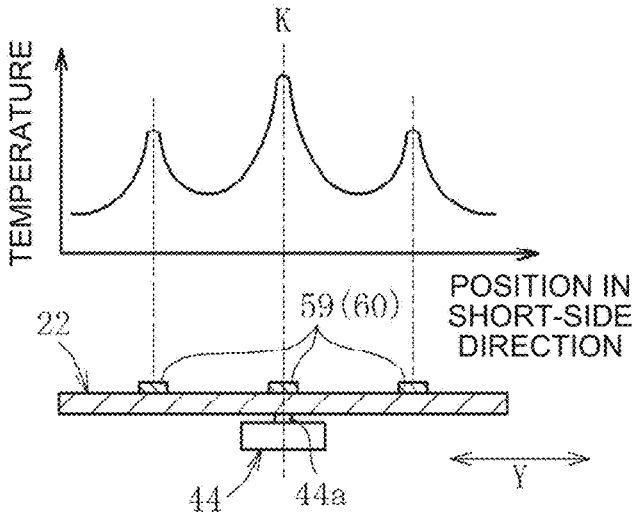
FIG. 56 is a diagram of the temperature distribution of the heater at the section along line I-I of FIG. 55.

As illustrated in FIG. 56, the temperature at the center position K of the heat generating unit 60 in the short-side direction provided with the resistive heat generator 59 corresponds to the highest peak value. The temperature of the peak value is detected by the temperature detector 44. The temperature of the heater 22 significantly varies in an extremely narrow range near the peak value. If the position of the temperature detector 44 slightly deviates in the short-side direction Y of the heater 22, the detected temperature significantly varies. As a result, the temperature detector 44 may possibly fail to appropriately detect the temperature.

Figure 57:
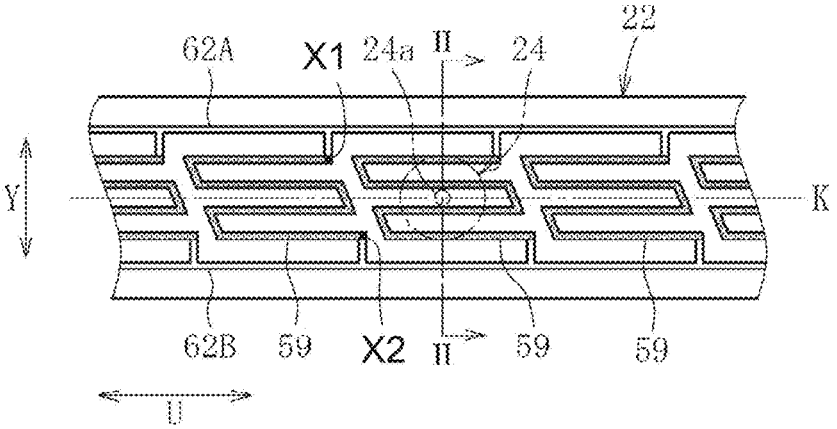
FIG. 57 is a view illustrating the position of the temperature detector in the short-side direction of the heater in which the coupling positions of the power supply lines to the resistive heat generator are disposed on the same side.

By contrast, let us assume a case where the coupling positions X1 and X2 of the power supply lines 62A and 62B to the resistive heat generator 59 are disposed on the same side like the example illustrated in FIG. 57, for example. In this case, the temperature detecting unit 44*a* is disposed not on the resistive heat generator 59 but at the position corresponding to a space between the parts of the resistive heat generator 59 extending in the longitudinal direction U of the heater 22 (part not provided with the resistive heat generator 59). The "position corresponding to a space between the parts extending in the longitudinal direction" means the position overlapping, in the thickness direction of the heater 22, the position of a space between the parts of the resistive heat generator 59 extending in the longitudinal direction U of the heater 22.

Figure 58:
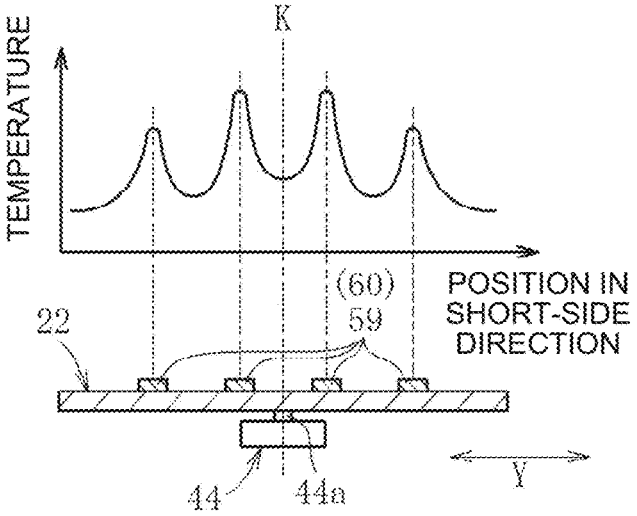
FIG. 58 is a diagram of the temperature distribution of the heater at the section along line II-II of FIG. 57.

As illustrated in FIG. 58, the temperature detector 44 detects the temperature between the adjacent peak values of the heater 22. The temperature between the adjacent peak values gradually varies in a relatively wide range. If the position of the temperature detector 44 deviates in the short-side direction Y of the heater 22, the detected temperature is less likely to vary. Consequently, this structure has the advantage of reducing variation in the detected temperature when the position of the temperature detector 44 deviates. If the position of the temperature detector 44 deviates, the detected temperature is less likely to vary. Consequently, the temperature detector 44 need not be disposed with high accuracy and can be mounted in a simpler manner.

Also in the heater 22 illustrated in FIG. 55, the temperature detecting unit 44*a* can be disposed between the adjacent peak values similarly to the heater 22 illustrated in FIG. 57. In this case, however, the height of the temperature is different between one and the other of the adjacent peak values (refer to FIG. 56). As a result, the amount of variation in the detected temperature varies depending on which peak value the temperature detector 44 deviates to. To suppress variation in the detected temperature, the configuration in which the coupling positions of the power supply lines are disposed on the same side is more desirable than the configuration in which the coupling positions are opposite to each other.

The configuration in which the coupling positions of the power supply lines to the resistive heat generator are disposed on the same side has the advantage over the configuration in which the coupling positions are opposite to each other in the position of the temperature detector 44 in the short-side direction Y of the heater 22.

The temperature detector 44 is preferably disposed in the longitudinal direction U of the heater 22 while noting the followings.

Figure 59:
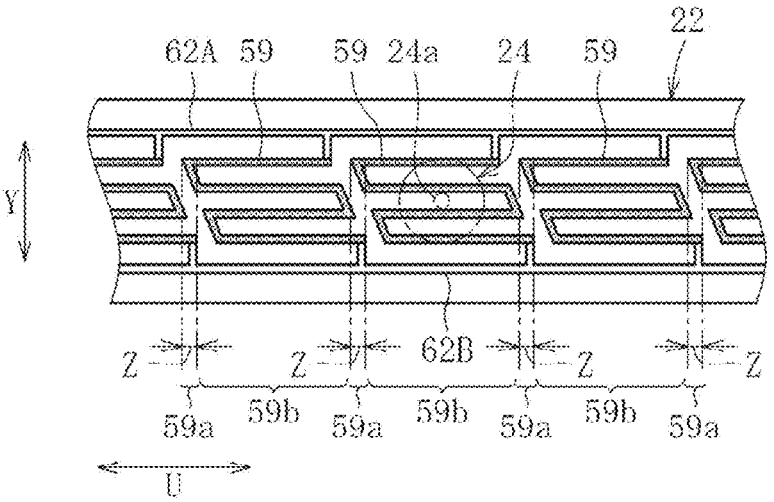
FIG. 59 is a view illustrating the position of the temperature detector in the longitudinal direction of the heater.

As illustrated in FIG. 59, both ends of each of the heat generators 59 in the longitudinal direction U of the heater 22 according to the present embodiment are inclined with respect to the sheet passing direction (vertical direction in FIG. 59). At least part of the ends of the respective resistive heat generators 59 disposed side by side overlap in the longitudinal direction U of the heater 22. In other words, at least the parts of the ends of the respective resistive heat generators 59 disposed side by side are disposed in the same region Z in the longitudinal direction U of the heater 22. The resistive heat generator 59 has an overlapping part 59*a* and a non-overlapping part 59*b*. The overlapping part 59*a* is disposed with the adjacent resistive heat generator 59 in the same region Z in the longitudinal direction U of the heater 22. The non-overlapping part 59*b* is not disposed with the adjacent resistive heat generator 59 in the same region Z in the longitudinal direction U of the heater 22.

The overlapping part 59*a* can suppress temperature fall between the resistive heat generators 59 disposed side by side. In the overlapping part 59*a*, however, the temperature tends to widely vary depending on the positions compared with the non-overlapping part 59*b*. For this reason, the temperature detecting unit 44*a* of the temperature detector 44 is preferably disposed at the position corresponding not to the overlapping part 59*a* but to the non-overlapping part 59*b* as illustrated in FIG. 59. The "position corresponding to the non-overlapping part" means the position overlapping the non-overlapping part 59*b* in the thickness direction of the heater 22.

Figure 35:
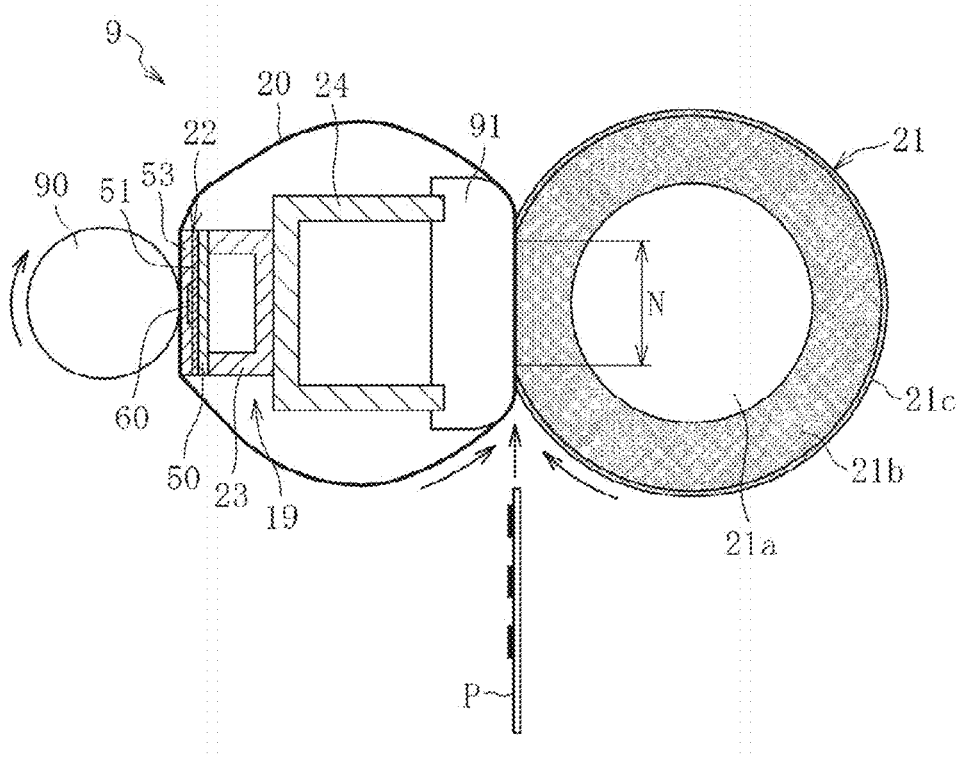
FIG. 35 is a diagram of the configuration of another fixing device.
Figure 36:
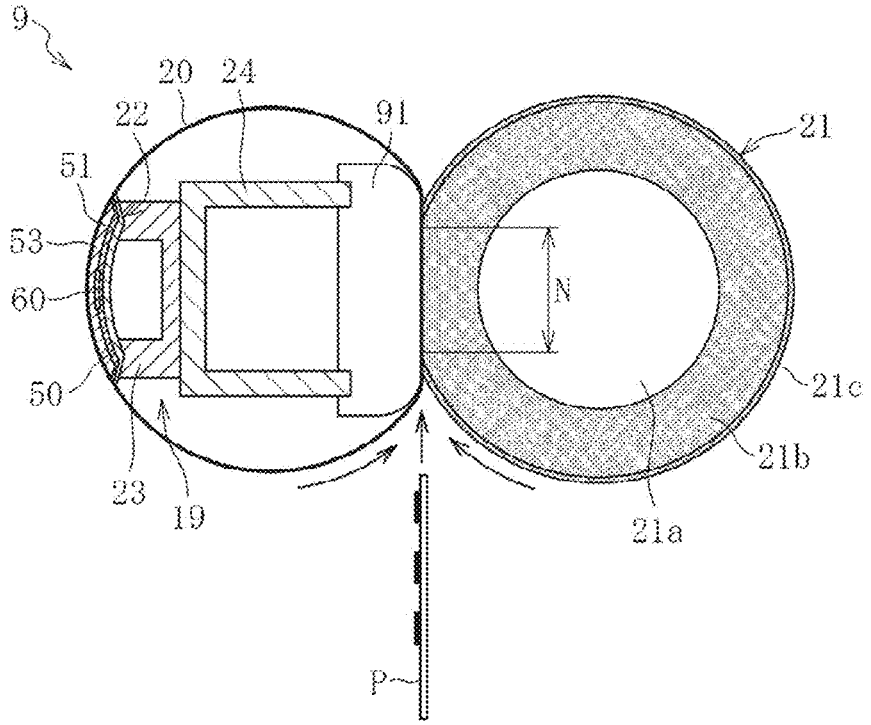
FIG. 36 is a diagram of the configuration of still another fixing device.
Figure 37:
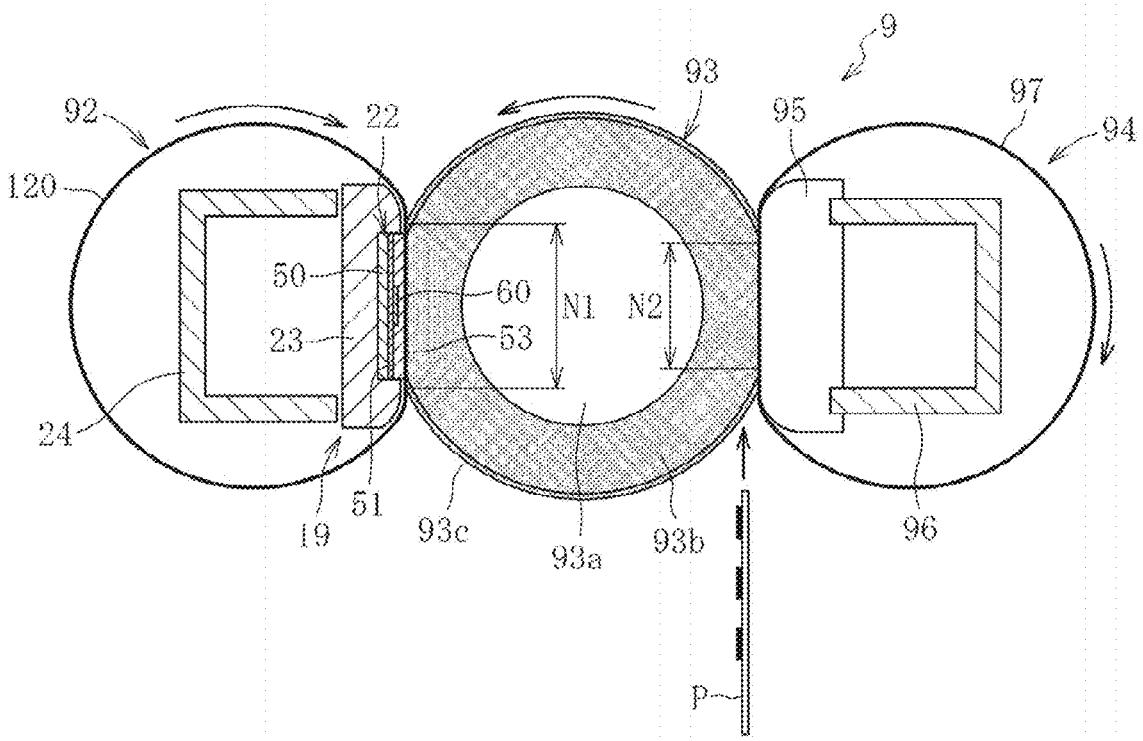
FIG. 37 is a diagram of the configuration of still another fixing device.

The present invention is also applicable to the fixing devices illustrated in FIGS. 35 to 37 besides the fixing devices described above. The following simply describes the configuration of the fixing devices illustrated in FIGS. 35 to 37.

The fixing device 9 illustrated in FIG. 35 includes a pressing roller 90 on the side opposite to the pressure roller 21 across the fixing belt 20. The fixing belt 20 is heated by being sandwiched by the pressing roller 90 and the heater 22. The inner periphery of the fixing belt 20 is provided with a nip forming member 91 on the side closer to the pressure roller 21. The nip forming member 91 is supported by the stay 24. The nip forming member 91 and the pressure roller 21 sandwich the fixing belt 20 to form the nip N.

Also in The fixing device 9 illustrated in FIG. 35, the same measure is taken against the temperature deviation of the heater 22 as described in the embodiments above. Specifically, in an operation of executing the job of continuously forming an image on a plurality of small-size sheets, heat generation (first heat generation state) by partial energization of heating the heat generation region corresponding to the width of the small-size sheet is performed, while heat generation (second heat generation state) by whole energization is performed at a predetermined timing. This can suppress unevenness in temperature and uneven heating of the fixing device 9 due to the temperature deviation between the first side and the second side of the heater 22 in the longitudinal direction. In particular, in the fixing device 9, the temperature deviation between left and right of the fixing belt 20 in the longitudinal direction can be reduced, and unevenness in glossiness and uneven fixing of an image due to the temperature deviation can be suppressed.

The fixing device 9 illustrated in FIG. 36 does not include the pressing roller 90. To secure the length of the contact part of the fixing belt 20 and the heater 22 in the circumferential direction, the heater 22 has an arc shape corresponding to the curvature of the fixing belt 20. The other configuration is the same as that of the fixing device 9 illustrated in FIG. 35.

Finally, the fixing device 9 illustrated in FIG. 37 is described. The fixing device 9 includes a heating assembly 92, a fixing roller 93 serving as a rotator member (fixing member), and a pressure assembly 94 serving as an opposed member. The heating assembly 92 includes the heater 22 described in the embodiments above, the heating unit 19, and a heating belt 120. The fixing roller 93 includes a solid iron cored bar 93*a*, an elastic layer 93*b*, and a release layer 93*c*. The elastic layer 93*b* is formed on the surface of the cored bar 93*a*. The release layer 93*c* is formed outside the elastic layer 93*b*. The pressure assembly 94 is provided opposite to the heating assembly 92 across the fixing roller 93. The pressure assembly 94 includes a nip forming member 95, a stay 96, and a pressure belt 97. The pressure belt 97 is rotatably provided surrounding the nip forming member 95 and the stay 96. Then, the sheet P is made to pass through a fixing nip N2 between the pressure belt 97 and the fixing roller 93 to apply heat and pressure to the sheet P to fix an image thereon.

If the heater 22 has deviation in the amount of generated heat between the first side and the second side in the longitudinal direction (depth direction in FIG. 37) of the heater 22 as described above, the heating belt 120 has temperature deviation between the first side and the second side in the longitudinal direction. In the fixing device 9 illustrated in FIG. 37, the heating assembly 92 heats the fixing roller 93. As a result, the fixing roller 93 also has temperature deviation between the first side and the second side in the longitudinal direction.

Therefore, also in the fixing device 9 illustrated in FIG. 37, heat generation (first heat generation state) by partial energization of heating the heat generation region corresponding to the width of the small-size sheet is performed in an operation of executing the job of continuously forming an image on a plurality of small-size sheets, while heat generation (second heat generation state) by whole energization is performed at a predetermined timing. This can suppress unevenness in temperature and uneven heating of the fixing device 9 due to the temperature deviation between the first side and the second side of the heater 22 in the longitudinal direction. In particular, in the fixing device 9, the temperature deviation between left and right of the heating belt 120 and the fixing rollers 93 in the longitudinal direction can be reduced, and unevenness in glossiness and uneven fixing of an image due to the temperature deviation can be suppressed.

The layout of the electrodes and other components disposed on the base 50 of the heater 22 is not limited to that according to the embodiments above. The present invention is applicable to any heaters that have temperature deviation between the first side and the second side in the longitudinal direction in an operation of heating the small-size sheet described above.

Figure 38:
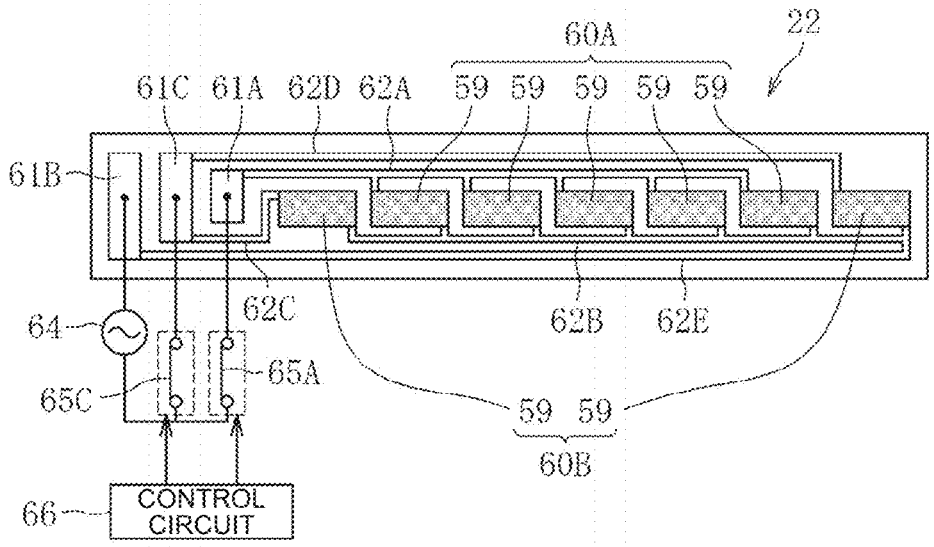
FIG. 38 is a diagram of power supply to the heater having another configuration.

The heater 22 illustrated in FIG. 38, which is an example of other heaters to which the present invention is applied, is different from the embodiments above. In the heater 22, all the electrodes are disposed on the first side in the longitudinal direction. In other words, the heater 22 is different from the heater 22 illustrated in FIG. 10 and other figures in that the second electrode 61B is disposed on the first side in the longitudinal direction. Because the second electrode 61B is disposed on the first side in the longitudinal direction, the power supply line directly coupled to the second electrode 61B extends to and is folded at the second side in the longitudinal direction to be coupled to the resistive heat generators 59 as illustrated in FIG. 38. In the power supply line that couples the second electrode 61B to the resistive heat generators 59 according to the present embodiment, the portion from the part coupled to the resistive heat generators 59 to the folded part on the second side in the longitudinal direction is referred to as the second power supply line 62B. The portion from the part connected to the folded part and extending toward the first side in the longitudinal direction to the second electrode 61B is referred to as a fifth power supply line (conductor) 62E.

The heater 22 also has the temperature deviation in the longitudinal direction described above both when only the first heat generating unit 60A is energized and when the first heat generating unit 60A and the second heat generating unit 60B are energized.

Figure 39:
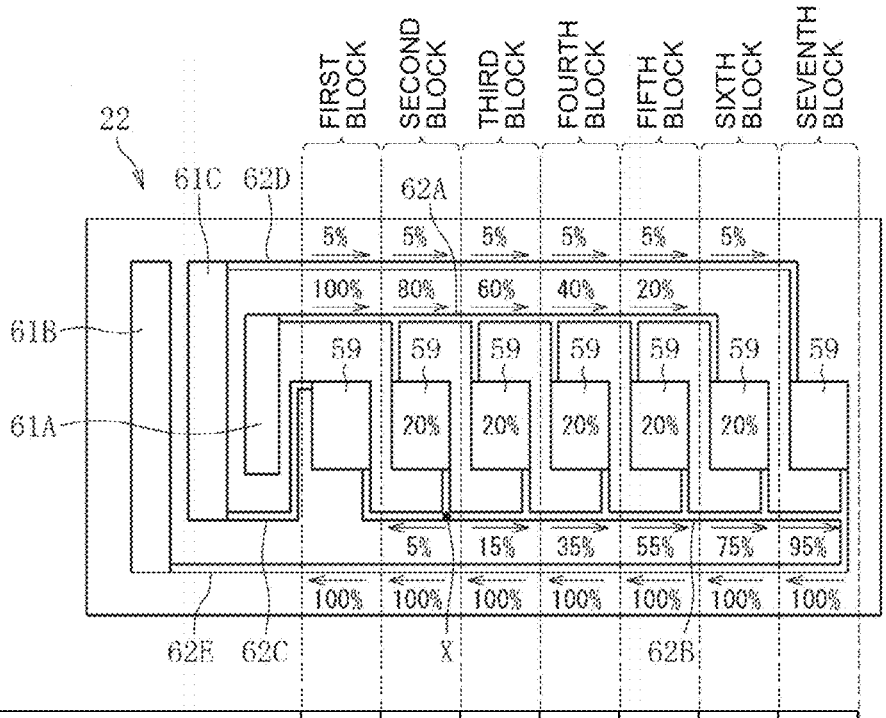
FIG. 39 is a diagram of the amount of heat generated by the power supply lines in the blocks when an unintended branch current is generated in the heater illustrated in FIG. 38.
Figure 40:
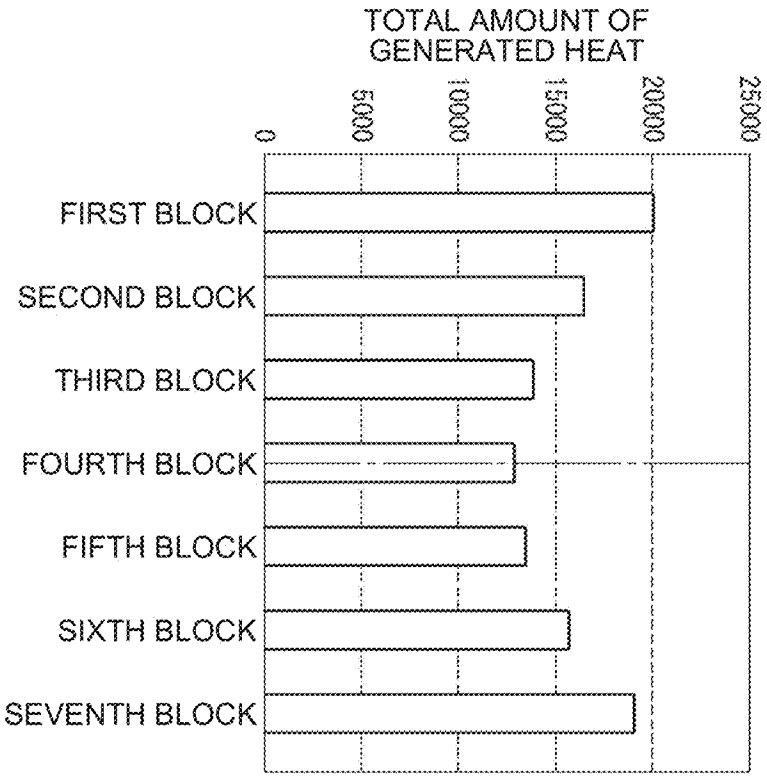
FIG. 40 is a graph of the total amount of heat generated by the power supply lines in the blocks in the case illustrated in FIG. 39.
Figure 41:
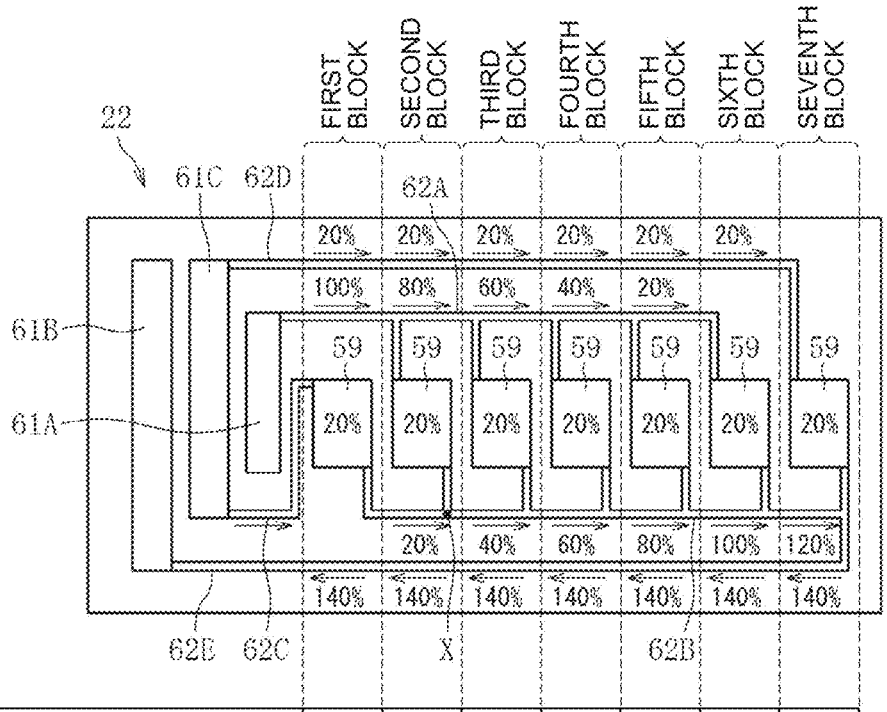
FIG. 41 is a diagram of the amount of heat generated by the power supply lines in the blocks when all the heat generating units are energized in the heater illustrated in FIG. 38.
Figure 42:
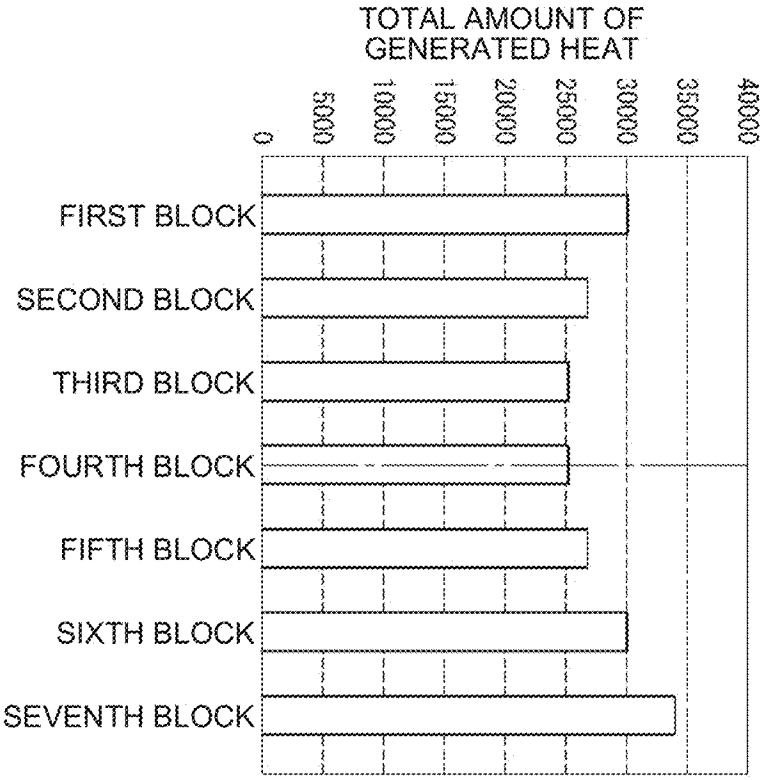
FIG. 42 is a graph of the total amount of heat generated by the power supply lines in the blocks in the case illustrated in FIG. 41.

If only the first heat generating unit 60A is energized, an unintended branch current toward the third power supply line 62C is generated as illustrated in FIGS. 39 and 40. As a result, the total amount of heat generated in the blocks are asymmetrical with respect to the fourth block positioned at the center of the heat generation region. The amount of heat generated on the first side in the longitudinal direction is larger than that on the second side. If the first heat generating unit 60A and the second heat generating unit 60B are energized, the total amount of heat are also asymmetrical with respect to the fourth block as illustrated in FIGS. 41 and 42. The amount of heat generated on the second side in the longitudinal direction is larger than that on the first side.

Figure 60:
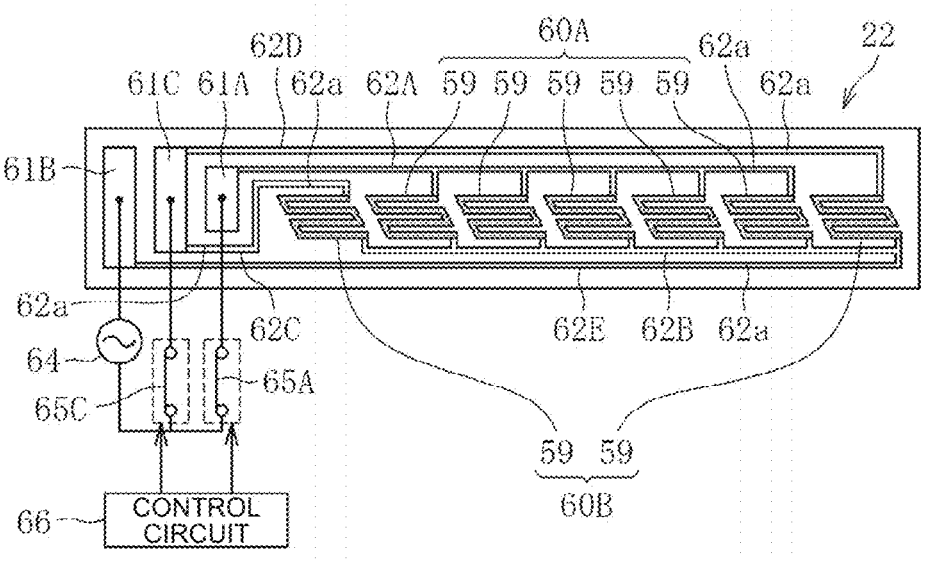
FIG. 60 is a diagram of power supply to the heater different from the heater illustrated in FIG. 38 in the configuration of the resistive heat generators.

In the heater 22 in which all the electrodes are disposed on the first side in the longitudinal direction, the resistive heat generators 59 may be each formed by folding the linear part in the longitudinal direction as illustrated in FIG. 60. Also in the present embodiment, an unintended branch current is generated in partial energization. As illustrated in FIG. 61, in partial energization, the amount of heat generated by the power supply lines in the second block is the largest in the heat generation region by the resistive heat generators 59 of the first heat generating unit 60A. As a result, the amount of heat generated on the first side in the longitudinal direction is larger than that on the second side. As illustrated in FIG. 62, in whole energization, the amount of heat generated in the seventh block is the largest, and the amount of heat generated on the second side in the longitudinal direction is larger than that on the first side.

Similarly to the embodiment illustrated in FIG. 10 and other figures, also in the heater 22 of these embodiments, heat generation (first heat generation state) by partial energization of energizing only the first heat generating unit 60A serving as the heat generation region corresponding to the width of the small-size sheet is performed in an operation of executing the job of continuously forming an image on a plurality of small-size sheet, while heat generation (second heat generation state) by whole energization of energizing the first heat generating unit 60A and the second heat generating unit 60B is performed at a predetermined timing. This can suppress unevenness in temperature and uneven heating of the fixing device 9 due to the temperature deviation between the first side and the second side of the heater 22 in the longitudinal direction. In particular, in the fixing device 9, the temperature deviation between left and right of the fixing belt 20 in the longitudinal direction can be reduced, and unevenness in glossiness and uneven fixing of an image due to the temperature deviation can be suppressed.

The present invention is not necessarily applied to the fixing device described in the embodiments above. The present invention is also applicable to drying devices that dry ink applied to a sheet and thermocompressively bonding devices, such as laminators that thermocompressively bond a film serving as a covering member to the surface of a sheet, such as paper, and heat sealers that thermocompressively bond a sealing part of a packaging material. Also in these devices, the present invention can suppress unevenness in temperature and uneven heating of the heating device due to the temperature deviation between the first side and the second side of the heating member in the longitudinal direction.

Besides the sheet P (plain paper), examples of the recording medium include, but are not limited to, thick paper, postcard, envelope, thin paper, coated paper (e.g., coat paper and art paper), tracing paper, OHP sheet, plastic film, prepreg, copper foil, etc.

An embodiment can suppress unevenness in temperature and uneven heating of a heating device due to temperature deviation between a first side and a second side of a heating member in a direction intersecting the conveying direction of a recording medium.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus capable of forming an image on a plurality of recording media having different lengths in a direction intersecting a conveying direction of the plurality of recording media, the image forming apparatus comprising:

a heating device comprising a rotator member, a heating member configured to heat the rotator member, and an opposed member configured to contact with the rotator member to form a nip, wherein the heating member is switchable between a first heat generation state in which an amount of heat generated on a first side of the heating member is larger than an amount of heat generated on a second side of the heating member in the intersecting direction and a second heat generation state in which the amount of heat generated on the second side of the heating member is larger than the amount of heat generated on the first side of the heating member, and the image forming apparatus is configured to switch between the first heat generation state and the second heat generation state while executing a job of continuously forming an image on a plurality of recording media having a same length in the intersecting direction, wherein the heating member comprises a first heat generating unit and a second heat generating unit, the first heat generating unit comprising at least one resistive heat generator, the second heat generating unit comprising resistive heat generators provided on both sides outside the first heat generating unit n the direction intersecting the cone ring direction, the heating member is configured to be brought into the first heat generation state by energizing only the first heat generating unit, and into the second heat generation state by energizing the first heat generating unit and the second heat generating unit, and the image forming apparatus is configured to switch from energizing the first heat generating unit to energizing the first heat generating unit and the second heat generating unit while executing a job of continuously forming an image on a plurality of recording media having a length corresponding to a length of the first heat generating unit, in the direction intersecting the conveyance direction.

2. The image forming apparatus according to claim 1, wherein the heating member further comprises a plurality of conductors, a first electrode, a second electrode, and a third electrode, the first electrode being coupled to the first heat generating unit via a conductor of the plurality of conductors, the second electrode being coupled in common to the first heat generating unit and the second heat generating unit via a conductor of the plurality of conductors, the third electrode being coupled to the second heat generating unit via a conductor of the plurality of conductors.

3. The image forming apparatus according to claim 2, wherein the third electrode is disposed on a same side as the first electrode and outside the first electrode in the direction intersecting the conveyance direction.

4. The image forming apparatus according to claim 1, further comprising a temperature detector configured to detect a temperature of a surface of the rotator member, wherein the temperature detector comprises a first-side temperature detector and a second-side temperature detector, the first-side temperature detector being provided at a position corresponding to an end on the first side in the direction intersecting the conveyance direction, of the first heat generating unit, the second-side temperature detector being provided at a position corresponding to an end on the second side in the direction intersecting the conveyance direction, of the first heat generating unit, and the image forming apparatus is configured to switch the heating member from the first heat generation state to the second heat generation state when a value obtained by subtracting a temperature detected by the second-side temperature detector from a temperature detected by the first-side temperature detector exceeds a predetermined upper temperature difference threshold.

5. The image forming apparatus according to claim 4, wherein the image forming apparatus is configured to switch the heating member from the second heat generation state to the first heat generation state when the value obtained by subtracting the temperature detected by the second-side temperature detector from the temperature detected by the first-side temperature detector is lower than a predetermined lower temperature difference threshold.

6. The image forming apparatus according to claim 1, further comprising a temperature detector configured to detect a temperature of a surface of the rotator member, wherein the temperature detector comprises a first-side temperature detector and a second-side temperature detector, the first-side temperature detector being provided at a position corresponding to an end on the first side in the direction intersecting the conveyance direction, of the first heat generating unit, the second-side temperature detector being provided at a position outside an end on the second side in the direction intersecting the conveyance direction, of the first heat generating unit, the position corresponding to the second heat generating unit, and the image forming apparatus is configured to switch the heating member from the first heat generation state to the second heat generation state when a temperature detected by the first-side temperature detector exceeds a predetermined threshold, and a temperature detected by the second-side temperature detector is lower than a predetermined lower threshold.

7. The image forming apparatus according to claim 6, wherein the image forming apparatus is configured to switch the heating member from the second heat generation state to the first heat generation state when the temperature detected by the second-side temperature detector exceeds a predetermined upper threshold.

8. The image forming apparatus according to claim 1, wherein the heating member further comprises a plurality of resistive heat generators, a plurality of conductors, and a plurality of electrodes coupled to the plurality of resistive heat generators via the plurality of conductors, and coupling positions at which respective conductors of the plurality of conductors are coupled to the plurality of resistive heat generators are disposed on a same side of a center position of the plurality of resistive heat generators in the direction intersecting the conveying direction of the plurality of recording media.

9. The image forming apparatus according to claim 1, wherein a ratio of a size of the resistive heat generators of the heating member to a size of the heating member in the conveying direction of the plurality of recording media is 25% or higher.

10. The image forming apparatus according to claim 1, wherein a ratio of a size of the resistive heat generators of the heating member to a size of the heating member in the conveying direction of the plurality of recording media is 40% or higher.

11. The image forming apparatus according to claim 1, wherein the resistive heat generators of the heating member are disposed along the direction intersecting the conveying direction of the plurality of recording media, and the heating member has an overlapping part in which the resistive heat generators overlap in the conveying direction of the plurality of recording media.

12. The image forming apparatus according to claim 11, wherein the heating member has a non-overlapping part in which the resistive heat generators of the heating member do not overlap one another in the conveying direction of the plurality of recording media and only one of the resistive heat generators of the heating member is disposed in a region in the direction intersecting the conveying direction, and a heating member temperature detector configured to detect a temperature of the heating member is provided at a position overlapping the non-overlapping part in a thickness direction of the heating member.

13. The image forming apparatus according to claim 1, wherein the image forming apparatus is configured to switch from the first heat generation state to the second heat generation state at a point of time when a predetermined number of recording media has reached the nip or a predetermined period of time has passed since start of an image formation operation.

14. The image forming apparatus according to claim 1, wherein the heating member is configured to generate heat in the second heat generation state from start of an image formation operation to then a first recording medium in the job reaches the nip.

15. The image forming apparatus according to claim 1, wherein the heating member is configured to generate heat in the second heat generation state from when a trailing end of a recording medium passes through the nip to when a leading end of a next recording medium reaches the nip.

16. The image forming apparatus according to claim 1, wherein the heating device is configured to fix toner on the plurality of recording media by heat.

17. An image forming apparatus capable of forming an image on a plurality of recording media having different lengths in a direction intersecting a conveying direction of the plurality of recording media, the image forming apparatus comprising:

a heating device comprising a rotator member, a heating member configured to heat the rotator member, and an opposed member configured to contact with the rotator member to form a nip, wherein the heating member comprises a first heat generating unit and a second heat generating unit, the first heat generating unit comprising at least one resistive heat generator, the second heat generating unit comprising resistive heat generators provided on both sides outside the first heat generating unit in the direction intersecting the conveying direction, and the image forming apparatus is configured to switch from energizing only the first heat generating unit to energizing the first heat generating unit and the second heat generating unit while executing a job of continuously forming an image on a plurality of recording media having a length corresponding to a length of the first heat generating unit, in the direction intersecting the conveyance direction.

18. The image forming apparatus according to claim 17, wherein the heating device is configured to fix toner on the plurality of recording media by heat.

* * * * *